United States Patent [19]

Brouwer et al.

[11] 4,347,872

[45] Sep. 7, 1982

[54] AIR WEFT INSERTION SYSTEM

[75] Inventors: Charles W. Brouwer, East Greenwich, R.I.; H. Gary Osbon, Kalamazoo, Mich.; Karl W. Wueger, Wakefield, R.I.

[73] Assignee: Leesona Corporation, Warwick, R.I.

[21] Appl. No.: 64,180

[22] Filed: Aug. 6, 1979

[51] Int. Cl.[3] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 1,368,691 | 2/1921 | Brooks | 139/435 |
| 2,622,961 | 12/1952 | Finlayson et al. | 226/97 |
| 2,662,556 | 12/1953 | Svaty | 139/435 |
| 2,668,560 | 2/1954 | Svaty | 139/435 |
| 3,065,769 | 11/1962 | Svaty | 139/435 |
| 3,065,770 | 11/1962 | Svaty et al. | 139/435 |
| 3,139,118 | 6/1964 | Svaty et al. | 139/435 |
| 3,633,808 | 1/1972 | Svaty | 139/435 |
| 3,655,862 | 4/1972 | Dorschner et al. | 226/97 |
| 3,782,422 | 1/1974 | Vermeulen | 139/435 |
| 3,828,829 | 8/1974 | Gotoh et al. | 139/435 |
| 3,863,822 | 2/1975 | Keldany | 139/435 |
| 3,938,561 | 2/1976 | Scheffel | 139/435 |
| 3,999,579 | 12/1976 | Ohkouchi et al. | 139/435 |
| 4,074,727 | 2/1978 | Kwok et al. | 139/435 |
| 4,134,435 | 1/1979 | Corneiller | 139/435 |

OTHER PUBLICATIONS

Space-Age Wind Tunnels Reshape Old Notions of Streamlining by John Saar, Smithsonian Magazine, Jan. 1982, pp. 76–84.

Analysis of the Air Flow in the Channel of Pneumatic Looms, by V. A. Pilipenko, Tech. of Textile Industry, USSR, 1965, No. 2.

A Study of Some Factors Involved in Pneumatic Weft Propulsion, by V. Duxbury et al., Textile Institute, 1959, pp. 558–573.

A Study on an Air Jet Loom with Substreams Added, Parts 1,2,3 & 4, by Minour Uno, Journal of Textile Machinery Society of Japan Transactions, vol. 25, Nos. 3, 4 & 7, 1972.

Journal of the Textile Machinery of Japan 1961 (Jul.)–A Study on Air-Jet Looms.

*Primary Examiner*—Henry Jaudon

*Attorney, Agent, or Firm*—Burnett W. Norton

[57] ABSTRACT

A method and apparatus for inserting a weft strand into the shed of a loom or the like in which a confined zone is provided in proximity to the shed serving as a guide for a weft strand passing through the zone, and a sustained pulse of a supersonic gaseous medium is abruptly expelled from the zone directed toward said shed to thereby pass the weft strand through at least a portion of the shed. The strand is preferably confined to a preselected path during passage of the pulse of medium and the strand through at least the stated portion of said shed.

50 Claims, 87 Drawing Figures

FIG. 2A.
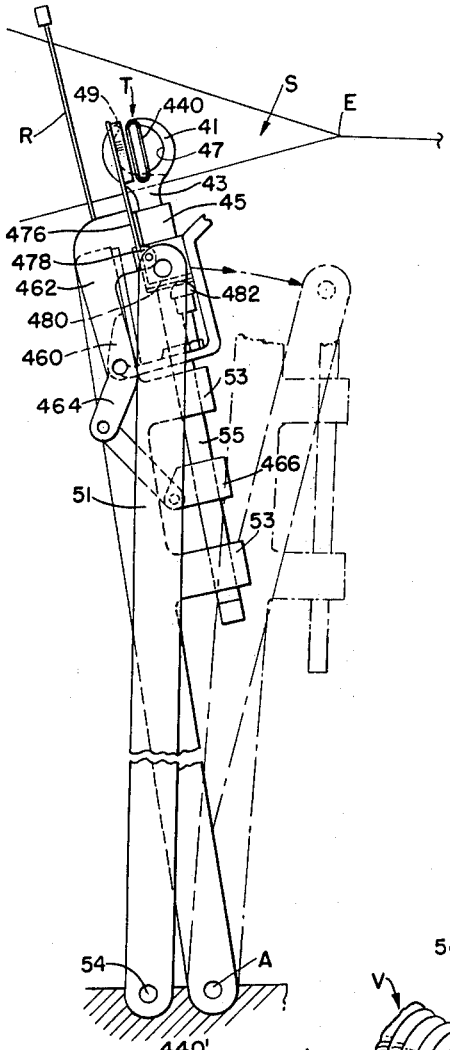
FIG. 2B
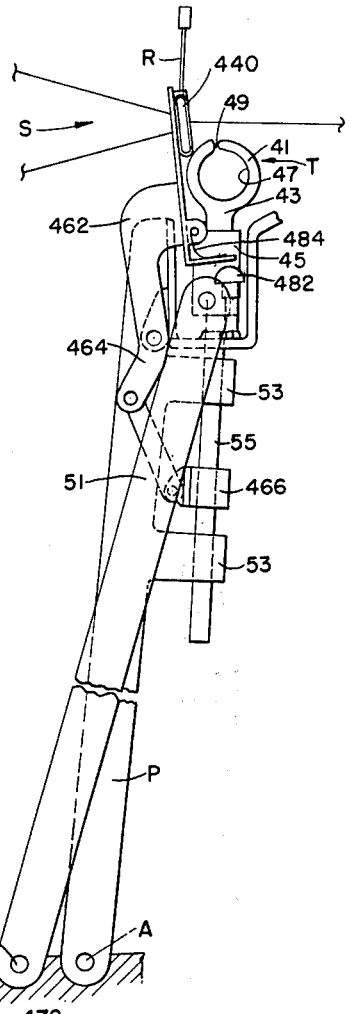
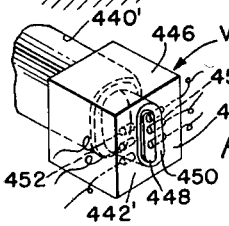
FIG. 19.
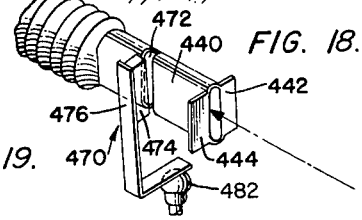
FIG. 18.

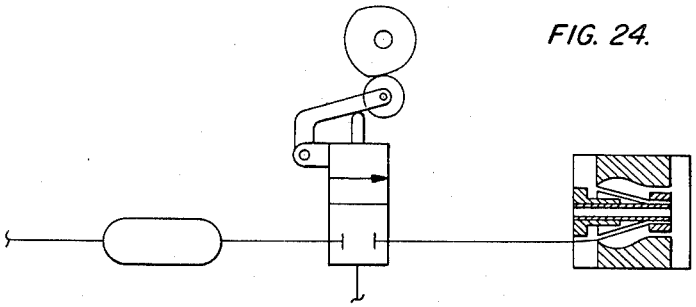
FIG. 24.
FIG. 7.
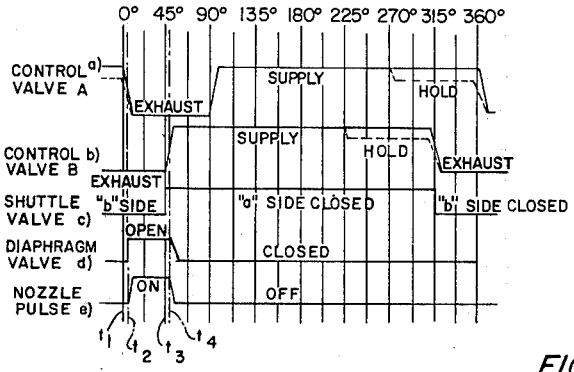
FIG. 12.
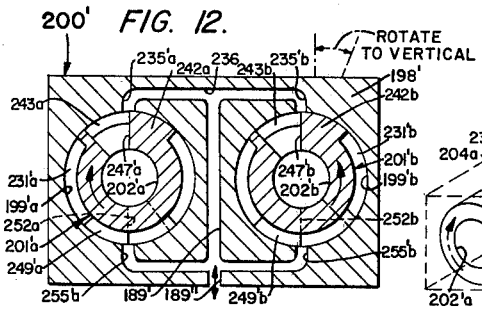
FIG. 11.
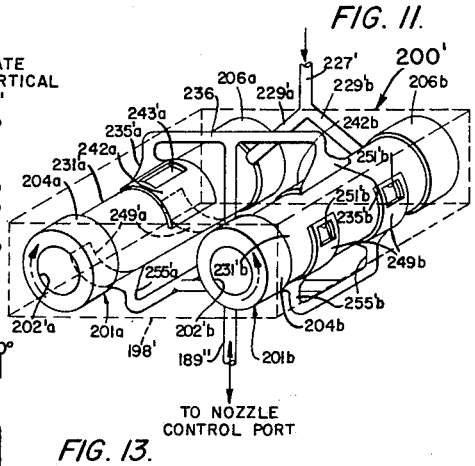
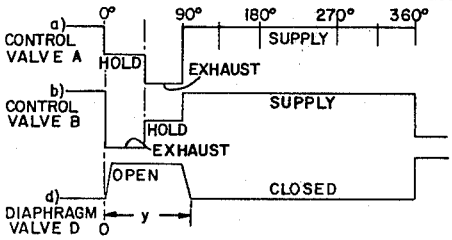
FIG. 13.

ELECTRIC CIRCUIT DIAGRAM

AIR WEFT INSERTION SYSTEM

INDEX

A. Field of Invention
B. Background and Prior Practice
C. Discovery of the Invention
D. Statement of Objects
E. Brief Description of Drawings
F. General Description of System of Invention
G. Detailed Description of Invention
I. Apparatus
a. Interrupted Guidance Tube Withdrawal Mechanism
b. Weft Lift-Out Mechanism
c. Weft Insertion Nozzle Assembly
(1) Single Embodiment
(2) Modified Embodiment (Floating "Pill")
d. Self-Threading Nozzle Feeder
e. Pilot Pressure Control System for Insertion Nozzle
(1) Electrical Embodiment
(2) First Mechanical Embodiment
(3) Mechanical Embodiment Alternative Design
f. Weft Metering and Storage
(1) Preferred Rotating Drum Embodiment
(2) Alternative Fixed Drum Embodiment
g. Weft Reception and Arrival Detection
h. In-Shed Weft Tensioning
i. Fabric Selvage Formation
j. Air Circuit
k. Electrical Circuit Diagram
l. Conversion of Shuttle Looms
II. Operation and Comparative Tests
a. Introduction
b. Nozzle Pressure
(1) Definition of Choking
c. Nozzle Contour
(1) "Supersonically Contoured" Nozzle—Effect of Contoured Nozzle With and Without Extension Barrel on Air and Weft Arrival Times (Table I)
(2) "Straight" Nozzle—Effect of Throat Area Variations on Air and Weft Arrival Times (Table II)
d. Nozzle Supply Capacity
(1) Effect of Capacity Variation on Weft Arrival Times (Table III)
e. Air Pulse Duration
(1) Effect of Pulse on Air and Weft Arrival Times (Table IV)
f. Comparative Simulation of Prior Art
(1) Effect of Prior Art Simulation With Varying Nozzle Area of Air and Weft Arrival Times (Table V)
(2) Comparison of Pressure Traces of Prior Art and Inventive Systems
g. Other Conditions
(1) Effect of Varying Air Velocity on Air Arrival Time (Table VI)
(2) Effect of Varying Spacing Between Nozzle and Guidance Tube (Table VII)
(3) Effect of Varying Nozzle Mach No. on Air Weft Arrival Time (Table VIII)
(4) Effect of Varying Nozzle Area on Projected Energy Consumption (Table IX)
h. Balanced Mode i. Other Conventional Factors
j. Specific Examples

A. FIELD OF THE INVENTION

This invention relates to a loom weaving system in which the weft is inserted through the shed of the loom by means of a pulse-like jet of air or other pressurized gaseous medium (hereinafter referred to generally as an air weft insertion system) and is concerned more particularly with an efficiently operating air weft insertion system capable of substantially increasing the insertion velocity of the air jet through the loom shed compared to existing systems with a corresponding reduction in actual weft insertion times to adapt the system for high speed weaving.

B. BACKGROUND OF THE INVENTION AND PRIOR PRACTICE

In all weaving, an initially flat array of longitudinally extending warp threads is divided into at least two interspersed groups which are separated in opposite directions from the starting plane to define between the separated warp groups an elongated diamond shaped space, known as a "shed", through which the weft or filling is inserted, the direction of separation of the warp groups being reversed in a given order after each such weft by means of a harness motion with the result that the warp threads are entwined in sinuous fashion around successive filling threads to form the woven fabric. Traditionally, the weft is carried in coiled form upon a bobbin held within a shuttle, and as the weaving progresses, the shuttle is propelled alternatively back and forth through the shed on the upper surface of a beam-like lay which carries a comb-like reed projecting upwardly therefrom and rocks back and forth to press or "beat up" each new weft by means of the reed against the working end or "fell" of the fabric being woven. In the traditional loom, bobbin propulsion was accomplished by means of so-called picker sticks mounted on the loom adjacent opposite side edges of the warp for pivotal movement about their lower ends and driven to alternately impact their upper ends against the shuttle. Obviously, this conventional design was subject to inherent limitations as to achievable shuttle speed and was, moreover, accompanied by substantial disadvantages; namely, deafening operating noise as well as risk of breakage of picker sticks or other damage to equipment and of danger to operating personnel when, as occasionally happened, the shuttle escaped its containment and became an uncontrolled projectile. In order to overcome these inherent problems in bobbin type weaving, the prior art has explored various alternatives, and in the past decade or so, increasing attention has been directed to the possibility of impelling the weft thread through the shed by means of a jet of fluid. Jets of water have been found to be a relatively manageable projection medium, but water is a possible cause of corrosion and limits the choice of yarn material; thus there are significant advantages in the use of a gaseous fluid. While gases other than air can in theory serve equally well, cost considerations dictate the choice of air as the only practical gaseous propelling medium; consequently, this mode of weaving will hereinafter be referred to for convenience as "air weft insertion", although the use instead of other gases is, in principle, intended to be included.

In general, air projection techniques that have been used in past air weft insertion systems fall into two basic categories. In one type, the weft end is initially projected by means of a pressurized air from a nozzle situated outside and adjacent one side of the warp shed which serves to initially accelerate the weft end and starts its travel through the shed. The propulsion forces of existing nozzles is severely limited in terms of the attainable length of projection of the weft end and hence, in this type, a plurality of "booster" or supplemental jet nozzles is provided at spaced intervals through the shed, such nozzles being inserted within and removed in various ways from the shed interior via the clearance between the warp yarns. The aggregate of the propulsion forces of this multi-stage sequence of nozzles can be sufficient to convey the weft thread across the full width of the loom.

While this approach has proved generally feasible in practice, it too is faced with definite disadvantages, viz, the requirement for carefully controlled timing of the sequence of nozzle action plus excessive consumption of compressed air and thus poor economic efficiency.

In order to avoid the need for booster nozzles disposed at intervals through the shed, an alternative approach has been developed in a second type which utilizes a single exterior insertion nozzle in conjunction with a weft guidance "tube" situated within the shed. Since during weaving, the groups of warp threads must shift up and down past one another, the presence of any continuous body within the shed during shedding is out of the question. Therefore, an "interrupted" weft guidance tube is used, taking the form of a plurality of generally annular segments, each shaped to sufficiently narrow thickness in its axial dimension as to pass between adjacent warp threads arranged in an axially aligned position so as to constitute together a lengthwise interrupted tubular member extending substantially the entirety of the shed width. Each annular segment has a slot-like exit opening at a point on its periphery to allow integral egress of the inserted weft thread when the guidance tube is withdrawn below the shed. When the weft thread is projected by the exterior nozzle into one end of this interrupted guidance tube, the projection force imparted to the thread by the nozzle appears to be substantially enhanced so that the distance the weft thread is propelled by this force can be significantly increased compared to the nozzle alone.

The reasons why the interrupted guidance tube extends the projection force of the nozzle are not totally understood at present. The adjacent segments of this tube are separated by clearance spaces which are sufficient to permit pressurized air delivered into one end of the tube to disperse to the outside atmosphere while the interior edges of the bore of the segments should present considerable frictional resistance to movement of an air jet therethrough; from this standpoint the effect of such a tube might be expected to be negative. On the other hand, ambient air could be entrained from the ambient atmosphere into the interior of the tube through the same intersegment spaces with the possible effect of augmenting the propelling forces. In any event, it is established that the addition of a weft guidance tube generally as described above substantially increases the distance a weft thread can be projected with a jet of compressed air emitted from a nozzle.

Numerous improvements have been suggested in this second type of air weft insertion system which in general have focused upon refinements in various aspects of the system, including enhancing the effect of the guidance tube by means, for instance, of arrangements capable of temporarily reducing the clearance space between the segments thereof during the weft insertion phase of the cycle or by developing superior aerodynamic characteristics for such elements, optimizing the delivery of a measured weft length to the insertion nozzle through a variety of weft measuring and storage devices intended to minimize the resistance of the weft length to propulsion and hence utilize to maximum advantage the thrust capability of a given nozzle, and the like. With rare exceptions, the prior art efforts in this type of system have given little attention to the fundamental behavior of the air delivery stream itself.

It is known according to aerodynamic theory that the thrusting force (dF applied by a moving gaseous stream to an element disposed therein with a given unit length (dx) and a circumference ($\pi$D) is determined by the equation:

$$dF = C_f \tfrac{1}{2}\rho(V_g - V_e)^2 \cdot \pi D \cdot dx \qquad \text{I}$$

where $\pi$ is the density of the gaseous medium, $C_f$ is a factor varying with the condition of the element and is roughly constant for a given thread, $V_g$ is the velocity of the medium, $V_e$ is the velocity of the element and D is the diameter of the element. In a given system the diameter and factor $C_f$ will ordinarily be fixed; hence, thrusting force is essentially a function of the density of the medium and the square of the difference in velocity between the moving gaseous medium and the element. In inserting weft in the shed of a loom, the weft will normally be stationary prior to the insertion so that $V_e$ becomes zero and the starting thrusting force, therefore, is essentially proportional to $\rho V_g^2$.

The practical application of this result is somewhat complicated by the generally opposing behavior of velocity and density in the system in question. At velocities below sonic speed (sonic speed being referred to as a Mach No. of 1 or "Mach 1"), velocity varies with the square root of the head pressure so that in order, for example, to double the velocity the pressure must be quadrupled. At a given head pressure, as the air accelerates along the nozzle, the pressure drops and is accompanied by a decrease in density according to the relationship required for adiabatic processes. When $V_g$ reaches sonic velocity in the throat of the nozzle, the rate of change in $\rho$ has become exactly equal to the rate of change of $V_g$ and $\rho V_g$ thus has its maximum value at the throat for a given supply pressure. At all velocities above sonic velocity, $\rho$ decreases more rapidly than $V_g$ increases. From Mach 1 to Mach 1.414, the relative rates of change are such that $\rho V_g^2$ continues to increase, while above Mach 1.414 $\rho$ decreases at sufficiently higher rates than $V_g$ increases that $\rho V_g^2$ becomes smaller so that for example $\rho V_g^2$ is approximately the same at Mach 2 as at Mach 1.

As the head pressure is made greater, $V_g$ increases, as mentioned, until sonic velocity is achieved, but further increases in head pressure produce increases only in the ultimate level of $\rho$ in the throat and not in $V_g$. That is, the highest throat velocity possible is Mach 1 irrespective of increases in pressure, which only serve to make the gas more dense. Acceleration of the gas to supersonic speed is possible only by increasing the volume of the space downstream of the throat to allow the densified gas to expand and decrease $\rho$, and hence make it possible for $V_g$ to increase. If the nozzle throat opens directly into the ambient atmosphere, the gas can expand randomly for a short distance while if the nozzle has a convergently contoured section below the throat (and thus forms a so-called super-sonic nozzle) the gas can expand in a controlled fashion.

For gas velocities above Mach 1 downstream of the throat, the pressure increase required for a given change in Mach No. is a geometrical rather than a linear function. For example, the theoretical ratio of head pressure to ambient pressure for Mach 1 is approximately 1.9, for Mach 1.414 approximately 3.25/1, for Mach 2 about 7.9/1 and in practice should be somewhat higher.

Clearly from these technical considerations, increasing $V_g$ by increasing head pressure definitely appears to be an unpromising way in terms of cost effectiveness of increasing the thrusting force dF in the above-equation since at below sonic speeds a given theoretical increase in $V_g$ requires the head pressure to be increased by the square of the difference and this disproportionality between velocity change and head pressure change comes even worse at above sonic velocities. Further, the gas velocity in the throat can in any case never exceed sonic speed and the essential thrusting force $\rho V_g^2$ itself is subject to limiting value at the low level of Mach 1.414 and can thereafter only decline.

To the apparent technical cost disadvantage of high nozzle pressures must be added the practical necessity for pressurized air used for weft insertion to be free of contaminants such as oil and dust particles. The production of such clean air requires special centrifugal compressors and/or special filtration devices which substantially increase the machinery investment for a given installation.

For these and other reasons, prior art workers in weft insertion systems have without known exception accepted the principle of a low pressure air supply and low air jet velocity as unavoidable conditions and have striven to use these given conditions with maximum effectiveness, placing their concentration on other techniques, as stated.

In any weaving operation, each weaving cycle divides into two main phases, the weft insertion phase, which occurs generally at the rearward end of the lay rocking motion, and the beat up phase, which occurs when the lay is rocked forwardly to the other limit of its arcuate path to pack, or beat up, the newly inserted weft end (or pick) against the fell of the already woven fabric, with the fabric being stepwise advanced as needed to maintain the fell at a fixed location. Various attempts have been made to shorten the beat up phase, so as to thereby increase overall weaving speed, by employing, for example, special mechanical drives designed to accelerate lay movement during beat up, and specially constructed lays with shortened pivot supports and reduced mass to shorten the arc of lay travel and lessen inertial forces involved in driving the lay, all of which can be advantageous. There are, however, inherent limitations on how far beat up time can be reduced in this way; consequently, the achievement of truly high speed loom operation, i.e. in the order of 1,000 weft insertions or picks per minute, is ultimately possible only by taking less time to insert the weft itself. Specifically, at 1,000 picks per minute, only a total of 60 milliseconds is available for an entire weft insertion or picking cycle, i.e. the lapsed time from one beat up to the next. Prior art air weft insertion systems normally require at least 50–60 milliseconds for weft insertion alone, apart from the beat up phase, and have, therefore, been inherently limited in operating speeds.

There are presently in use or available for use in the textile industry several millions of existing shuttle-type looms which were designed for operation at speeds of up to about 150–200 picks per minute and cannot be adapted for high speed operation without a virtual complete rebuilding. However, with a fairly modest amount of mechanical modification, such looms can be driven at speeds of about 400 cycles per minute. At this speed, the period required for one complete cycle is 150 ms, and in theory, weft insertion times in the order of 50–60 ms as characteristic of the prior art might be tolerable in a cycle of this duration. However, at insertion times of this order, loom operation would become somewhat critical due to the large proportion of total cycle time consumed by the insertion time, and might require special "dwell motions" for this purpose. Consequently, it would be of a definite benefit in the conversion of existing shuttle looms to air weft insertion for the weft insertion time to be reduced substantially below the prior art level and thereby impart greater flexibility to and reduce criticality in the operation of such converted looms.

C. SUMMARY OF THE INVENTION

As stated above, if a compressible gas is supplied to a nozzle converging at some point to an opening or throat of minimum cross-sectional area, and the pressure acting on the gaseous medium is gradually increased, the velocity of the gas at the throat can at most only equal sonic speed, and any further increase in the pressure on the gas only increases the density of the gas stream without any increase in gas velocity above sonic velocity. At this condition, the nozzle is said to be "choked" and the minimum ratio of head pressure to ambient pressure at which this choking condition occurs is equal to approximately two.

According to the invention, it has been discovered contrary to all reasonable expectations that if in a weft insertion system including an interrupted guidance tube, a convergent weft insertion nozzle is supplied with air at a pressure exceeding the pressure required to choke the nozzle throat for a controlled sustained time, the nozzle in fact has the capacity for effective utilization of the pressure energy of the air for transporting the weft, permitting projection of the weft through the loom shed in periods of time substantially less than with prior art systems of this type and that it becomes possible to avoid excessive energy consumption by modulation of the pressure output from the nozzle without significant reduction in weft transporting performance.

D. STATEMENT OF OBJECTS

The ultimate object of the present invention is, therefore, the provision of an improved air weft insertion system which is adapted for utilization equally in the conversion of existing shuttle looms as in a specially redesigned new loom and is characterized by improved performance and reliability with reduced consumption of compressed air energy.

A further object of the invention is the provision of a weft insertion air nozzle designed with the capacity for maximum transmission of thrust to the weft.

A still further object of the invention is an actuation control unit for the improved weft insertion nozzle which can either be electrically or mechanically activated and makes possible accelerated and precisely reproducible response times in the firing of the nozzle.

Another object of the invention is an improved weft metering and storage unit capable of automatically supplying a length of weft precisely matched to the width of the loom to the insertion nozzle without complex control instrumentation.

Another object of the invention is an improved mounting for an interrupted in-shed weft guidance tube which is effective to positively withdraw the guidance tube outside of the shed automatically during the beat-up motion of the lay.

Another object of the invention is a weft lift-out device serving to positively remove the inserted weft from the guidance tube in response to the beat up of the lay.

A further object of the invention is the creation of an improved fabric selvage utilizing a combination of a leno selvage weave with an adjacent pair of twisted binder threads which maintains the integrity of the selvage.

A still further object is an improved support for the weft reception tube which automatically adjusts the position of that tube to maintain the same in registration with the path of the weft throughout the weaving cycle.

These and other objects and advantages will be explained in greater detail by the following detailed description when read in conjunction with the accompanying drawings in which:

E. BRIEF DESCRIPTION OF DRAWINGS

These and other objects and advantages will be more fully explained by the following complete description when read in conjunction with the accompanying drawings in which:

FIGS. 2A and 2B are enlarged detail views looking at the left end of the lay of the loom of FIG. 1 in rearward weft inserting position and forward beat up position, respectively, showing the compound motion of the weft guidance tube;

FIG. 7 is a wave form diagram illustrating the operation of the control unit of FIG. 6;

FIG. 11 is a side perspective view of a modified mechanically operating air control unit for the insertion nozzle of the invention with the housing shown only in outline and the air conduits appearing schematically as conduits;

FIG. 12 is a vertical section somewhat diagrammatic through the modified mechanical control unit of FIG. 11 and including the housing;

FIG. 13 is a wave form diagram illustrating the operation of the mechanical control unit of FIGS. 11 and 12;

FIG. 18 is a detail view of one form of weft reception tube with an associated weft engaging clamp;

FIG. 19 is a detail view of a modified weft reception tube incorporating photoelectric detection devices for signalling the arrival of the weft end;

FIG. 24 is a schematic view indicating diagrammatically an arrangement for simulating a prior art air weft insertion system;

Figure 27:
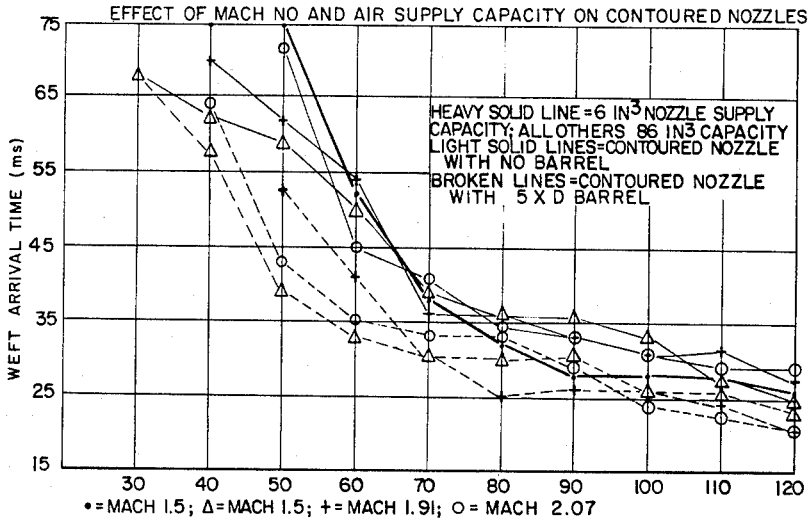
Figure 37:
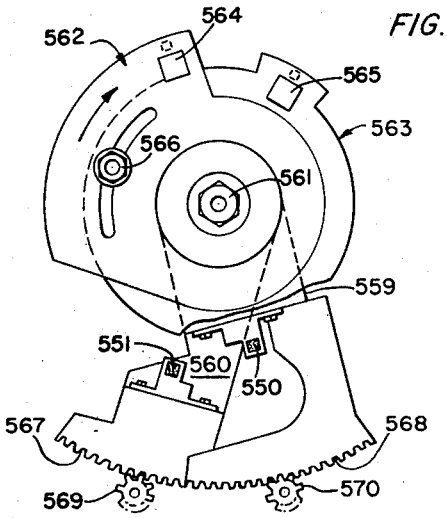
Figure 22:
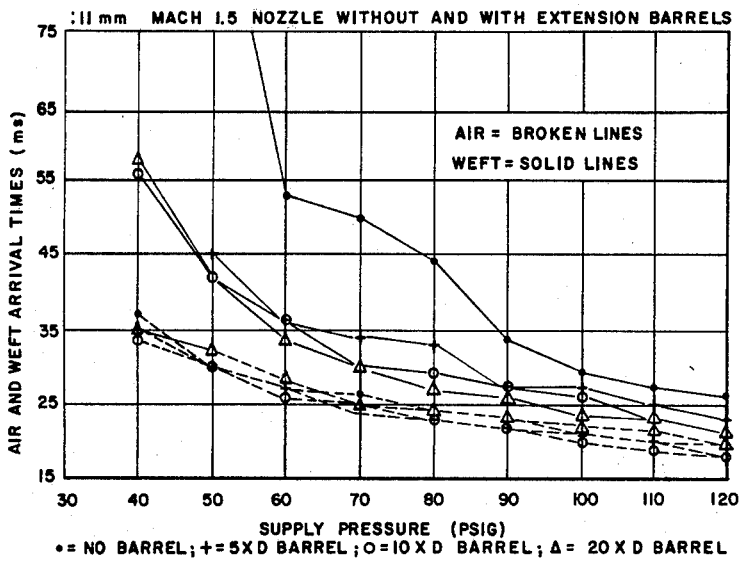
FIG. 22 is a graph plotting air and weft arrival times against supply pressure over a range of 40–120 psig for an 11 $mm^2$ supersonically contoured nozzle with and without extension barrels of lengths equal to 5, 10 and 20 times the diameter of the nozzle outlet.
Figure 23:
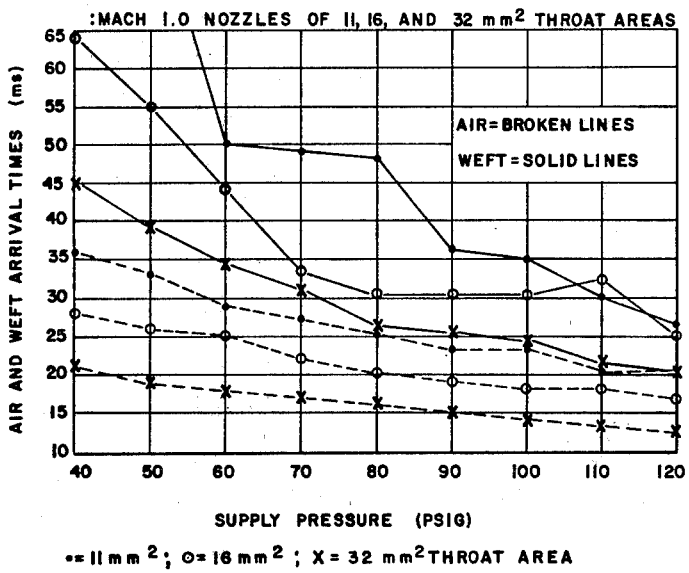
FIG. 23 is a graph similar to FIG. 22 for three uncontoured nozzles having throat areas of 11, 16 and 32 $mm^2$, respectively, without extension barrels.
Figure 25:
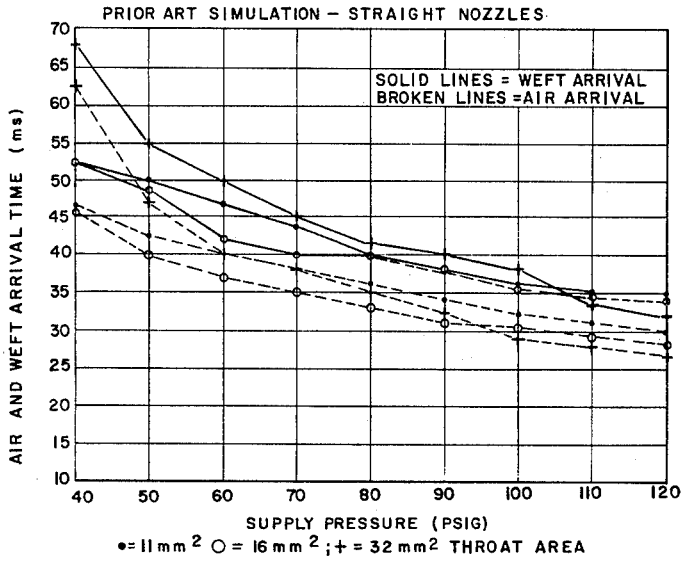
FIG. 25 is a comparative graph similar to FIG. 23 but representing the performance of a simulation of a prior art air weft insertion system using uncontoured nozzles of varying throat areas.
Figure 29A:
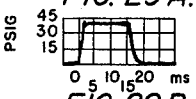
Figure 29B:
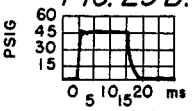
Figure 29C:
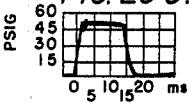
Figure 29D:
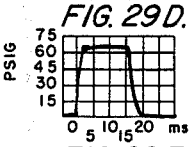
Figure 29E:
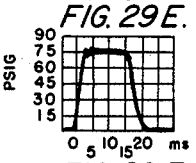
Figure 29F:
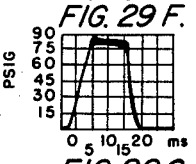
Figure 29G:
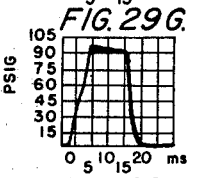
Figure 29H:
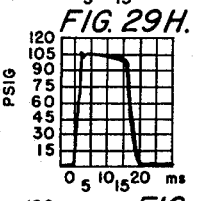
Figure 29I:
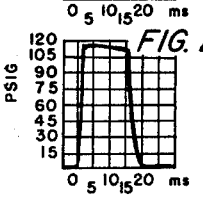
Figure 30A:
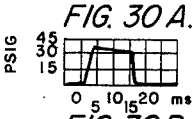
Figure 30B:
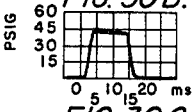
Figure 30C:
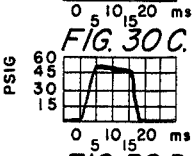
Figure 30D:
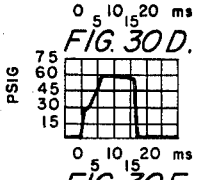
Figure 30E:
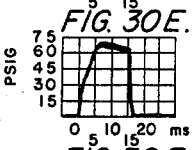
Figure 30F:
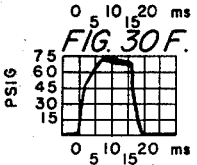
Figure 30G:
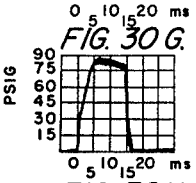
Figure 30H:
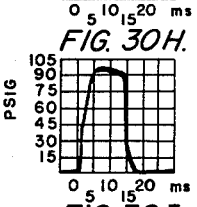
Figure 30I:
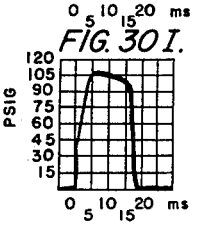
Figure 31A:
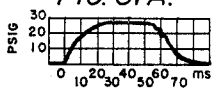
Figure 31B:
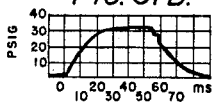
Figure 31C:
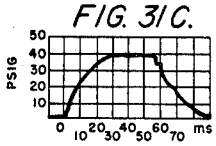
Figure 31D:
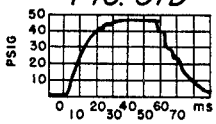
Figure 31E:
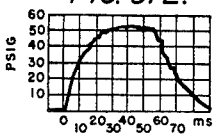
Figure 31F:
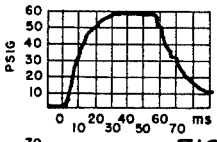
Figure 31G:
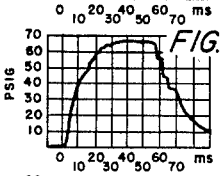
Figure 31H:
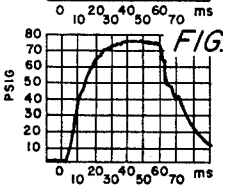
Figure 31I:
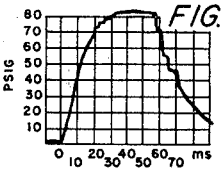
Figure 32A:
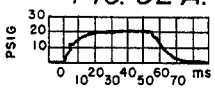
Figure 32B:
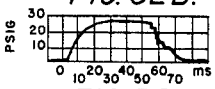
Figure 32C:
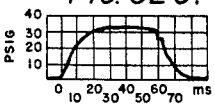
Figure 32D:
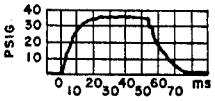
Figure 32E:
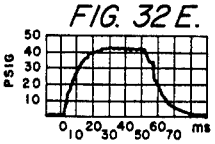
Figure 32F:
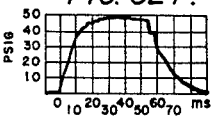
Figure 32G:
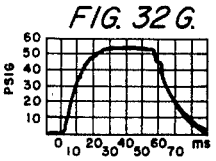
Figure 32H:
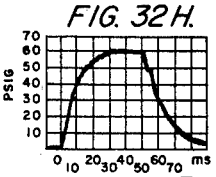
Figure 32I:
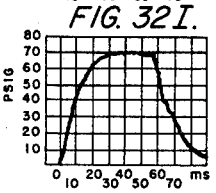
Figure 33A:
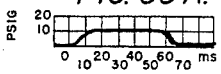
Figure 33B:
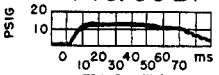
Figure 33C:
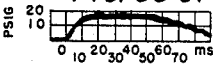
Figure 33D:
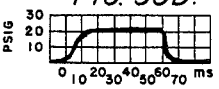
Figure 33E:
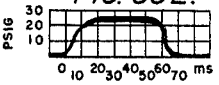
Figure 33F:
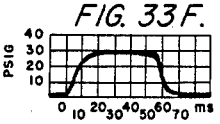
Figure 33G:
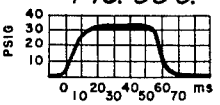
Figure 33H:
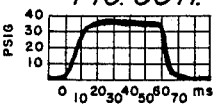
Figure 33I:
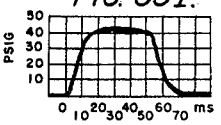
Figure 34A:
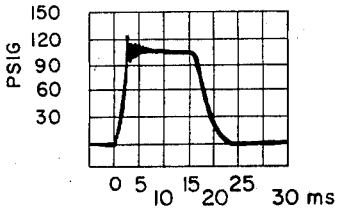
Figure 34B:
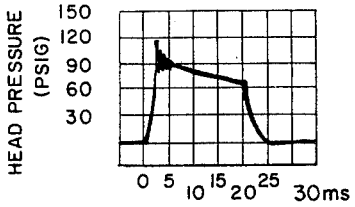
Figure 36:
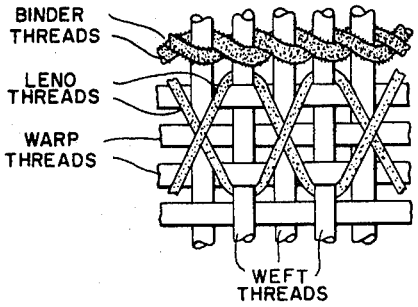
Figure 35:
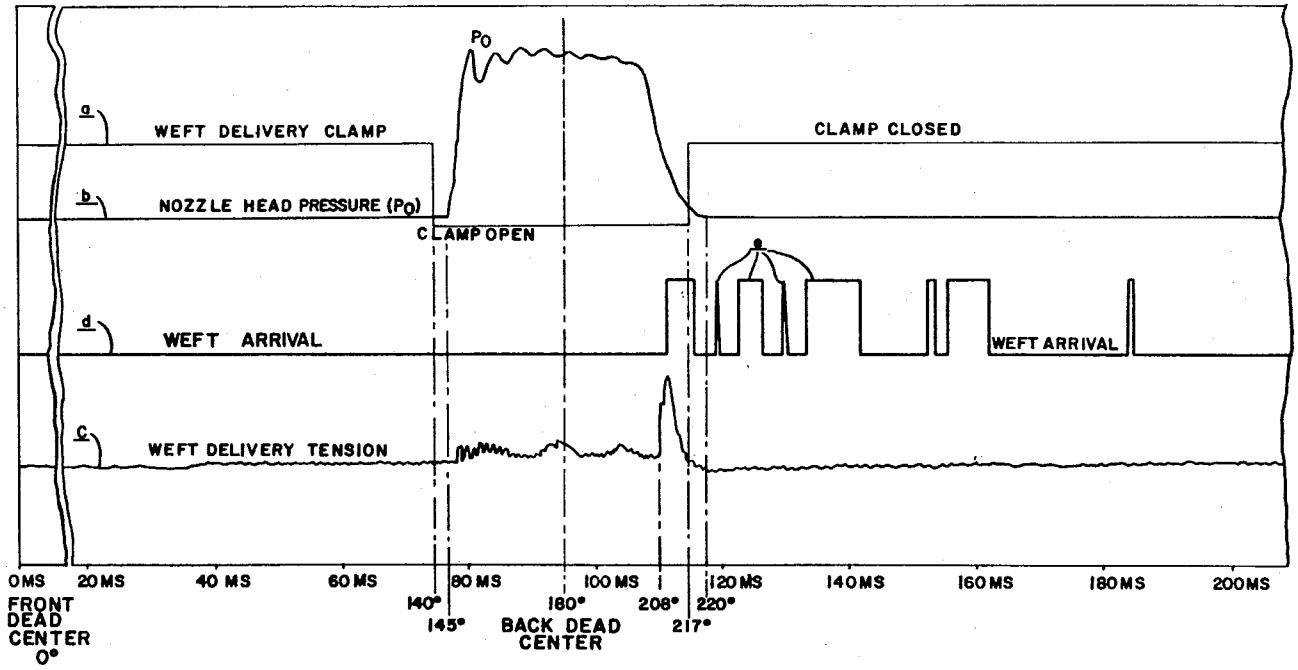

FIG. 27 is a plot similar to FIGS. 22 and 23 of the system of the invention comparing the weft arrival times over a range of supply pressures of 30–120 psig for supersonically contoured nozzles ranging from Mach 1.5 to Mach 2.07, with and without an extension barrel equal in length to five times the nozzle outlet diameter, supplied with air from a large capacity accumulator, with the Mach 1.5 nozzle being also operated with a low capacity accumulator for comparative purposes;

FIGS. 28A–I represent reproductions of actual oscillographically derived pressure traces showing the changes in head pressure versus time in air pulses generated by the 11 $mm^2$ throat area uncontoured nozzle of FIG. 23 when operated at 10 psi intervals over the range of supply pressures of 40–120 psig;

FIGS. 29A–I are reproductions of pressure traces similar to FIGS. 28A–I but for a 16 $mm^2$ throat area uncontoured nozzle and on a different scale;

FIGS. 30A–I are recreations of pressure traces similar to FIGS. 28A–I and 29A–I but for the 32 $mm^2$ throat area uncontoured nozzle and on the same scale as FIG. 29A;

FIGS. 31A–I are comparative recreations of pressure traces similar to FIGS. 28A–I but on a different scale for the prior art simulation of FIGS. 24 and 25 utilizing an 11 $mm^2$ throat area uncontoured nozzle;

FIGS. 32A–I are comparative recreations of pressure traces similar to FIGS. 29A–I but on a different scale for the prior simulation with a 16 $mm^2$ throat area uncontoured nozzle;

FIGS. 33A–I are comparative recreations of pressure traces similar to FIGS. 30A–I but on a different scale for the prior art simulation with a 32 $mm^2$ throat area uncontoured nozzle;

FIG. 34A is a recreation in terms of head pressure versus time on a still different scale of a pressure trace generated by the preferred nozzle in the system of the invention equipped with an added supply capacity or accumulator; while FIG. 34B is a recreation of a pressure trace for the identical system absent any added supply capacity or accumulator and illustrating the change in time in peak pulse pressure at the lower supply capacity compared with the pulse of FIG. 34A;

FIG. 35 is a reproduction of an actual "strip chart" produced by a multi-channel oscilloscope monitoring one operative cycle of a loom according to the invention following the preferred balanced mode of operation, and showing wave forms corresponding to nozzle throat pressure, delivery clamping actuation, weft delivery tension, and weft arrival at the reception tube;

FIG. 36 is an enlarged detail plan view of a fragment of the selvage of the fabric produced by the invention, revealing the combination of twisted binder strands with a leno selvage weave; and FIG. 37 is a detail view of a mechanical arrangement for actuating the clamp open and close switches permitting precise adjustment of the actuation times thereof.

F. GENERAL DESCRIPTION OF SYSTEM OF INVENTION

Figures 1, 3:
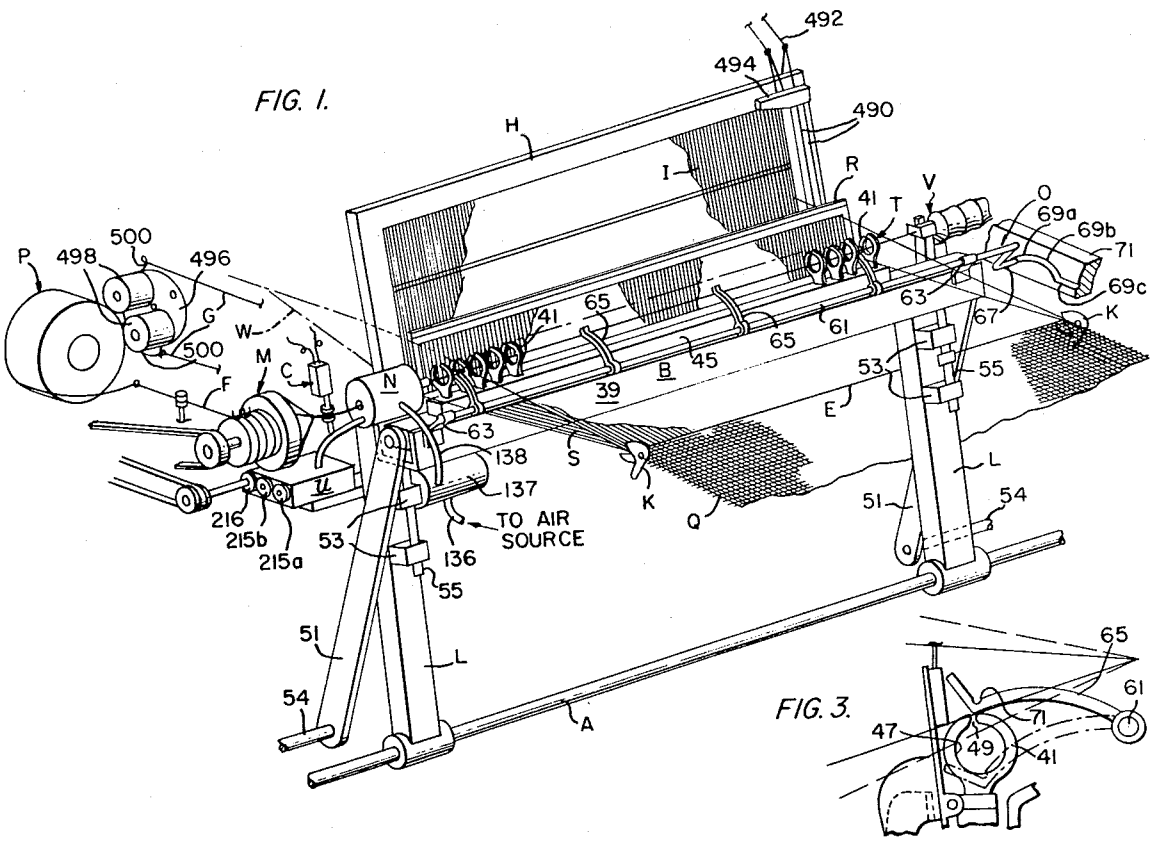
FIG. 1 is a highly schematic view in perspective of the essential components of a loom incorporating the present invention.
FIG. 3 is an enlarged detailed view of the upper portion of the lay in beat up position as in FIG. 2B showing the weft lift-out device in projected position in solid lines and in retracted position for weft insertion in dotted lines.

The loom of the present invention is basically conventional in much of its construction and operation (with one adaptation to better suit the requirements here), and the loom structure is illustrated schematically in an overall view in FIG. 1 and described generally with alphabetical designation only in enough detail to establish the context of the present improvements. As usual, the warp threads on ends W are carried on a rotatably supported warp beam (not seen) and pass therefrom through the eyes of parallel arrays of heddle wires I arranged in two or more separate groups held in adjacent parallel planes by corresponding heddle frames H. The heddle frames H are mounted for alternating up and down reciprocation whereby the groups of warp threads are separated to form an elongated diamond-shaped shed S having its front corner defined by the fell E of the fabric being woven. Forwardly of the heddle frames H, a lay beam B extends withwise across and beneath the lower plane of the warp, the lay beam B being mounted at its ends on generally upstanding supports or swords L which are pivoted on a shaft A at their lower ends and are rocked to and fro by driving means, such as a crankshaft, not shown. A reed R in the form of a sheet-like array of wires on the flat plates with the warp threads passing in the clearance space therebetween projects upwardly from the rear side of the lay to impress each new weft against the fell as the lay rocks forwardly. The woven fabric is collected in a conventional way upon a take-up beam, not shown.

The fabric has a rough or fringe selvage Q because the weft is inserted in the warp shed continuously from the same side of the warp shed rather than alternately from opposite sides as in conventional shuttle weaving. This rough selvage may be trimmed by means of trimming shears or knives K in operative position at the fell line and actuated in the usual way.

In accordance with the invention, the lay B of the loom is equipped with an interrupted segmental weft guidance tube to facilitate in a manner known in itself the delivery of weft or filling strands F through the shed, the guidance tube obtruding in interdigitating fashion with the warp ends into the interior of the shed when the lay is in its rearmost position and withdrawing from the shed while the lay moves forward. The lay preferably carries a weft lift-out device generally designated O to positively displace the inserted weft F from the guidance tube. The weft is projected into the interrupted guidance tube by means of a burst or pulse of air emitted by a weft insertion nozzle N mounted on the lay adjacent one side of the shed, while the free end of the inserted weft is received beyond the far side of the shed within a vacuum reception tube V carried on the opposite end of the lay and if desired is engaged by a clamp (not seen in FIG. 1) associated with that tube. Preferably, the tube is displaceably supported to follow the path of the weft during beat up. The reception tube can include photoelectric detection means (not seen) to detect the arrival of the weft thereat and initiate a control signal in the absence of the weft. The generation of the pulse or burst of air through the nozzle is precisely controlled by means of a nozzle activation control unit U which is actuated in timed relation to the cyclical operation of the loom. A proper length of weft is withdrawn from a weft package or other source P and made available to the insertion nozzle N by means of a strand metering and delivering unit M disposed at a fixed position outboard of the insertion nozzle N, and a clamping means C is interposed between the metering unit M and nozzle N for positively gripping the weft F in timed relation to the inserting action.

G. DETAILED DESCRIPTION OF INVENTION

The various component units of the present system which embody novel features will now be described individually.

I. Apparatus a. Interrupted Guidance Tube Withdrawal Mechanism

In a conventional loom, the lay consists of a large massive beam extending entirely across the width of the loom, the upper surface of the beam lying when in rearward weft insertion position virtually coplanar with the threads forming the lower side or floor of the shed whereby the shuttle can slide on the beam when moving through the shed.

In the loom of the present invention, the lay beam's massiveness is expendable, and only enough of a skeleton beam is retained, e.g. in the form of an upwardly opening channel 39 fixed to the ends of lay swords L, as required for the mechanical support of various components including the segmented or interrupted weft guidance tube T of the invention. As mentioned, this tube T consists of an axially aligned array of thin annular segments 41 (better seen in FIGS. 2A and 2B) which preferably have an axial thickness not greater than about $\frac{1}{8}''$ to allow their introduction upwardly into the interior of the shed S through the clearance spaces between warp threads W without abrading or otherwise damaging the warp and an annular thickness appropriate for mechanical strength, say $\frac{1}{4}$–$\frac{3}{8}$". Each tube segment 41 has a radial foot-like extension 43 projecting from a lower peripheral point to enable the elements to be mounted in spaced axially aligned relation upon a transversely extending common base 45 in which the extension ends 43 are fastened or embedded. Each weft thread F during insertion is projected through the interior bore 47 of predetermined diameter of the axial array of the annular segments 41 and provision is made for the escape of the weft thread laterally from the segment array as it is withdrawn from the shed, by way of a narrow gap 49 formed in each segment at a common peripheral point on the rear upper quadrant thereof.

In prior art constructions, the interrupted guidance tube is fixed relative to the lay. Obviously, the guidance tube elements must, in any case, be completely withdrawn from the interior of the shed S before the reed R reaches beat up position to permit the weft F to float free within the shed before being pressed against the fell E of the fabric by the forward motion of the reed R. In general, prior art arrangements have usually required some change in the normal arcuate path of the lay so as to achieve a timely withdrawal of the guidance tube, for example, by tilting the lay and reed bodily forwardly toward the fell of the fabric. This results, however, in the reed having a considerable inclination at its beat up position which means that the force driving the thread against the fabric fell E is applied at an angle to the plane of the fell, displacing the thread downwardly at the same time as it is pressed forwardly against the fell, which can lead to distortions in the fabric, whereas in conventional loom design, the arcuate path of the upper lay end is more or less symmetrical about a vertical plane so as to give the best compromise between the preferably horizontal position of the lay during weft insertion and the preferably vertical position of the reed at beat up position.

In the present invention, the lay construction is modified to incorporate a mounting permitting relative vertical displacement of the weft insertion tube. The design of the mounting is not critical and can take various forms. For example, each lay sword can be provided with a vertically spaced pair of collars 53 in axial alignment for sliding reception of a slide rod 55 passing through openings in the bottom of channel 39 (FIG. 1) and attached at its upper end to the supporting base 45 of insertion tube T. The ends of the base 45 are connected to the upper ends of generally upstanding driving links 51 which are pivoted at their lower ends to the frame of the loom on a pivot axis 54 displaced rearwardly from the pivot axis A of the lay swords L. Consequently, when the lay pivots, the upper ends of drive links 51 swing through a more inclined arc indicated by dashed arrows than the upper ends of the lay swords L creating a vertical displacement of the guidance tube base 45, and thus of the guidance tube T itself, relative to the lay channel 39. In this way, during beat up the guidance tube T has a compound motion, swinging arcuately with the lay while moving vertically by itself, and the point of its full withdrawal from the shed can, therefore, be varied as desired independently of the position of the lay B by adjusting the position of the lower pivot axis 54 of the drive links 51 relative to the pivot axis A of the lay swords L.

Early withdrawal of guidance tube T during beat up is advantageous in giving greater opportunity for the warp threads to recover from any distortion in their normal position as a consequence of the removal of the guidance tube segments 41 from therebetween. It has been found that if the tube is fixed relative to the lay and its withdrawal is thus delayed, the warp threads (which must shift laterally somewhat to allow passage of the guidance tube segments) may be held in such displaced position at the time the weft is pressed against the fabric fell and become "locked" in this aberrant position when the shed collapses during reversal of the warp thread groups of the shed. This results in observable defects in the uniform spacing of the warp threads within the resultant fabric, producing what is known as a "reedy" fabric, because such defects are normally characteristic of excessively thick reed elements.

In selecting the position of the exit slot or gap 49 (FIGS. 2A and 2B) in the guidance tube segments 41 along the upper peripheral portion thereof, consideration should preferably be given to the compound motion of guidance tube T, including both the vertical component as well as the usual arcuate component. Thus, the less the vertical displacement of the guidance tube, the closer the position of exit slot 49 to the lower end of the upper segment quadrant adjacent reed R and vice versa.

The guidance tube segments 41 themselves can be molded of any strong durable plastic material, such as that sold under the name Delrin, preferably filled or reinforced with chopped glass fibers for increased strength. Segments constructed in this manner have the slight disadvantage of nonconductivity and can be susceptible to the build up of static electrical charges during weaving. This can be avoided by applying a metallic coating, for example, by vacuum deposition, to the segments and grounding them electrically to the frame of the loom. Alternatively, the segments can be formed of cast metal. In assembling the guidance tubes of the invention, a plurality of such segments of sufficient number (dependent upon the width of the loom and the desired separation) are arranged in axially aligned position on a jig, giving what has been found to provide a reasonably accurate alignment with a deviation of ±1–2/1000". Deviations of this magnitude can be tolerated without substantial deleterious effect; however, significantly better performance can be achieved when the interior wall of the arrayed segments 41 are subjected to a honing operation. For this purpose, an elongated rod having a slightly tapered axially slotted cutting head with a maximum diameter slightly exceeding the starting undersize bore diameter of the segments as molded is passed through the segment array while being rotated at a moderate speed of a few hundred rpm, by means for instance of a hand drill, the head of the rod being coated with any commercial honing compound consisting of a fine abrasion suspended in a lubricating carrier. Honing produces highly uniform alignment of the bore apertures of the segments in the guidance tube array and removes any interior irregularities. Sufficiently of the honing operation can be checked visually by sighting with the eye along the bore of the array and noting when the bore surfaces appear bright or shiny.

By way of illustration of an effective tube assembly for weaving with warp threads of 40's cotton at a density of about 72 threads per inch of loom width, one might use one tube segment per 20 warp threads.

The size of the bore diameter of guidance tube T can significantly affect the operation of the system if selected inappropriately. For instance, with nozzles of various contours and throat cross-sectional areas ranging between 8 and 32 $mm^2$, a bore diameter of $\frac{3}{4}''$ works well. If the diameter is reduced to $\frac{5}{8}''$, only the largest (32 $mm^2$) nozzle can project the weft the full width of a normal loom, and the weft travel time is prohibitively increased. Apparently, the bore diameter needs to be relatively large for relative easy entry and passage of the air jet delivered by the nozzle. First, the diameter of the tube bore 47 in relation to the outlet diameter of the nozzle, its spacing from the tube entrance, and the cone angle of the jet must be sufficient that the jet substantially fully enters the tube entrance. Second, the bore 47 should not be too "tight" in relation to the air column moving therethrough, as otherwise the column encounters excessive resistance in proceeding through the bore and "leaks" from the slot 49 and spacing between the tube elements. If the nozzle opening is sufficiently large to emit a massive blast of air, the impedance of a "tight" tube can be overcome, but the resistance is still manifested in seriously retarding the advance of even such a massive blast. It is not presently known how far the bore diameter might be increased without approximating an unconfined environment for the weft and losing the advantage of the guidance tube; some experimentation may hence be indicated to establish the effective limits of bore diameter variation in questionable cases.

In the embodiment of the loom of the invention illustrated in the drawings, the weft insertion nozzle N is mounted on the lay skeleton 39 in a fixed or stationary position and does not move in synchronism with the compound motion of the weft guidance tube. This permits a simplified construction and the effectiveness of the tube for weft insertion is not thereby significantly reduced. During the actual weft insertion phase, the vertical movement of the tube is virtually nil, and the axis of the insertion nozzle is aligned, well enough within the axis of the guidance tube over this phase. If desired, however, insertion nozzle N could likewise be mounted on the movable supporting base 45 for the weft guidance tube so that the axis of the nozzle would actually "track" the center line of the guidance tube over the complete operating cycle of the loom. Conceivably, this arrangement might afford some slight additional increase in overall operating speed in permitting the weft insertion phase to be initiated at a slightly earlier point in the cycle.

b. Weft Lift-Out Mechanism

Where the weft guidance tube is fixed on the lay as in known air weft insertion systems, the egress slot thereof has been so located at a point on the upper peripheral portion of the annular tube segments that the path of the tube during withdrawal beneath the bottom of the shed effected passive displacement of the inserted weft thread out of the egress slot. That is to say, as the guidance tube with the inserted weft thread therein passes from the shed, its thin individual annular segments are able to slide between the spaces between warp threads, whereas the weft thread itself cannot, being restrained by the array of shed threads, and must, therefore, remain within the shed as the guidance tube segments swing outside the shed. Hence, the position of the egress slot was selected to facilitate passage of the weft thread therethrough. Passive displacement of the weft can be used in the invention, if desired, and while the optimum location of the egress slot 49 for this purpose may vary according to a specific design, it has been generally found that a location at about 130°–140° produces good results, starting with the plane passing through the axis of the supporting extensions 43 and counting in a clockwise direction.

It is preferred in the invention, however, that, instead of accomplishing displacement of the inserted weft threads passively in the above manner, a mechanism be provided to lift out each inserted weft thread positively through egress slot 49 in the tube segment array. In this way, more direct control can be exercised over the position of the weft thread during beat up and displacement of the weft can be effected at an earlier point in the beat up motion of the lay than would otherwise be possible. To this end, as shown in FIGS. 1 and 3, a rock shaft 61 extends across the width of the loom on the forward side of the lay channel 39 at a location presenting a minimum of interference to access to the guidance tube from the front of the loom. The ends of rock shaft 61 are journalled for rotation in supports 63 projecting from the ends of lay channel 39, and several thin weft lift fingers 65 are affixed to shaft 61 at appropriate intervals across the shed width including points adjacent the side edges of the shed. Since the relative mass of the weft is in any case extremely small, only that number of lift fingers 65 sufficient to keep the weft in a reasonably straight condition during the lifting action is needed (four being sufficient for a 40 inch loom, although more than four can, of course, be used), and lift fingers 65 can be quite thin so as to pass easily through the clearance spaces between the warp yarns of the shed. A bell crank lever 67 is fixed to one outside end of the rock shaft and at the end of that lever acts as a cam follower which cooperates with a cam track 69 constructed in a stationary part 71 of the loom frame. The cam track 69 is appropriately curved to impart the desired motion to the lift fingers and includes in the schematically illustrated arrangement in FIG. 1, a rearward inverted flat U-shaped arcuate portion **69*a* connecting with a generally horizontal forward section 69*b*, and thus, during weft insertion at back dead center, fingers 65 are retracted below the bore 47 of tube T as shown in dotted lines in FIG. 3; and as the lay starts to move forwardly toward beat-up position, the cam follower immediately rides up in the cam track portion 69*a* to rock the fingers 65 quickly upward to the projected solid line portion in FIG. 3, which lifts the weft vertically through the egress slot 49 in the tube segment 41, after which the follower drops to retract the fingers 65 and enters the horizontal track section 69*b* to hold the fingers 65** stably in their retracted position during beat up. When the lay returns to the weft insertion position, the fingers swing up and then down again to a retracted position below the bore of the guidance tube ready for the next weft to be inserted.

The shape of the fingers can vary, bearing in mind that the fingers must ultimately leave the shed between the warp threads in the same manner as the guidance tube segments and must be clear of the fell at beat up position. At the same time, the ends of the fingers making engagement with the thread should be contoured to positively catch and hold the thread during their lifting action to maintain good control over the thread. Preferably, therefore, the rearward end of each lift finger terminates in a generally V-shaped notch 71 to define a crotch into which the thread will naturally fall as the fingers are lifted. The remainder of the fingers are arcuately curved to insure clearance with the shed threads as the lay pivots forwardly to beat up position. It is also preferred that the notch shaped rearward ends of the lift fingers lie in their retracted position somewhat past in the rearward direction of the center plane of the guidance tube; this locates the weft thread toward the rearward side of the guidance tube bore rather than the forward side and promotes smooth egress through exit slot 49.

Under the impetus of the lifting mechanism, the weft thread is displaced essentially vertically relative to the movement of the guidance tube during beat up, and consequently, the portion of the exit slot should coincide substantially with the top point of the tube segment periphery. In this way, the removal of the weft is determined by the positive lifting action of the lifting mechanism independently of the motion of the guidance tube relative to the bottom of the shed.

c. Weft Insertion Nozzle Assembly

Figure 4:
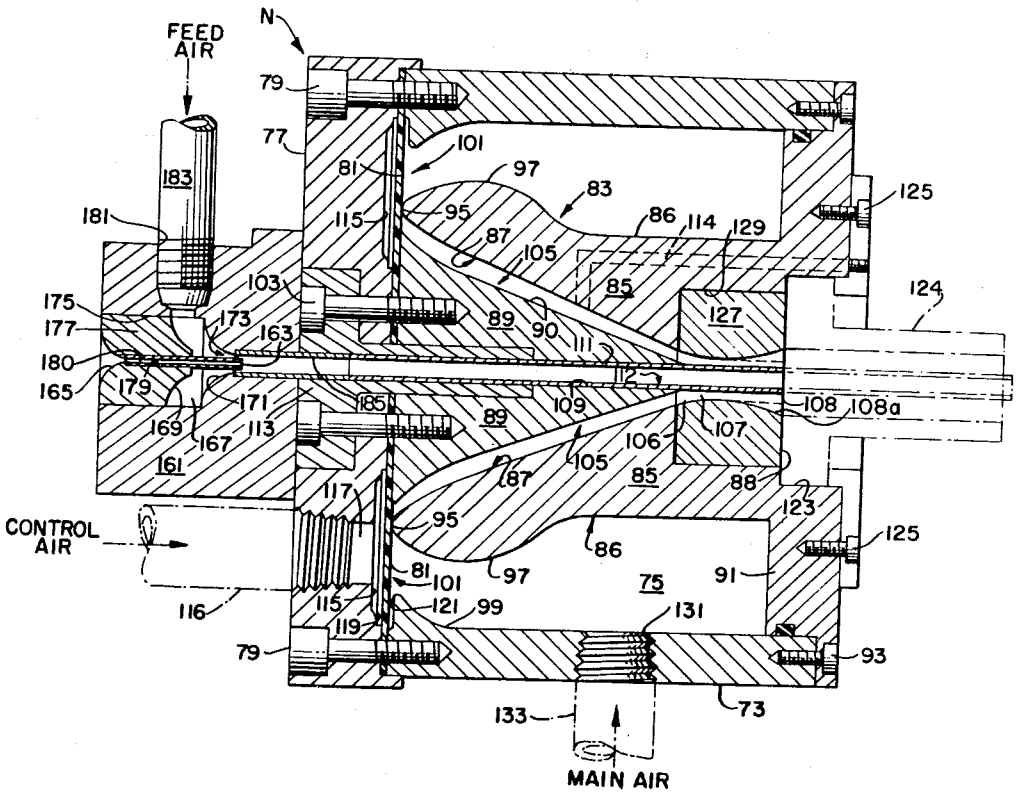
FIG. 4 is an enlarged detailed view of one embodiment of weft insertion nozzle according to the invention taken in cross-section through the nozzle axis.

In order to achieve more precise and instantaneous control over the flow of air from nozzle N for propelling the weft stand across the warp shed of the loom, a special nozzle and servo control assembly has been devised. As shown in FIG. 4, this nozzle assembly has an exterior casing 73 enclosing an interior space, the casing being preferably circular in shape, although its configuration is not critical. One end of the casing, at the left in FIG. 4, is sealed by a cover plate 77 secured via bolts or other securing means 79, a flexible diaphragm 81 being tightly clamped around its margins between the abutting surfaces of the casing and the plate and spanning the casing end. Within the interior of the casing is a two-part core generally designated 83 having the dual function of delineating with the interior wall of the casing an axially elongated annular storage chamber 75 for containing a determined amount of compressed air and forming between its two parts an annular divergent passageway ending in a throat and exit opening.

The two parts of the core including an outer hollow sleeve 85 having a generally cylindrical outer wall 86 and a conical inner bore 87 and an internal generally flaring trumpet-shaped plug 89 fitting in spaced relation within the conical bore of the sleeve. The hollow sleeve 85 can by means of an integral peripheral flange 91 at its outer (right) end 88 be affixed with screws or the like 93 to the outer end of the casing, to complete the enclosure of the storage chamber space, although the sleeve and flange could be formed separately and connected together. In any event, sleeve 85 is supported in cantilever-like fashion within casing 73 by a connection of its outer end to the right end of the casing which also seals that casing and (except for the nozzle orifice), the inner end of the sleeve projecting free within the casing to adjacent its head end.

The free end edge of the hollow sleeve 85 is rounded as at 95 so as to give a smooth nearly re-entrant curvature between the adjacent margins of the conical wall 87 and the outer wall 86 of sleeve 85. Preferably, the section of outer wall 86 adjacent free end edge 95 is developed with a convex or somewhat bulbous curvature as at 97 to merge more smoothly with the rounded free end edge 95, while the corresponding section of the interior wall of casting 73 projects radially inwardly along a concave curvature as at 99 to form therebetween a gradually tapering inwardly curving annular mouth 101 at the end of storage chamber 75.

The rounded free end edge 95 of sleeve 85 makes abutting contact with an inner annular region of the diaphragm 81 and functions as the seat of a "valve" which acts, as will be explained, to control the flow of pressurized air from storage chamber 75. The interior wall 87 of the core sleeve, after a slight initial convex curvature at its end merging with the rounded free end edge 95, has a generally uniform conical inclination and within this conical space the trumpet-shaped plug 89 is held in fixed depending relation from the inner side of casing head 77 by means of fastening bolts 103 or the like, the center region of the diaphragm being pinched between the flat end face of the plug and the casing head. The outer wall 90 of the plug is spaced from the conical inner wall 87 of sleeve 85 and together define a converging annular supply passageway 105 which gradually decreases in radius toward the supported sleeve end 91 and undergoes a slight narrowing in annular thickness adjacent the rounded end edge 95 of the sleeve.

The apex end of trumpet-shaped plug 89 terminates somewhat short of the outer end of conical bore 87 of sleeve 85 and the remainder of bore 87 converges as at 106 to a throat region 107 of the nozzle connecting with the tapering annular passageway 105. Throat region 107 extends to an orifice opening 108 in the supported end of sleeve 85 either in straight cylindrical fashion as shown in dotted lines at 108 in FIG. 4, or in flaring divergent fashion as at **108*a***, as indicated in solid lines, depending upon the type of nozzle orifice opening that is desired, as will be explained.

Passing through the interior of trumpet-shaped plug 89, and preferably in coaxial relation thereto, is a small axial passage 109 which is occupied by a weft feed tube 111 extending the entire length of plug 89 and projecting therebeyond at least to the plane of the outer end face 88 of sleeve 85 and thus the outer limit of the bore 107 therein. Preferably, the strand feed tube 111 is constructed integrally with a T-shaped carrier spindle 113 embedded in the plug and fastened thereto, for instance with the same bolts 103 securing plug 89 itself to casing head 77. The feed tube and carrier spindle make a sliding telescoping fit with the axial passage 109 in the plug to facilitate ready removal of the tube for cleaning or replacement.

The interior face of casing head 77 facing diaphragm 81 opposite chamber 75 is relieved to define a shallow annular recess or manifold 115 opening toward and, in effect, closed by the diaphragm and this annular recess is connected by a line 116, shown in dotted lines in FIG. 4, through a suitable port 117 in the casing head to a source of a gaseous control medium, e.g., air (not shown) for the purpose of controlling the movement of the diaphragm. It will be understood that diaphragm 81 is exposed on its interior face to an annular area of predetermined dimension formed by the shallow manifold 115 in the casing head. Because the diaphragm will flex as required to balance the forces acting on its two faces, its movement will be determined by the ratio of each of these areas multiplied by the corresponding pressure of the media acting thereon. The annular areas of mouth 101 and manifold 115 can be the same; in that event, so long as the pressure of the control air in manifold 115 is less than the effective pressure of the air in storage chamber 75, the diaphragm 81 will be displaced upwardly away from the rounded end edge 95 of the core sleeve, establishing communication between mouth 101 of chamber 75 and the beginning end of the annular passageway 105 to the nozzle orifice opening 108.

Since annular passageway 105 begins on the radially inward side of the rounded end edge 95 of sleeve 85 proximate the chamber mouth 101, it will be seen that the instant diaphragm 81 starts to leave its seat on the rounded end edge and pressurized air begins to escape from the storage chamber mouth 101, the effective annular surface area of the diaphragm exposed to chamber pressure increases or "grows", which acts to further unbalance the forces acting to flex the diaphragm away from its seat in a kind of avalanching effect. Consequently, the diaphragm moves virtually instantaneously from its seated closed position to the limits of its unseated or open position, as allowed by its operating characteristics, i.e. its flexibility, tension clearance, etc. Thus, the opening action of the diaphragm "valve" of the nozzle of the invention is extremely rapid and, indeed, it has been found possible to achieve an operating response for the design in the order of one ms, in terms of the time required for the pressure in the annular passageway 105 to reach essentially the full pressure existing initially in storage chamber 75.

When it is desired to terminate the flow of air from storage chamber 75, a control air pressure of sufficient magnitude is reimposed on the exterior side of the diaphragm within the annular control manifold 115 and, it will be realized that if the effective inner and outer annular diaphragm surface areas are the same, a control pressure in excess of the storage chamber pressure will be required to restore the diaphragm to its seated position in contact with the rounded end edge 95 of the core sleeve. For this reason, the ratio of the annular or radial dimension of the control manifold 115 to the annular or radial dimension of the mouth 101 of the storage chamber is preferably substantially greater than 1, e.g. in the order of 2 or more to 1, to reduce the difference between closing and opening control pressure. The selection of such higher ratios of effective surface areas has the further advantage of allowing a control pressure to be derived from the same source as the supply to the storage chamber 75, recalling that the control pressure itself need not be greater than storage chamber pressure, due to the "multiplier effect" of the unequal ratio of the effective annular areas on opposite sides of the diaphragm.

Since the air in escaping from storage chamber 75 must undergo a substantial complete reversal of direction in moving from chamber mouth 101 into annular passageway 105 when the diaphragm valve opens, it is desirable for mouth 101 and the entrance to the passageway 105 to be contoured as already described to promote smooth transition in air flow and clean communication between mouth 101 and passageway 105 without sharp edges or angles in the walls and thereby reduce turbulence and friction losses in air flow and minimize abrasive wear upon the diaphragm, which must in operation undergo rapid oscillation between its closed and open positions. For the same reasons, the surface of the casing wall and head contiguous to the unsupported annular region of the diaphragm should be relieved slightly as at 119 and 121 so as to provide clearance space for the free oscillation of the diaphragm. Otherwise, the life of the diaphragm will be severely reduced. A suitable diaphragm material is buna or neoprene rubber preferably reinforced with fabric.

The total volume of passage 105 and throat 107 is made as small as possible consistent with other needs since the space downstream of diaphragm 81 contains residual air after the diaphragm closes and if too large prolongs the decay characteristics of the nozzle.

Under some circumstances, an extension of the nozzle orifice opening 108 in the outer face 88 of sleeve 85 by means of a straight cylindrically-shaped barrel 121 (seen in dotted lines in FIG. 4) may be useful. A central region of sleeve end face 88 can be recessed as at 123 for reception of one end of such a barrel 124 which can be secured in place by means of bolts or other fasteners 125 and construction of the core sleeve and supporting flange in two pieces may simplify the design of this assembly.

For versatility in use, it is advantageous for the size and contour of the throat area of a given nozzle assembly to be variable and for this purpose the throat region of the nozzle sleeve is constituted by an interchangeable insert 127 fitting with close tolerances into a socket 129 in the sleeve end. Each insert can be bored to a given size and contour to allow the nozzle characteristics to be easily changed. No special sealing or gasketing is needed at tolerances of $\pm 1/1000''$.

The weft insertion nozzle assembly N is mounted upon the lay of the loom so that the nozzle can be "fired" at the proper point in the operating cycle of the lay. As mentioned, the weft insertion nozzle could be mounted for a compound movement similar to that of the guidance tube. However, this "tracking" relationship is not required, and very satisfactory results have been achieved by mounting the nozzle in fixed relation upon the lay with its axis approximately in alignment with the axis of the interrupted guidance tube when the latter is in dwell position at the extreme rearward point of the lay motion.

Utilization of the diaphragm control "valve" just described, eliminates the need for additional control valves in the supply of the pressurized air to the storage chamber and the casing wall can have a supply port 131 connected to an end of a supply conduit 133 (in dotted lines) running to the main supply source not shown. A preferred embodiment of a complete circuit of the pressurized medium will be described later.

Because of the desirability for the nozzle to be mounted bodily upon the lay, the overall size of the nozzle is preferably kept within fairly modest proportions to avoid interference with other parts of the loom, and this in turn imposes a limitation upon the permissible capacity of the storage chamber 75 within the nozzle. In the design shown, an acceptable capacity for the storage space has been found to be 6 $in^3$. With this limited capacity, the pressure that develops within passageway 105 upon opening of the diaphragm valve may undergo early decay from a maximum or peak value equal to the storage pressure within storage chamber 75, and this decay in driving pressure can result in a reduction in the effective thrusting force actually exerted upon the weft strand. In the present preferred practice of the invention, the driving pressure is sustained during the duration of the air pulse emitted from the nozzle orifice as closely as possible to its maximum level, and this objective can be accomplished by augmenting the storage chamber capacity with a supplemental reservoir or accumulator 137 of substantially greater capacity and connected to the supply pressure source as at 136. In this way, the effective head pressure delivered the nozzle orifice through passageway 105, which would otherwise decay as more and more of the air escapes from storage chamber 75, is continuously replenished by means of fresh air supplied from reservoir 137. The reservoir should be mounted as close as convenient to nozzle N, for example, below the same end of the lay as at 137 in FIG. 1, and connected to the nozzle by a line 138.

If the diaphragm were allowed to remain open a sufficiently long time, obviously, the decaying effect would occur even with the addition of the reservoir capacity but, with the limited operating times of the nozzle of the invention, it has been found that maximum operating head pressure can be sustained through the pulse with the addition of a reservoir capacity of about 80 $in^3$.

Figure 5:
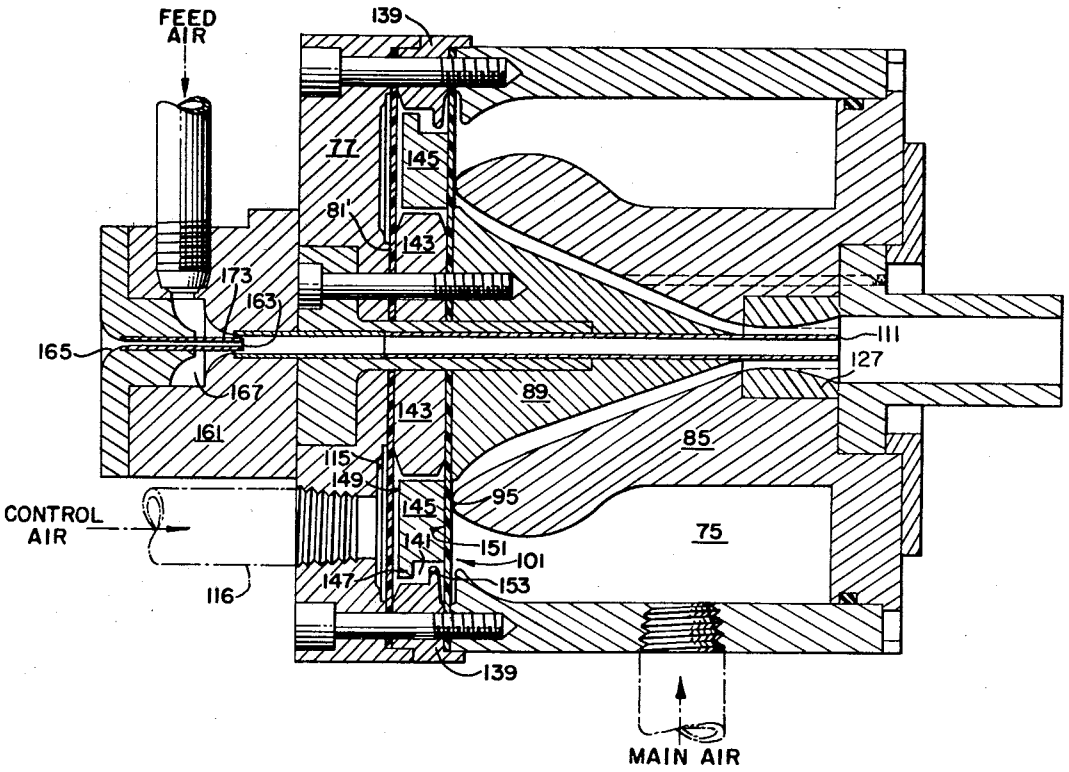
FIG. 5 is a cross-sectional view similar to FIG. 4 of a modified embodiment of weft insertion nozzle.

Mention has already been made of the "multiplier effect" achieved by selection of a ratio greater than 1:1 between the effective working surface areas on opposite sides of diaphragm 81. This "multiplier effect" can be enhanced by means of an alternative nozzle construction, as shown in FIG. 5, which for the most part is identical to the nozzle of FIG. 4 and is given the same reference numerals. According to this alternative construction, a casing spacer ring 139 is interposed between the head end of the casing wall and the corresponding margins of casing head 77 with the diaphragm 81 held therebetween, and an additional pilot diaphragm 81' is clamped in place on the other side of ring 139 so that a diaphragm is situated on either side of spacer ring 139 with a separation space 141 therebetween. The central regions of the two diaphragms 81 and 81' are secured in the desired spaced relationship by means of a companion spacer disc 143 clamped between the flat face of conical plug 89 and the corresponding area of casing head 77 and in turn clamping the central regions of the diaphragms. Within the annular hollow space 141 between the two diaphragms and the mutually facing side edges of the ring and disc, there is disposed a free floating ring 145 which by virtue of a laterally projecting flange 147 has a greater annular radius, and thus a greater effective surface area, on its outer side 149 than on its inner side 151, the annular dimension of the inner and smaller side 151 of floating ring 145 being enough to completely cover via intervening diaphragm 81, the mouth 101 of storage chamber 75. Thus, a smaller control pressure applied against the outer pilot diaphragm 81' will serve to control movement of the inner operative "valve" diaphragm 81 against a given storage chamber pressure, and the ratio of the differential annular areas 149, 151 of the floating ring thereto increases the "multiplier effect" exerted upon the operating diaphragm 81 as will be seen from the following mathematical analysis.

From the aforegoing general description, it will be appreciated that an equilibrium condition will exist on the two opposite sides of the operating diaphragm 81 when the product of the pressure $P_1$ times the area $A_1$ on one surface equals the product of the pressure $P_2$ times the area $A_2$ on the other surface, and if the surface areas are fixed, this equilibrium condition will become unbalanced when the pressure on either side rises above or fails below its equilibrium value. This relationship can be illustrated quantitatively by assuming a given set of dimensions for the effective working areas of the opposite sides of the diaphragm which set is in fact employed in a preferred embodiment of the invention. Thus, it is assumed that the inner diameter of the floating ring 145 is 1.5", the outer diameter of the inner face 151 of the ring is 2.363", the outer diameter on the pilot face of the ring including the lateral flange 2.523", the diameter of the circular point of contact of the rounded sleeve end edge 95 with the operating diaphragm 81 (i.e. at the "seat" of the valve) 1.625", and the pressure ($P_3$) within the storage chamber 75 is 80 lbs. The annular area on the pilot side 149 of the ring can be calculated by subtracting the area of the interior opening from the overall area of the ring on the pilot side. Since the area is equal to $\pi D^2/4$, the overall area of the pilot side of the ring is equal to $0.785\times(2.523)^2$ or 4.999 sq.in, while the area of the ring interior equals $0.785\times(1.5)^2$ or 1.767, the difference between the two being 3.2 sq.in which is the annular area ($A_p$) of the pilot face of the ring.

The total area of the operating face of the ring equals $0.785\times(2.363)^2$ or 4.385, while the area delimited within the end edge 95 of the core sleeve equals $0.785\times(1.625)^2$ or 2.074, for a difference of 2.311 for the annular area ($A_s$) of the operating diaphragm face which receives the force of the storage pressure. In equilibrium condition, the following equation applies:

$$P_p\times A_p=P_s 33\ A_s$$

where $P_p$ is the unknown pilot pressure in manifold 115. Substituting the known values for $A_s$, $A_p$, and $P_s$, $P_p=(80\times2.311)/3.2$ and $P_p=57.2$ pounds. Therefore, as long as the pilot pressure is 57.2 pounds or above, diaphragm 81 will be maintained in closed position.

On the other hand, as soon as the pilot pressure is permitted to drop below the equilibrium pressure of 57.2 pounds, diaphragm 81 will be displaced by the storage pressure $P_s$. Instantaneous with the moment such displacement occurs, the interior margin of the operating diaphragm face, previously sheltered by the rounded end edge 95 of the sleeve (i.e. the region of the face of diaphragm 81 inside the valve "seat"), becomes exposed to the force of the storage pressure $P_s$, thereby enlarging the effective area receiving $P_s$ on the operating side of diaphragm 81. Specifically, the operating surface area as enlarged is equal to 2.619 sq.in (the complete area of the inner side 151 of the ring 4.385 sq.in less the area of the interior opening 2.074") amounting to more than a 25% increase (i.e. 26.3%) in the effective working area of the operating side of the diaphragm. Obviously, the product of the storage pressure and this increased operating area overwhelmingly overbalances the resistance of the pilot pressure on the opposing diaphragm area, causing the opening action of the diaphragm to become virtually instantaneous.

In order to restore the diaphragm to closed condition, one must impose a somewhat greater pilot pressure which can be similarly calculated. Assuming that the storage pressure remains at 80 lbs, the new pilot pressure $P_p'$ times the pilot area must exceed the storage pressure (80#) times the enlarged operating area (2.619). Therefore $P_p'=(2.69/3.11)\times80\#$ and $P_p'=65.4\#$ which is the minimum pilot pressure needed to restore diaphragm 81 to closed position over the mouth 101 of supply chamber 75. Floating ring 145 is formed of plastic or like low mass material and is preferably held loosely in its operating position in space 141 between the diaphragms by means of a stabilizing lip 153 projecting interiorly from the inner end of casing spacer ring 139, the size of space 141 being sufficient to allow limited free movement of floating ring 145 axially of the nozzle, while restraining ring 145 against possible lateral or rocking movement that might be an aberrant influence on the operation of diaphragm 81.

It will be recalled that the weft strand feed tube 111 extends through casing head 77 and conically shaped core plug 89, projects beyond the apex of the plug through the outer end portion of the bore 107 in core sleeve 85 to a point at least even with the outer face 88 of that sleeve. This means that the nozzle orifice opening 108 is necessarily in the shape of an annulus bounded between the exterior wall of the exposed end of feed tube 111 and the interior wall of the sleeve bore 107. It is an important feature of the present invention common to all embodiments of the weft insertion nozzle thereof that the area of the annulus at the point of least diameter of bore 107 constitutes the minimum area in the entire air flow path through the nozzle. The point of the minimum area of the air flow path defines the throat of the nozzle and a critical requirement of the invention is the occurrence of a choking effect in that throat. Given the re-entrant bend in the air flow path in the present nozzle, with the storage chamber 75 developed as an annulus around the bore 107 and its delivery passageway 105 and the converging nature of passageway 105, it follows that the point of minimum flow area occurs at the point of least diameter in bore 107 in the illustrated embodiments (the total effective flow area of annular passageway 105 being a function of its overall diameter as well as its annular radius). Where other design configurations are employed, the same result may not inherently follow but design of the nozzle in any case will have to comply with this requirement.

In addition, where the supplemental reservoir 137 is employed to augment the flow capacity of storage chamber 75 and thus maintain the full head pressure being delivered to the nozzle orifice, the conduit 138 connecting between the outlet of the supplemental reservoir and the port in the casing wall, together with these ports themselves, must have an effective flow area larger than the effective flow area of the nozzle throat. Since the duration of the air flow during weft insertion will ordinarily consume only a minor fraction of the total working cycle of the loom of the invention, the flow rate capacity of supply conduit connecting between the pressure source and the storage chamber, or the supplemental reservoir, when present, need not fill this same requirement, provided, of course, that in the available replenishment time (between nozzle firings), the amount of air delivered from the supply main to the reservoir and/or the storage chamber is adequate to restore their initial filled condition.

d. Self-Threading Nozzle Feeder

The weft feed tube of the weft insertion nozzle could, of course, be threaded initially by hand using a threading leader of sufficient rigidity as to be insertable into the bore of the feeder tube for drawing the leading end of the weft throughout. However, to facilitate nozzle thread, preferably the nozzle is provided with a weft threading attachment seen to the left of the nozzle itself in FIGS. 4 and 5. This attachment consists of a small cylindrical casing 161 penetrated by an axial feed bore 163 of sufficient diameter to freely pass the weft to be threaded into the nozzle and having a trumpet-shaped inlet opening 165 in one of its end faces. The other end face of the casing fits in abutting contact against the exterior face of the head 77 of the nozzle casing with its feed bore 163 registering with the bore 112 of the nozzle feed tube 111. Surrounding an intermediate section of feed bore 163 is an annular aspirating chamber 167 having forwardly flaring end walls 169, 171 and communicating with the interior of feed bore 163 by way of a small forwardly directed annular opening 173 in its end wall remote from inlet opening 165. By connecting the aspirating chamber 167 to a source of pressurized air a confined high velocity annular stream of air is projected forwardly into feed bore 163, creating a negative pressure and resulting in an aspirating effect in its inlet opening 165. Thus, when the free end of the weft is brought into the vicinity of inlet opening 165, it is sucked into that opening and projected forwardly through the feed tube 111 of the injection nozzle.

To simplify construction of the self-threading attachment, a cylindrical socket 175 having a convexly flared end face is drilled into the casing and a cylindrical plug 177 of reduced axial dimension and having a concavely flared end face is pressfitted into the socket leaving an axial clearance to form chamber 167. An axial aperture 179 passes through plug 177 and its outer end is flared outwardly to form the trumpet-shaped inlet opening 165. A tubular insert 180 fits tightly into axial aperture 179 and extends about the depth of the socket, the insert having an exterior diameter slightly less than the minimum inside diameter of the flared socket wall to define with the open space of the socket the annular chamber 167 having the small annular clearance 173 at its inner end. A supply port 181 connected by a conduit 183 to a source of pressurized air (not seen) is passed radially through casing 161 into annular chamber 167, and as pressurized air flows from the annular chamber into the bore 163, a negative pressure is created in the interior of the tubular insert 180 to positively aspirate the strand into its trumpet-shaped inlet opening.

Alignment of the self-threading attachment with the nozzle inlet can be facilitated forming bore 163 by means of a tubular insert 185 projecting outside the casing 161 for a telescoping fit with an outer portion of the feed tube 111 of the nozzle itself.

In operation, the air pressure supplied to aspirating chamber 167 may be maintained continuously at a level substantially below the operating pressure level of the nozzle, say in the order of 10 to 20 psig.

e. Pilot Pressure Control System for Insertion Nozzle

As previously indicated, the present invention imposes very stringent requirements upon the operating characteristics of the diaphragm valve in that the valve must have the capacity of responding in precisely reproducible fashion at a minimum frequency of 900 cycles per minute combined with an extremely short actuation time, in the order of one ms, and a special control system is provided for actuating the diaphragm valve in accordance with these requirements. The use of a directly operating solenoid valve for controlling pilot pressures acting to actuate the diaphragm valve of the invention, for example, is out of the question at the present state of the valve art. There are available solenoid driven control valves which are capable of a response time in the order of one ms, but these valves can pass only an extremely small amount of fluid in a given time, and this low transmission capacity would introduce such excessive impedance that the required rapid reaction of the diaphragm valve itself is impossible. Moreover, such fast acting solenoid valves are effective in only one direction and are characterized by a much slower response time, in the order of 5–6 ms, on their return stroke. Presently available solenoid valves with an air transmission capacity sufficient for purposes of the present invention have a response time in the order of 10 ms in each of their operating directions which would impose a minimum of 20 ms "delay" for each operating cycle and consequently inherently preclude the achievement of shorter response times.

(1) Electrical Embodiment

Figure 6:
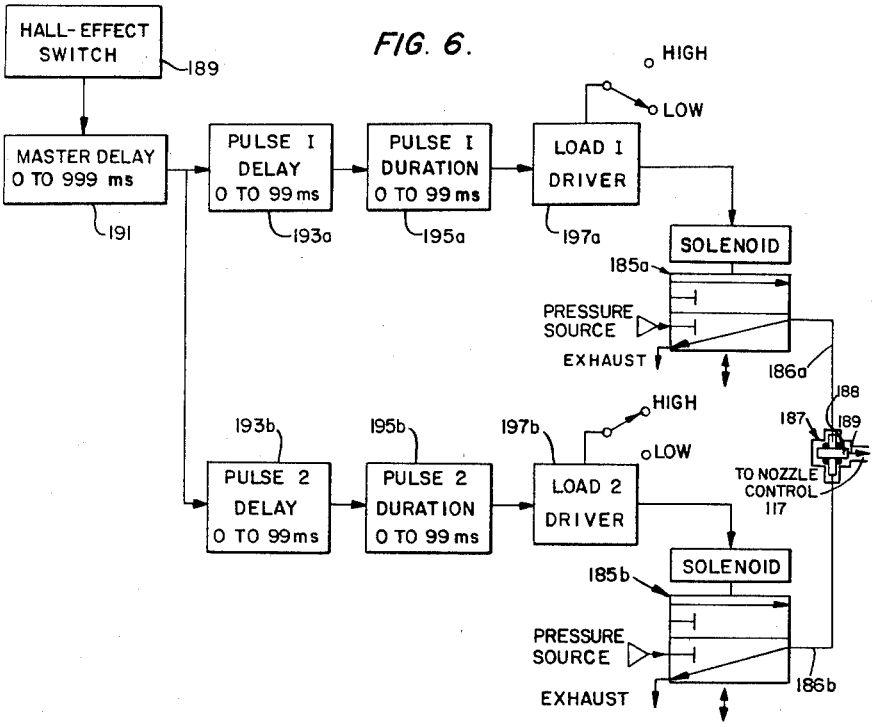
FIG. 6 is a schematic diagram illustrating an electronically actuated air control unit for the insertion nozzle of the invention.

One embodiment of the nozzle control unit in accordance with the present invention, based on electrical principles is illustrated schematically in FIG. 6 and utilizes two separate solenoid servo valves 185*a*, 185*b* (represented diagrammatically) of suitable air transmission capacity connected to the opposite sides of a common shuttle valve 187 which in turn is connected at its output 189 to the pilot port 117 of the casing head 77 of the weft insertion nozzle. Upon electrical energization, each solenoid servo valve moves between a supply position connecting a suitable source of pressurized air to its outlet and an exhaust or "dump" position connecting its outlet to the ambient atmosphere, both valves 185*a*, 185*b* being biased to exhaust position and so shown in FIG. 6. The outlets 186*a*, 186*b* of the respective solenoid servo valves communicate with opposite ends of shuttle valve 187. Each side of the shuttle or piston 188 of valve 187 is effective by means not shown to close the corresponding end of the valve when unbalanced to that end. The outlet port 189 from shuttle valve 187 is located at its midpoint so that the shuttle or piston clears the outlet port in either of its extreme end positions. Hence, when the shuttle is in each extreme position, the outlet of one solenoid servo valve is in full communication with the shuttle valve outlet while the outlet from the other solenoid servo valve is closed by the shuttle. In this way, the shuttle valve isolates each solenoid valve from the other.

The function of this arrangement is illustrated schematically by the wave forms in FIG. 7. As indicated, each solenoid valve A, B moves between a supply position in which its wave form a, b is high and an exhaust position in which its wave form is low, the transition from these two positions being shown as a line sloping at an angle determined by the response time or lag of the solenoid. Wave form c represents the shuttle valve, side b of the shuttle being closed when the wave form is low and side a being closed when the wave form is high. The response of the diaphragm valve appears in wave form d, being closed when low and open when high. The actual nozzle output pulse is shown in wave form e, the nozzle being "off" (no air output) when form e is low and "on" (air pulse delivered) when form e is high. It is assumed that at the starting point, the diaphragm valve of the nozzle itself is in closed or seated position (and wave form d is low), while solenoid control valve A is in its supply position (and wave form a is high) connecting the supply pressure source to the "a" side of the shuttle valve, thus biasing the shuttle to its "b" side (and wave form c is low), closing off the outlet from the "B" solenoid valve, and establishing connection between the outlet of solenoid valve "A" and the shuttle valve outlet which applies control or pilot pressure to the control side of the nozzle operating diaphragm valve to maintain that valve closed (and wave form d is low). Solenoid control valve B is at this time situated in its exhaust or dump position (and wave form b is low). An operating cycle is initiated at a time $t_1$, indicated by a dash-dot line, to open the diaphragm valve of the nozzle by releasing the control pressure thereon, and solenoid control valve A is shifted electrically to its exhaust position, while solenoid valve B remains in its exhaust position. As a consequence, the shuttle valve remains at its "b" side position, but the control pressure acting on the diaphragm valve now begins to be exhausted to the atmosphere through the exhaust of solenoid A at some rate determined by the response rate of the solenoid valve as well as the inherent impedance, i.e. line resistance, etc., in the various connecting lines. Therefore, wave form a begins to fall at a sloping rate. When the control pressure acting on the diaphragm falls below a certain calculated level at a time $t_2$, the supply pressure in the storage chamber of the nozzle will then exceed the control pressure, forcing the diaphragm immediately into open position and wave form d goes high. The opening of the diaphragm valve admits pressurized air from the air storage chamber to the nozzle (and wave form e starts high at time $t_2$).

The diaphragm valve remains open, with the weft-projecting air pulse emitting from the nozzle, so long as both solenoid valves A and B are in their exhaust (i.e. low) position; and in order to return the diaphragm valve to its closed position and end the nozzle pulse, solenoid control valve B is actuated electrically at a time $t_3$ to shift from its exhaust to its supply position. Thus, solenoid valve B, as seen in wave form b, makes its transition from exhaust to supply position, shown by the sloping line, the slope or rate of which is again determined by the response time of the valve and the impedance of the system as before. Since the opposite or "b" side of the shuttle valve is at this point in communication with the atmosphere, because of the exhaust position of solenoid valve A, there is no resistance to the shifting of the shuttle to the "a" side position (and wave form c abruptly goes high), and pressure begins to build up within the control side of the operating diaphragm of the insertion nozzle.

At a certain time $t_4$, the control pressure will exceed the pressure in the storage chamber 75; and when this occurs, the diaphragm moves from its open to its closed position (and wave form d goes low). Since there is no "avalanching" effect in the closing of the diaphragm valve, as occurred in its opening, the closing response of the diaphragm valve is inherently somewhat slower than its snap action opening response (as seen in wave form d), but this has no significant effect on operating efficiency since some decay is unavoidable in exhausting residual air from within the nozzle passageways. It is, however, desirable that the closing response not be excessively long in order to minimize unnecessary consumption of air during each operating cycle, and the alternative nozzle embodiment of FIG. 5 is preferred because it allows the diaphragm to close at a lower level of control pressure and consequently with a higher rate of response. As the diaphragm valve closes, the nozzle pulse is shut off (and wave form e starts low at time $t_4$).

The signals used for controlling the actuation of the solenoid control or servo valves A and B of the embodiment of FIG. 6 are derived electrically as also shown in FIG. 6. Each operating cycle of the control system must occur in timed relation to the operating cycle of the loom itself. The control impulse for initiating each control cycle is preferably derived from the driving crankshaft of the loom itself. To this end, a so-called Hall effect switch 189 is associated with the crankshaft (not shown), this switch consisting of a magnetically operated switch arranged at a point adjacent the crankshaft and a small magnetic element carried on the periphery of the crankshaft itself so that upon each rotation of the crankshaft, the magnetic element passes the switch and activates it to transmit a control signal.

From the preceding discussion of the actuation of solenoids A and B, it will be realized that means must be present to actuate each solenoid control valve separately at preselected times which desirably are adjustable relative to one another. Also, the timing of the generation of the control signal during the loom operating cycle needs to be adjustable to regulate the timing of the firing of the weft insertion gun and achieve insertion of the weft at the optimum point in the loom operating cycle. This adjustability could be achieved mechanically by changing the location of either the switch or magnetic actuator of the Hall effect switch relative to the crankshaft periphery, but to do this conveniently would require a rather complicated mechanical arrangement, particularly since the loom crankshaft is ordinarily in a relatively inaccessible position. Moreover, a high degree of precision, i.e. within ⅓ of a degree of rotation would be difficult to achieve in this way; hence, an electronic arrangement system for regulating the control signal is much preferred. To this end, a master delay timer 191 is connected to the Hall effect switch and consists of a plurality of, preferably three, decade counters (not shown separately), each adapted to count from 0 to 9 in intervals of 1 ms, and including an associated control dial for setting purposes, the counters being ganged together so as to count continuously from 0 to 999 ms to give an accuracy of 1 ms. Upon receiving the initial control signal from the Hall effect switch 189, the master delay timer 191 begins its counting operation and counts for a given number of microseconds as set on the control dial of its decade counters and after concluding such count, emits a control signal. In this fashion, the master timer, in effect can delay the transmission of the initial control signal in increments of 1 ms up to 999 ms for each loom operating cycle.

The control signal from master delay timer 191 is transmitted separately to each of the solenoid valves by means of separate solenoid control timers 193*a*, 193*b*, which are similar in arrangement and in function to master delay timer 191, making possible the regulated delay of the timer control signal in increments of 1 ms up to 999 ms (or a smaller or greater total if a coarser or finer degree of control is desired) and depending upon the delay interval set on the dials of the solenoid timers, each such timer will transmit a control pulse at a preselected given interval after receiving the common control pulse from the master delay timer.

The initial control signal generated by the Hall effect switch is of very brief duration and is not sufficient to maintain the actuation of each of the solenoids for the period of time that the valves of these solenoids must remain in open and closed position. Consequently, the control signal from each of the solenoid delay timers 193*a*, 193*b* is delivered to a pulse duration timer 195*a*, 195*b* which functions to prolong or "stretch" the pulse for a given period of time. The pulse duration counter is composed of a gang of two of the decade counters mentioned above to give a capacity of 0 to 99 ms delay in intervals of 1 ms (although a higher precision is obviously possible with additional decade counters if desired). Also, the power of the control signal is ordinarily of a low magnitude, as is true for most "logic" circuits, and is insufficient to electrically drive the solenoid. Each signal must, therefore, be amplified by a driver amplifier 197*a*, 197*b* which switches between high and low, i.e. on and off, conditions in response to the high or low state of the control signal, supplying sufficient power to the solenoid valve for effective electrical actuation thereof.

It will have been understood from the aforegoing description that a highly flexible and precise control system for the weft insertion nozzle is obtained by the just described arrangement. First, the operation of the diaphragm valve is independent of the response times of the individual solenoid servo valves either upon actuation or de-actuation. Since separate solenoids determine the application and release of the control pressure, the lag of the solenoid in returning to starting position is immaterial from the standpoint of any control function, provided, of course, that the lag of the solenoid is not so great that it cannot be returned to starting position in time for the next cycle. Secondly, while the actuations of the solenoid valves are caused fundamentally by crankshaft rotation of the loom, and are hence directly related to the loom operating cycle, the actual timing of such actuation is adjustable with respect to such rotation, giving complete flexibility in regulating the timing of weft insertion relative to the loom cycle. Finally, the timing of the actuation of each solenoid relative to the other is precisely variable and the duration of energization of each solenoid is independently adjustable with a good degree of accuracy.

(2) First Mechanical Embodiment

Figure 8:
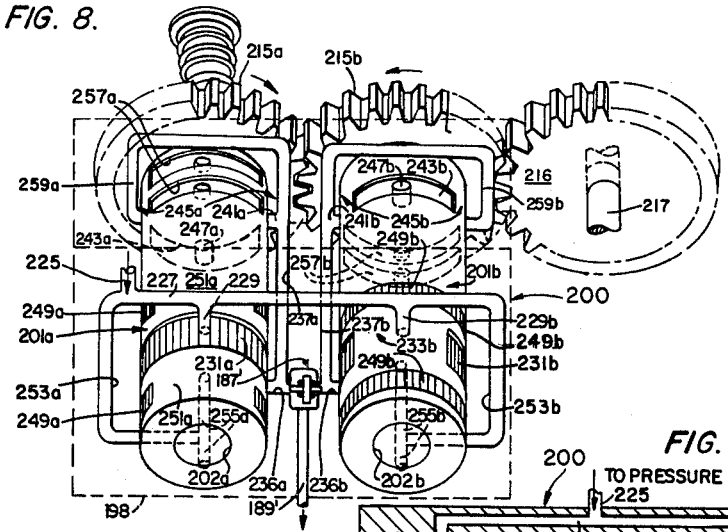
FIG. 8 is a front perspective view on a mechanically operating air control unit for the weft insertion nozzle with the housing in outline and the air passage shown schematically as conduits.
Figure 9:
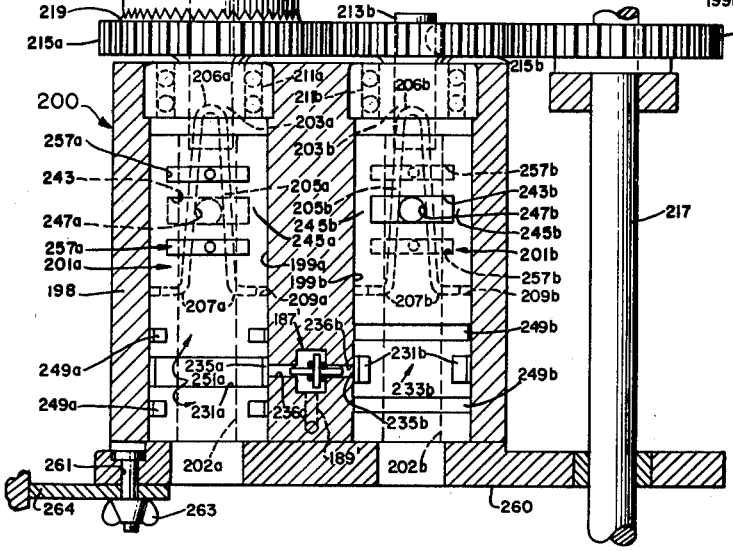
FIG. 9 is a sectional view looking down on the mechanical nozzle control unit of FIG. 8 with the housing shown in cross section and the rotary spools in plan.

The control system of the invention should have the capability of operating many millions of cycles without a failure; and while the electronic system described above is as durable as is possible with electronic components, it may be preferable to utilize instead a mechanical control system which tends to be more reliable over long periods of operation. One alternative embodiment of the nozzle control system based on mechanical principles is illustrated in FIGS. 8 and 9. In general, the mechanical control embodiment includes a pair of valve spools which are mechanically coupled together and to the drive system of the loom, one spool being capable of adjustment in its peripheral relation relative to the other. Each of the spools rotates within a housing and includes on its periphery supply and exhaust apertures located at circumferentially and axially spaced points thereon which during spool rotation are brought into communication with a supply and exhaust port, respectively, in the housing. These ports are in communication via a connecting conduit with a common shuttle valve, similar to the electrical embodiment, so that upon rotation of the spools, the application and release of pilot pressure to the pilot or control side of the operating diaphragm valve of the weft insertion nozzle is regulated.

More specifically, the mechanical system of FIGS. 8 and 9 includes a housing block 198 represented by dotted lines in FIG. 8 and penetrated by two large spaced parallel cylindrical apertures 199*a*, 199*b* (FIG. 9). In each such aperture is fitted a hollow air regulating spool 201*a*, 201*b* with a clearance of about 0.0003" which is sufficiently tight to sustain a moderate air pressure. To minimize wear and avoid the necessity for bearings, each spool 201*a*, *b* is connected in its hollow interior 202*a*, 202*b* to a coaxial drive shaft 203*a*, 203*b* by means of a floating connection which can take the form of an elongaged V-shaped "hair pin" 205*a*, 205*b* having the apex 206*a*, 206*b* of the V secured to the free end of the drive shaft and lateral extensions 207*a*, 207*b* at the ends of the V engaged in recesses 209*a*, 209*b* formed in the interior of the bore of the spool about midway of its length. With this flexible coupling, the spools will rotate bodily with shafts 203*a*, *b* while being free to assume a natural centered position within their respective enclosures, due to the flexibility of the hair spring as well as their pivoted connection thereto. Other types of floating couplings could, of course, be substituted.

Each drive shaft 203*a*, *b* is journaled in bearings 211*a*, 211*b* in an end wall of the housing 198 and includes an exterior extension 213*a*, 213*b* carrying a pinion 215*a*, 215*b*, and both pinions are interengaged to rotate in synchronism. The driving force for the two pinions can be supplied by a gear carried directly on the crankshaft of the loom or, if preferred, the output gear of a mechanical transmission driven from a gear on the loom crankshaft and engaged by one pinion, the driving gear in any case being designated 216 and rotated with a shaft 217. To permit the relative peripheral position of the two spools to be adjusted, one pinion 215*a* is connected to its drive shaft extension 213*a* through an adjustable coupling which may take the form of a pair of abutting discs 219, 220 serrated on their adjacent contacting faces for mating engagement, the disc 219 being integrally united to pinion 215*a* which rotates freely on its shaft extension 213*a* and the disc 220 being slidingly keyed to the projecting end of the shaft extension and biased against the pinion disc 219 by means of a compression spring 221 held at its free end with a split ring fastener and washer 223. By disengaging the keyed disc 220 from the pinion disc 219 against the force of compression spring 221, shaft 213*a* can be turned independently of its drive pinion 215*a* and thus the rotary position of spool 201*a* can be shifted as desired relative to the rotary position of the other fixed spool 201*b*. The ends of the apertures 199*a*, *b* in the spool housing are open to vent the hollow bore of each spool 201*a*, *b* to the atmosphere.

The housing 198 is constructed with a series of air passageways for cooperation with spool valves 201*a*, 201*b*, and in FIG. 8, for sake of clarity and convenience, these passageways are developed and shown as external conduits (the housing itself being indicated only in dotted lines), although in reality these passageways would be formed internally of the housing). The beginning of the passageway is an inlet opening indicated at 225 which is connected to a source of pressurized air (not shown), and in turn connects with a supply conduit 227 from which branches supply ports 229*a*, 229*b* (see FIG. 8), one for each of the two spools. At a point along its length in axial registration with the associated supply ports 229*a*, *b*, each of the spools 201*a*, *b* carries a peripheral supply recess 231*a*, 231*b* which extends around the periphery of each spool for a given arcuate extent less than 360°, say 270°, the remaining arc of the spool periphery at this point being solid or unrelieved, as at 233*a*, 233*b* (only the latter of which can be seen in the drawings). When one of the supply recesses 231*a*, *b* coincides with its corresponding supply port, air under pressure is admitted from supply line 227 to fill the supply recess, while, contrariwise, when an unrelieved wall portion 233*a*, *b* coincides with a supply port, the supply port is blocked as to air flow by reason of the tight fit of the spool in the housing aperture. At the same axial or lengthwise point along each spool but spaced peripherally from the supply ports 229*a*, *b* is a delivery port 235*a*, 235*b* (see FIG. 9) which connects by a delivery line 236*a*, 236*b* to the corresponding side of a shuttle valve similar to the shuttle valve 187 of the electrical embodiment and designated 187', the shuttle valve here as in the other embodiment having its outlet 189' connected to the pilot or control port 117 of the insertion nozzle. Thus, when a spool supply recess 231*a*, *b*, filled with pressurized air, coincides with a delivery port 235*a*, *b*, air flows into the delivery port and through the delivery line to the shuttle valve 187' while when an unrelieved peripheral portion 233*a*, *b* coincides with the delivery port, that port is blocked.

Between its delivery port 235*a*, *b* and connection with the shuttle valve, each delivery line 236*a*, *b* branches as at 237*a*, 237*b* (FIG. 8) to form an exhaust line terminating in an exhaust port 241*a*, 241*b* (not seen in FIG. 9) in peripheral alignment with but displaced axially along the spool length from the corresponding delivery port 235*a*, *b*. At a point along each spool length axially aligned with the exhaust port 241*a*, *b*, an exhaust recess 243*a* and 243*b* is formed on each spool periphery and each such exhaust recess has a peripheral extent complementary with the peripheral extent of the delivery recess 231*a*, *b* with the remaining periphery solid or unrelieved as at 245*a*, *b*. That is to say, the arcuate extent of each exhaust recess 243*a*, *b* equals the arcuate extent of the unrelieved surface portion 233*a*, *b* interrupting the ends of each delivery recess 231*a*, *b*, whereas the remaining unrelieved portion 245*a*, 245*b* of the spool periphery at each exhaust recess matches the peripheral dimension of the delivery recess 231*a* and *b*. A vent 247*a*, 247*b* extends from the bottom of each exhaust recess 243*a*, *b* and the interior bore 202*a*, *b* of the associated spool so as to vent the recess space to the atmosphere. Thus, when one of the exhaust ports 241*a*, *b* coincides with its exhaust recess 243*a*, *b*, communication is established between the shuttle valve 187' via delivery port 235*a*, *b*, exhaust branch line 237*a*, *b*, exhaust port 241*a*, *b*, exhaust recess 243*a*, *b*, and exhaust vent 247*a*, *b*, and the ambient atmosphere. On the other hand, when the unrelieved peripheral portion 245*a*, *b* of the spool coincides with an exhaust port, that port is blocked.

As described before, the relative starting positions of the two rotary spool valves will be different, being shown as 180° out of phase in FIGS. 8 and 9, and can be adjusted as desired. It follows that as each spool valve rotates, supply and delivery ports for a given spool will be in communication with one another via the common delivery recess 231*a*, *b* for a period of each revolution determined both by their peripheral separation and by the peripheral length of the delivery recess, and while such communication exists, pressure is delivered to the corresponding side of the shuttle valve 187', whereas the exhaust port 241*a*, *b* during this period will be blocked. The exhaust port 241*a*, *b*, on the other hand, will be in communication with the atmosphere (through the exhaust recess 243*a*, *b*, vent and spool bore) for a period according to the peripheral length of exhaust recess 243*a*, *b*, during which period the corresponding side of the shuttle valve will be exhausted. During the latter period, the corresponding delivery port is blocked by the solid peripheral surface 233*a*, *b* complementary to the exhaust recess extent at their common axial position. While either of the delivery port 235*a*, *b* or supply port 229*a*, *b* of a given spool is blocked, delivery of pressure to the corresponding side of the shuttle valve is precluded, even though the other port is in communication with the supply recess. When the supply and delivery ports are both open to the delivery recess, the exhaust port for that spool must be blocked. The peripheral positions of the respective spools are independently adjustable so the above actions can be arranged to occur in a desired sequence.

In the aforegoing construction, each spool receives the radial thrust from the several flows of pressurized air and, in time, the radial biasing force of the pressurized air would cause unacceptable wear of the spool unless compensatory measures were adopted. For this purpose, counterbalancing supply grooves 249*a*, 249*b* are provided on each spool on the opposite axial sides of the supply recess, the aggregate axial thickness of these grooves and their peripheral dimensions being each equal to that of the supply groove but 180° out of phase. That is, the unrelieved portions 251*a*, *b* between the ends of each pair of counterbalancing supply grooves 249*a*, *b* is exactly diametrically opposite to the unrelieved portion 233*a*, *b* between the ends of the corresponding supply recess situated between them. The supply line 227 from the pressure source includes extensions 253*a*, *b* which are branched at their end as at 255*a*, 255*b* for communication with the respective counterbalancing grooves 249*a*, *b* to supply air to those grooves in balancing opposition to the air impinging upon the supply recess 231*a*, *b* from its supply port.

Similarly counterbalancing exhaust grooves 257*a*, 257*b* are provided on each spool periphery equal in arcuate extent and aggregate axial thickness but opposite in peripheral location on the opposite sides of the exhaust recesses, and exhaust line extensions 259*a*, 259*b* open onto these grooves to apply counterbalancing pressure.

In addition to independent adjustment of the spool relative to one another, the starting position of the entire spool assembly should also be adjustable relative to the crankshaft of the loom to vary the overall starting point in the loom operating cycle (analogous to the master delay timer 191 of FIG. 6). To this end, the housing for the two rotary valve spools 201*a*, 201*b* (which could, of course, be made separate instead of common) is carried by a supporting plate 260 mounted for pivotal movement around the shaft 217 of driving gear 216 (i.e., the loom crankshaft or an output gear of a transmission coupled thereto making one revolution per loom cycle) and plate 260 can be adjusted on the fixed support 261 arcuately relative to the driving gear within the limits provided by an arcuate adjusting groove 261 and butterfly nut 263 therein. By properly locating spool support plate 260 at the start of an operation, the starting position of the fixed spool relative to the crankshaft position can be adjusted so as to give a measure of flexibility in setting the timing of the firing of the gun in relation to the loom operating cycle. In the embodiment shown, the range of adjustment is less than 100%, but since the interval in the loom cycle during which weft insertion is possible is only a fraction of the overall cycle, 100% adjustment is not needed as a practical matter, and a degree of adjustment equalling about 20° of rotation is quite adequate in practice. If more latitude is needed, the driving gear can be readjusted in rotary position.

As in the electronic control embodiment of FIG. 6, the control functions of opening and closing the diaphragm valve are effected in the mechanical embodiment by individual instrumentalities which operate separately but in determined adjustable time-related fashion, one of the spools functioning to release the control pressure from (and open) the diaphragm valve while the other spool functions to apply control pressure to (and close) that valve. Specifically, it is the rotation of the first or leading spool into supply position with both its supply and delivery ports opening into its supply recess that initiates application of the control pressure to close the diaphragm valve—the subsequent rotation into supply position by the second or trailing spool is immaterial (except to position the second spool for eventual movement to exhaust position) as is the rotation of the first spool into exhaust position. Conversely, it is the rotation of the second or trailing spool into exhaust position while the first spool is already in exhaust position that initiates release of the control pressure to open the diaphragm valve—the prior location of the first spool in its exhaust position is immaterial except to position it for eventual movement to its supply position.

The shuttle valve shifts in position in passive response to an unbalance in pressure applied to its sides by the delivery conditions of the two spools and functions to permit only one spool at a time to deliver control pressure to the diaphragm valve. When the effect of a change in the rotary position of a spool is merely to bring the pressures on the opposite sides of the shuttle valve into equilibrium, whether such pressures be high during delivery or low during exhaust, the shuttle valve holds its existing position.

The maximum period possible between release and reapplication of control pressure to the diaphragm valve, and hence the period the diaphragm valve remains open (disregarding lag due to impedance losses), occurs where the two spools exactly coincide in peripheral position and equals the time equivalent of the arcuate length (i.e. in degrees of rotation) of the exhaust recess at a given speed of spool rotation. However, exact coincidence of the two spools would be the same as a single spool and would normally not be used. The arcuate length of the exhaust recess does obviously fix the maximum time of pulse duration and should be selected with this in mind. By shifting the starting rotational position of one spool relative to the other, the relation in time of the two control functions can be changed and the duration of the exhaustion period and thus of the nozzle pulse can be varied up to the available maximum. The diaphragm valve does not open exactly simultaneously with the rotation of the second spool into exhaust position but lags somewhat therebehind since the control pressure must drop to some critical level and the rate of pressure drop in practice is determined by the impedance of a particular system and must be established experimentally for that system. Once established, it remains constant in relationship to spool rotation and thus, the actual timing in practice of the actuation and de-actuation of the nozzle valve is fixed by the spool rotation. After a preliminary adjustment, both spools rotate continuously in synchronized relation to the operation of the loom and to each other.

The response of the mechanical embodiment of FIGS. 8 and 9 is identical in principle to that of the electronic embodiment of FIGS. 6 and 7, except that the mechanical embodiment includes an intermediate "dwell" or hold condition represented in dotted lines in FIG. 7, not present in the electrical embodiment, in which the spool valve is neither actually applying nor exhausting pressure but simply maintains whatever condition existed previously. Specifically, assume that for each spool the exhaust recess 243*a*, 243*b* extends through an arc of 90° of rotation and the supply recess 231*a*, 231*b* is complementary thereto and extends over 270° of rotation. Assume also that spool A is rotating clockwise, while spool B is rotating counterclockwise as indicated by the arrows in FIG. 8 and that the supply port for each spool is situated 90° in advance of the delivery port relative to the direction of rotation. Finally, assume that spool B is initially rotated 45° in its direction of rotation ahead of spool A and that the starting point corresponds to time $t_1$ in FIG. 7.

Figure 10:
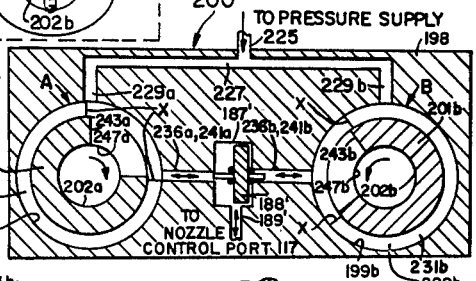
FIG. 10 is a vertical section somewhat diagrammatic taken through the control unit of FIGS. 8 and 9, showing details of the rotary spools thereof.

As a point of reference, FIG. 10 is a diagrammatic cross-sectional view taken through the control spools of FIG. 8 in their starting position, the sectional line being such as to show both the supply recesses 231*a, b* and the exhaust recesses 243*a, b* in relief notwithstanding their actual axial displacement from one another, the transition between the supply and exhaust recesses being indicated diagrammatically by a thin solid wall designated x, with each exhaust recess being shown opening to the spool bore while each supply recess is closed by the spool wall. The line connecting between each spool in FIG. 10 with its side of the shuttle valve 187' is designated both as a delivery line 236*a, b* and an exhaust line 241*a, b* since the delivery and exhaust lines are in the same peripheral location and are in open communication with one another. As appears in FIG. 10, the starting position of spool A is rotated 135° counterclockwise from the position of the left spool in FIG. 8, while the starting position for spool B is rotated 90° counterclockwise from the right hand spool in FIG. 8. In these positions, spool B is already in exhaust condition, the B exhaust port 241*b* being midway of the B exhaust recess 243*b* (and wave form b in FIG. 7 is low); whereas the exhaust recess 243*a* for spool A has just been brought into coincidence with the A exhaust port 241*a* so that the A spool is just beginning to exhaust (and wave form a has just gone low). The shuttle valve is in its "b" side position (and wave form c is low); control pressure is being released from the nozzle, and at a certain time $t_2$, the control pressure falls sufficient low that the diaphragm valve snaps open (wave form d going high at time $t_2$) and the nozzle pulse begins (wave form e going high). These conditions hold for the next 45° of rotation to time $t_3$, at which time spool B has rotated exhaust recess 243*b* just past exhaust port 241*b* and is in supply condition with its supply and delivery ports 229*b*, 236*b* in communication with the B supply recess 231*b*. Hence, at time $t_3$ pressure is applied to the "b" side of the shuttle valve 187' shifting the same to its "a" side position. Thus, wave form b goes high as does wave form c. This same 45° rotation for spool A effects no change in the exhausting condition of spool A (and wave form a stays low). The application of pressure by spool B to the shuttle valve 187' is transmitted to the control port of the nozzle and pressure begins to build up against the nozzle diaphragm valve. At a certain time $t_4$ the control pressure overwhelms the nozzle pressure, and the diaphragm valve closes (wave form d going low). Closure of the diaphragm valve ceases the flow of air into the nozzle, and the nozzle pulse begins to decay (and wave form e starts to go low).

After 90° of rotation, spool B remains in supply condition (and wave form b continues high), and the shuttle valve and diaphragm valve are held as before (and wave form c remains high, while wave form d remains low); whereas spool A has advanced from exhaust to supply condition (and wave form a goes high), which, however, has no effect on the system since spool B is already in supply condition. At 135° of rotation, the system remains stable in all respects which continues for another 90° of rotation or until a total of 225° of rotation at which point the supply port for spool B becomes blocked by the unrelieved portion 233*b* of the supply B recess which holds the existing pressure condition on the shuttle valve and diaphragm valve. Wave form b drops to its intermediate hold condition indicated in dotted lines in FIG. 7. Spool A remains in supply condition during this time and for an additional 45° of rotation to a total of 270° of rotation, at which point spool A moves into hold condition (and wave form a drops to its intermediate dotted line position) while spool B remains in hold position. When the 315° point is reached, spool B has its exhaust port coinciding with its exhaust recess and begins to exhaust (wave form b moving low). The pressure being held in spool A (due to its hold condition) urges the shuttle valve to its "b" side position (and wave form c goes low) which continues to hold the control pressure against the diaphragm valve (and wave form d remains low ). The final 45° of rotation brings the system to the starting point at time $t_1$ at which point spool A goes into exhaust condition and a new cycle commences.

In practice, the extent the two spools would be adjusted out of phase may differ from the 45° assumed above according to whatever pulse length may be desired and the frequency of the loom cycle per unit time. The pulse duration depends upon the length of time both spools are in exhaust and can be varied by changing the relative times at which the last spool goes low and the first spool goes high.

(3) Mechanical Embodiment-Alternative Design

In the mechanically operating embodiment of FIGS. 8–10, a shuttle valve must be interposed between the delivery ports of the two spools in order to prevent a cross-connection between these delivery ports which would allow a pressure condition applied by the supply recess of one spool to vent directly to the atmosphere through the exhaust recess of the other spool and result in loss of control over the working of the diaphragm valve. It is possible to provide a modified the design 200' for the spool array to eliminate the presence of the shuttle valve and one modified design functioning in this way is illustrated in FIGS. 11–13. Except for the elimination of the shuttle valve 187', the housing and driving means of the alternative embodiment are the same as in the initial unit and for sake of clarity, in the diagrammatic perspective view of FIG. 11, the driving gears, shafts and the like are omitted, and the housing is shown only in outline by dotted lines as at 198', the various air passageways which would in reality be formed as bores within the housing being developed as independent conduits for sake of clarity. Housing 198' encloses apertures 199'*a*, 199'*b* in which the spools 201'*a*, 201'*b* fit. The spools themselves are identical, except that they have opposite directions of rotation and have an opposite "hand". At the opposite ends of each spool there are solid collar-like sections 204*a*, 204*b* and 206*a*, 206*b* which form a pressure holding fit when the spools are mounted in the housing 198' and apart from several unrelieved regions or "islands", to be described, the spool periphery between these end collars 204*a, b* and 206*a, b* is relieved or of reduced diameter, as at 231'*a*, 231'*b*, to form a continuous annular chamber. A supply line 227' (see FIG. 11) connected to a supply source of pressurized air (not shown) branches to form supply ports 229'*a*, 229'*b* so that the respective supply chambers are continuously supplied with pressurized air.

At an intermediate point along the length of each spool the annular supply recess is interrupted by an unrelieved full diameter arcuate region of the spool periphery or island 242*a*, 242*b* and an end section of each such island has its interior cut away as at 243'*a*, 243'*b* to form an exhaust recess which communicates through an axial vent 247'*a*, 247'*b* (see FIG. 12) with the interior bore 202'*a*, 202'*b* and thus with the surrounding atmosphere. A delivery port 235'*a*, 235'*b* is arranged at corresponding points on the periphery of the spool apertures 199'*a*, 199'*b* and at an axial location within the axial limit of island 242*a*, 242*b* so that as each spool rotates, the associated delivery port can be placed selectively into communication with a supply recess, or with an exhaust recess (in which case communication also with the supply recess is prevented by the marginal edges of the island around the exhaust recess serving as a seal between the exhaust recess and supply recess) or be blocked by an island itself. The two delivery ports 235'*a*, *b* connect to a common delivery conduit 236 which connects to the control port of the nozzle via conduit 189''.

The rotary spools of the alternative design will likewise be subjected to radial forces which would in time result in excessive wear, and it is preferred in this embodiment also that counterbalancing means for such radial forces be provided similar to those already described in the initial embodiment. To this end, each island 242*a*, *b* and exhaust recess 243*a*, *b* is duplicated 180° out of phase by a pair of counterbalancing islands 249'*a*, 249'*b* and recesses 251'*a*, 251'*b*, one pair located to either side in the axial sense of the main island, and together equalling the peripheral and axial dimensions of each main island and exhaust recess, respectively. The recesses 251'*a*, 251'*b* are vented to the atmosphere as at 252*a*, 252*b*. Each set of counterbalancing islands 249'*a*, *b* and recesses 251'*a*, *b* has an associated counterbalancing port 255'*a*, 255'*b* which are connected to the same delivery conduit 189'' as the delivery ports 235'*a*, 235'*b*. Thus, whatever pressure is applied to each island or exhaust recess of each spool is exactly counterbalanced by an equal but opposite pressure applied to the counterbalancing islands and recesses.

The operation of the alternative mechanical embodiment closely resembles that of the main embodiment, and a wave form diagram illustrating the cyclic operation of the alternative form appears in FIG. 13 (wave forms c and e being absent since the shuttle valve is omitted and the nozzle pulse is unchanged). If both spools are in exhausting condition (i.e. both wave forms a and b are low) or one spool is in exhausting condition and the other spool in hold or blocking condition (i.e. either of wave forms a and b is low and the other is intermediate), then the nozzle operating diaphragm valve will be open (wave form d being high) and the nozzle will be emitting a pulse. Conversely, if both spools are in supplying condition (i.e. both wave forms a and b are high) with their delivery ports communicating with a corresponding supply recess, or if one spool is in supplying condition and the other in hold or blocking condition (i.e. either of wave forms a and b is high and the other is intermediate), control pressure will be delivered through control conduit 189'' and applied against the diaphragm valve to close that valve (wave form d being low) and terminates the nozzle firing pulse. Since the relative positions of the exhaust recess and blocking islands are reversed in the two spools, the island leading in one spool, while the exhaust recess leads in the other spool, one spool will be in blocking or hold condition while the other spool is in exhausting condition and by varying the angular relationship of the two spools, i.e. the arcuate distance represented by y in FIG. 13, the length of time that the diaphragm is free of control pressure and thus the length of the nozzle pulse can be adjusted. Maximum pulse duration occurs when spool A moves to hold position simultaneously as spool B moves to exhaust position; while minimum pulse duration occurs when both spools move simultaneously to exhaust position. In FIG. 13 wave forms a and b have been drawn in positions representing the maximum relative separation of the two spools, i.e. maximum possible length for y, the nozzle remaining open for a total of 90°, for sake of clarity. In practice, the interval between opening and closing of the diaphragm valve would normally be considerably smaller and in any case, the arcuate extent of the islands and recesses can be modified to suit the circumstances.

f. Weft Metering and Storage

(1) Preferred Rotating Drum Embodiment

An important aim of the invention is, as already indicated, a reduction in the amount of waste involved in producing fabric in the system of the invention. If it were attempted to control the length of the weft strand inserted into the warp directly through timed actuation of the weft delivery clamp located upstream of the insertion nozzle, considerable practical difficulties would be entailed. First, even electrically, i.e. solenoid, actuated clamps designed for precision operation are not reproducibly accurate within ±1 ms and given the high velocity of the strand under the impetus of the firing of the insertion nozzle, variations in the order of a few ms can easily result in significant differences in the length of the delivered weft. For instance, with weft arrival times in the order of 30 ms, the weft is moving at an average velocity of about 2"/ms so that variation in clamp actuation time in the order of 3 ms would cause a difference of 5–6" in the length of delivered weft.

Moreover, there is an inherent randomness in weft delivery at the velocities in question where the delivery is from stored coils. For example, as strand coils are whipped free from storage at high velocities, they develop substantial inertial forces and consequently upon reaching a limit are subject to substantial overrunning, i.e. backlash, the effect of which is inherently variable, making it impossible to precisely fix the length of strand advancing from a coiled supply past a given point within a fixed period of time. Also, the uncoiling strand develops a balloon in its path from the supply and the drag resistance offered by the ambient air against this balloon is likewise variable and affects the instantaneous rate of travel of the strand.

To avoid these practical difficulties, a different approach has been taken in the invention in the control of weft delivery, based upon two simple fundamental principles. First, since the duration of each operating cycle of the loom is constant for a given operating speed, for instance 150 ms at 400 picks per minute loom operating speed, the exact length of weft required per loom cycle is fixed, and the weft feeding device can be adjusted to exactly meter out from a supply package that exact amount of weft during each operating cycle and deliver the same to a storage device. With, for instance, a cylindrical feeder, its diameter is, of course, known, and simple mathematics permits the calculation of the amount of rotation per cycle required to deliver a length of weft equal to the loom width. As the first principle, therefore, during each operating cycle of the loom, there is delivered to a storage device having a delivery point a length of weft equal to that consumed during the cycle, i.e. equal to the width of the loom.

Second, it is postulated that the collected weft strand be withdrawn entirely from the storage device during each operating cycle and be stretched out as straight as possible from the fixed delivery point through the insertion nozzle into the shed, free of coils, loops, slack and the like. If the exact amount of weft needed for each cycle is made available during each cycle, and if this amount of weft is actually withdrawn in entirety from the storage device during each cycle, then obviously the amount of withdrawn weft must be correct.

Figures 14, 15:
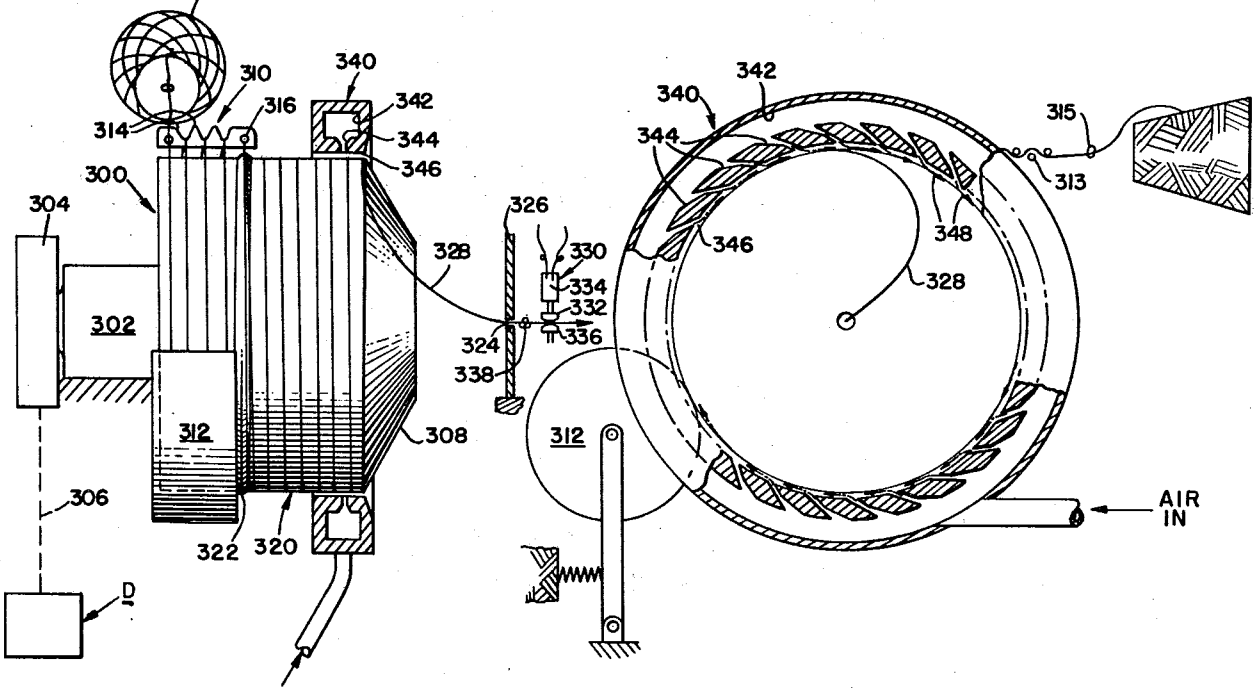
FIG. 14 is a side elevational view, partly in cross section, of one embodiment of weft metering and delivering unit utilizing a rotating drum.
FIG. 15 is an end view of the weft metering and delivering unit of FIG. 14, partly cut away to show the interior of the associated air ring.

In compliance with these principles, the system of the invention includes a weft metering and storage unit shown in detail at FIGS. 14 and 15. This unit includes a generally cylindrical drum 300 having a polished peripheral surface and mounted upon the free end of a cantilevered shaft 302 having a driven gear 304 that is positively coupled, as indicated by broken line 306, to the driving crankshaft D of the loom to be rotatably driven continuously in synchronism with the loom crankshaft. The coupling can take the form of driving and driven pulleys connected by a timing belt, or alternatively of a variable speed transmission, so that the extent of rotation of the drum per loom cycle can be adjusted and thereby the linear distance of travel of a given point on the drum periphery per crankshaft revolution. The drum is disposed adjacent one side of the loom with its axis of rotation extending generally parallel to the axes of the lay and weft guidance tube (not shown in FIGS. 14 and 15). At its inboard end facing toward the shed, the drum preferably has a conical nose 308 to permit the strand to be withdrawn therefrom along its axis without engaging a sharp edge.

The outboard section 310 of the drum serves as a weft metering means which functions to withdraw at a determined rate a correctly metered length of weft from the weft supply package P, supported at a convenient location on the loom frame, and to maintain positive frictional engagement with the weft to thereby achieve such controlled advance and at the same time frictionally restrain the weft being delivered against slippage. The metering section of the unit can take several forms but preferably comprises a pinch roller 312 in pinching engagement with a locus on the periphery of the outboard section of the drum. The quantity of weft that is allowed to be present on the outboard metering section of the drum is not critical and can be varied widely. Good results are achieved in practice by applying two or more wraps or coils of the weft on this outboard section 310 in spaced apart, i.e. helical, relation, the number of wraps and extent of the spacing, i.e. the pitch of the helix, being determined by several spaced guide eyes or notches 314, the innermost of which is a closed guide eye 316 positively engaging the strand against axial withdrawal and constituting a fixed weft delivery point delimiting the metering section. Preferably, the pinch roller contacts several wraps of the weft, assuring good control over the weft during its delivery to the storage section and avoiding possible snarls, but other ways of maintaining the weft under control in this region are available and could be substituted.

Alternatively, if the weft is wound around the outboard section 310 of the drum in a number of wraps large enough to create sufficient frictional contact required for positive engagement of the weft by the drum, pinch roller 312 could be eliminated. However, the presence of the pinch roller is preferred since it guarantees that the weft advances linearly with the drum periphery and is not free to slip thereon. As a further alternative, a pair of feed rolls (not shown) engaging the weft in their nip could be employed for controlled delivery of the weft to the closed guide eye 316, but this would involve extra complications in synchronizing the rotational advance of such feed rollers with the drum rotation.

The inboard free end section 320 of drum 300 functions as a weft storage means, serving to collect upon its surface the length of weft which is delivered thereto by the metering section 310 by way of closed weft guide 316 which is the transition between the two sections and establishes the outboard limit of storage section 320 of the drum as well as the inboard limit of metering section 310.

To insure that the coils formed by metering section 310 are delivered by the closed weft guide 316 in proper sequence on the storage section 320, a slightly downwardly and inwardly inclined shoulder or ramp 322 is formed on the drum periphery in approximate axial alignment with the closed guide 316. As a coil is delivered to the storage section, it contacts the ramp 322 and will be cammed inwardly thereby, leaving the ramp clear to receive the next collected coil. Otherwise, a subsequent coil might fall over or even inwardly of a previous coil and cause snarling. A preliminary guide 315 and tension 313 (see FIG. 15) precedes the pinch roller 312 to keep the weft from meandering laterally while advancing from the supply package P.

Upon leaving the inboard end of the storage section 320 of drum 300, the weft passes through a guide 324 arranged coaxially with the drum axis, the guide preferably being in the form of a closed eye disposed in the center of a vertically disposed plate 326. During the withdrawal of the weft coils from the storage section 320 during weft insertion, a balloon develops as at 328 in the weft path upstream of this guide eye, which defines the downstream limit of the balloon, and the plate 326 aids in preventing the balloon from overrunning the rest of the weft and creating tangles. Inboard of this balloon guide is a positively actuated weft delivery clamp 330 which can in practice be located on the lay just upstream of the insertion nozzle (not seen in FIGS. 14 and 15). At the operating speeds contemplated here, a fast response clamp is a requirement and, preferably, takes the form of a shoe 332 reciprocated by means of a solenoid 334 into contact with a fixed anvil 336. The solenoid 334 is actuated from the loom crankshaft as by means of a Hall effect switch, cam operated microswitch or the like (not shown) adjusted to actuate a relay and close the clamp at the desired time, any lag in the action of the solenoid being allowed for in setting the timing of the opening of the clamp which is not critical.

When the weft passes through the closed weft guide 316 into proximity with the rotating surface of the storage drum section 320, an air flow is created by the so-called Coanda effect which causes the weft to follow the moving drum surface. However, the strength of the Coanda effect is not sufficient to insure that after the stored length of weft has been withdrawn from storage section 320, an incoming fresh length of weft will again wrap around the drum, and in order to apply an additional wrapping force supplementing the Coanda effect, an additional circular air flow is provided.

To generate this added flow, an annular ring 340 encircles in closely spaced relation the storage section of the drum, the ring being hollow and generally toroidal in structure with its hollow core 342 acting as a manifold and connected to a source of pressurized medium, not shown. This medium is for all practical purposes air, and hence the ring will, for convenience be referred to as an air ring. The inner wall of the air ring is perforated by a series of uniformly circumferentially spaced slots 344 communicating with the hollow core 342 and delivering compressed medium therefrom into the annular gap 346 between the interior of the ring and exterior of drum storage section 320. The slots 344 are inclined from the radial from their manifold end inwardly in the direction of drum rotation, and a circular or vortical flow of air indicated by dot-dash arrows 348 is thus generated around the storage section of the drum urging the weft against the periphery of that section to be collected in a coil and maintaining such coil tight to prevent sloughing. Moreover, any slack that may develop in the weft due to relative motion between the insertion nozzle and the fixed drum is automatically taken up by the air ring flow and rewound upon the drum.

In operation, the strand from the supply package is preliminarily threaded manually through the preliminary guide, beneath the pinch roller, around the metering section the appropriate number of turns, through the fixed weft guide (and any intervening additional guides), the interior of the air ring, the balloon guide, the tension device, the delivery clamp and finally through the injection nozzle. Then the loom can be operated in the usual way. Once the loom is in operation, the drum rotates continuously with air being supplied to the ring continuously and after each length on the storage section is withdrawn therefrom during weft insertion, a new weft length is generated by the metering section and delivered to the storage section.

The combined force of the air ring flow and the Coanda effect can be varied and is sufficient to cause the weft to wrap upon the drum surface whenever its tension falls below a certain level in the range of about 1–5 grams, and this force is applied equally to the downstream as well as the upstream side of the strand. That is, the biasing effect will not only cause any freshly metered out strand to wind on the drum surface, it will equally cause any excess weft downstream of the storage drum section 320 to be wound on the drum surface which is useful in preventing strand kinking. However, this effect can also pull the strand backward and an important function of the weft delivery clamp 330 is to prevent the weft from being pulled back out of the shed after its insertion and coincidentally storage of weft for the next insertion is initiated. Obviously, the tension developed in the weft by the firing of the insertion nozzle greatly exceeds the biasing force of the air ring, but towards the end of the insertion phase, there naturally comes a time at which this tension has been dissipated and the inertia of the inserted weft falls below the biasing force of the air ring. If the weft remained free when this time is reached, it would be pulled out of the shed as the biasing force of the air ring takes over; hence the timing of the reactivation of the clamp must be set to occur before this point is reached.

Recalling that the pressure trace of the insertion nozzle firing pulse has a generally trapezoidal configuration, one will understand it is necessary for the clamp to be activated to close not later than a few ms, i.e. 2–5 ms, following the end of the firing pulse and preferably just slightly before the pulse has completely dissipated. On the other hand, actuation of the clamp while the nozzle pressure remains at significant levels is definitely to be avoided. If the weft is forceably restrained, by the clamp or otherwise, while being highly stressed by the blast of the insertion nozzle, then the weft tends to disintegrate because of the intense vortical forces it receives.

The release of the weft by the clamp for the next insertion step should likewise precede the activation of the insertion nozzle. As regards the timing of the reactivation of the clamp relative to the end of the insertion stage, when the stored weft coils are whipped free of the storage drum surface by the nozzle, the final coils tend to override the drum due to inertia as has already been mentioned, and it has been observed that an initial rise occurs in the tension in the moving weft, as detected by the tension detector 338, which is traceable to this backlash effect. Therefore, the actuation of the clamp should preferably be delayed for a few, e.g. 2–5 ms, after the earliest tension increase to allow this backlash effect to subside and the weft to assume its desired straightened out condition before being clamped. When the weft is drawn straight back to the fixed weft guide, a decided peak appears in the weft tension at the detector, and this indication can be used to establish the correct timed relationship for clamp operation.

In determining the length of weft provided by the storage drum ssection, one must keep in mind that the drum is operating continuously during the entire loom cycle so that an additional weft is being added to the storage drum section during the very period that the already collected weft length is being withdrawn by the insertion nozzle. However, by following the two simple principles explained above, the delivery system becomes self-regulating, in that with the correct amount of weft being transferred to the storage drum section 320 during each cycle and the length being withdrawn in entirety back to the closed weft guide, it becomes immaterial how much of the weft length is collected during the storage phase and how much is added during the weft insertion stage. This approach has the virtue of allowing a tolerance of a few ms without difficulty due to the relatively slow speed of travel of the weft during metering and storage versus its high rate during insertion. For instance, with a 48" loom and a 150 ms operating cycle time, the linear speed of the weft while being metered and stored is only about 0.3"/ms so that a variation of ±4 ms creates a difference of only about 1" in weft length.

Because of the extremely fast advance of the weft upon withdrawal from the storage section during nozzle firing, it may be desirable to apply a retarding force beyond the light tension of the detector 338 to the weft in the region between the balloon guide 324 and the delivery clamp 330 and a conventional tensioning device can be employed to augment the detector tension for this purpose. However, conventional tensioning devices are notoriously difficult to control precisely and are better avoided if possible. As an alternative, the advance of the weft from the storage section 320 can be retarded by increasing the separation between the inboard end of drum 300 and the balloon guide 324. This correspondingly increases the size of the balloon 328 and thus the resistance applied to the ballooning length of weft by the air and inertial forces.

(2) Alternative Fixed Drum Embodiment

Figure 16:
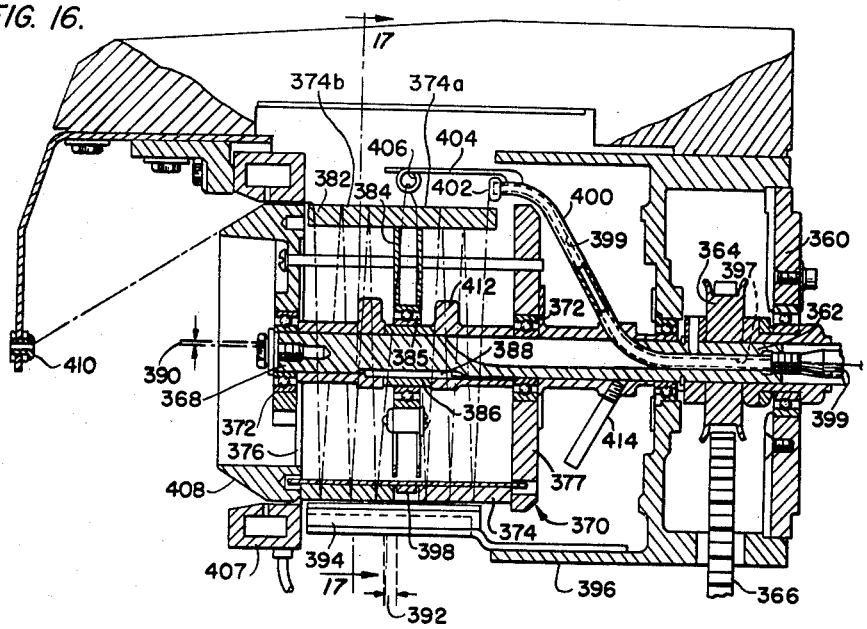
FIG. 16 is a side elevational view partially in cross-section of a modified weft metering and delivering unit utilizing a stationary winding drum.
Figure 17:
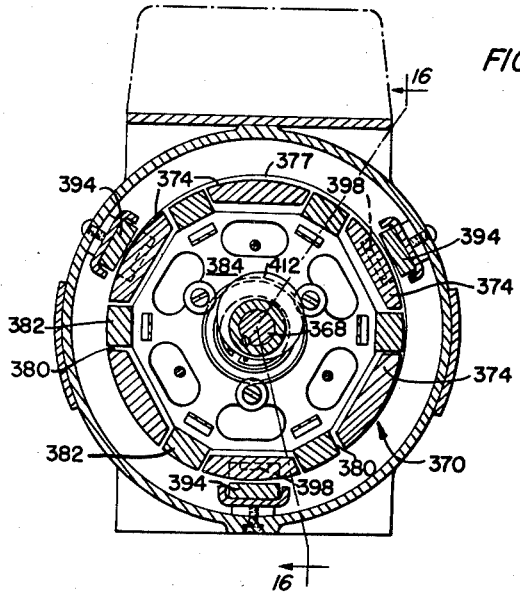
FIG. 17 is an end view partially in section of the modified metering and delivering unit of FIG. 16.

As an alternative to the rotating drum unit described above, weft metering and storage can be carried out with a stationary drum unit similar in principle to the strand feeder disclosed in U.S. Pat. No. 3,776,480 to which reference could be made for a more complete understanding. In general, the alternative embodiment, as appears in FIGS. 16 and 17, includes a fixed support 360, which can be a bracket extending from the loom frame, and in this support is double-journalled one end of a rotatable shaft 362. A timing pulley 364 is affixed to the shaft between its journals for engagement by a timing belt 366 driven from the loom crankshaft (not seen) so as to create a positive mechanical drive between the crankshaft and the rotatable shaft. The free end of the shaft projects toward the loom in cantilevered fashion as at 368 inboard of support 360 to carry on its projecting end a generally cylindrical hollow drum 370 via intervening bearings 372 to permit independent relative rotation therebetween. The drum is formed of a plurality of segments 374 clamped between end walls 376, 377 in peripherally spaced apart relation to define a plurality, say six or eight, of axial slots 380 (see FIG. 17) uniformly around the drum periphery and a corresponding plurality of axially extending bars 382 fit freely in these slots. The axial bars are each integrally connected at about the midpoint of their inner sides to a common supporting spider 384 fitting within the interior hollow drum but free of connection with the drum segments. The spider is journaled via a bearing 385 on a bushing 386 keyed as at 388 to the shaft end 368, the periphery of the bushing being both eccentric, as indicated at 390, and slightly skewed or tilted relative to the shaft axis, as indicated at 392, so as to skew the axial bars in their slots. The drum is held against rotation by one or more fixed magnets 394 each supported adjacent the drum periphery from the end of an arm 396 projecting from the fixed support and attracting an associated magnet 398 recessed in one of the drum segments. Thus, when the shaft rotates while the drum/bar composite remains stationary, the spider 384 wobbles about shaft 368 imparting what is referred to as a "nutating" or "walking beam" motion to the array of axial bars 382 relative to the drum periphery which serves to gradually advance coils of a strand wrapped around the drum.

The outboard end of shaft 362 is hollow as at 397 to define an axial weft passageway for the weft advancing from its supply package (not seen in FIGS. 16 and 17) and communicates with the bore 399 of a radially and axially projecting hollow winding tube 400 having a free end 402 opening terminating adjacent the outboard end of the bar array 382. For purposes of the present invention, an arm 404 extends from the end of winding tube 400 to carry a closed weft guide eye 406 at a point along the length of the drum coinciding roughly with the midpoint of the axial bars.

The inboard end wall 376 of the drum is surrounded by an air ring 407 similar in design and operation to the air ring of the rotating drum embodiment, and beyond the air ring, the end wall has a tapered axial extension 408 to facilitate smooth passage of the weft thereby. A balloon guide eye 410 similar to the balloon guide eye of the previous embodiment is arranged in spaced coaxial relation to the inboard end of the drum to guide the weft to the nozzle.

The outboard axial section **374*a* of the drum-bar composite between the winding tube end 402 and the closed guide eye 406 functions in operation as the metering section of the unit, receiving the weft delivered thereto from the weft supply package via the winding tube 400, the winding tube being rotated the correct number of turns per loom cycle in relation to the diameter of the drum-bar composite to wind upon the drum the desired length of weft for that cycle. The inboard axial section 374*b* of the drum between the closed weft guide eye 406 and the air ring 407 functions as the storage section for holding the length of weft which is withdrawn by the insertion nozzle, the closed guide eye 406 forming the transition between the metering and storage sections and limiting axial unwinding of the stored coils during insertion. The weft guide eye 406 rotates bodily with the winding tube and, in effect, progressively transfers wraps or coils of the weft previously applied to the metering section onto the storage section, while the winding tube lays down fresh wraps of weft upon the metering section. The "nutating" motion of the bar array relative to the drum periphery serves to space the coils about 1/16–3/32" apart dependent upon the skew and to gradually advance the coils axially along both the metering and storage sections and maintain these coils in helically separated condition. The aggregate number of wraps of weft upon the two sections is sufficient to exert enough frictional force upon the weft in such coils as to hold the coils against slipping around the drum following the rotating winding tube, and consequently, fresh weft is drawn from the supply into and through the bore 399 of the winding tube as the latter rotates about the drum in timed relation with the rotation of the crankshaft of the loom. Inasmuch as shaft 362 rotates at a considerable rate, e.g. several thousand rpm, in operation, careful balancing is critical to vibration-free operation and weights 412, 414** can be provided for counterbalancing purposes at appropriate points.

Air ring 407 functions in the same manner as before to retain the weft coils on the storage section of the drum and remove any slack that may form between the injection nozzle and the closed weft guide eye 406.

g. Weft Reception and Arrival Detection

In order to insure that the leading end of the weft after insertion through the shed is engaged and contained during beat up of the weft, a hollow weft reception vacuum tube generally designated V is mounted on the end of the lay opposite the insertion nozzle, the tube being open at one end located adjacent to and facing that side of the shed and connected at its other end to a source of vacuum (not shown) maintaining a negative pressure in the tube of about 20" water. One preferred embodiment of vaccum tube V is shown in FIG. 18 and in this embodiment the end of the tube adjacent the shed is elongated or flattened as at 440 (see also FIGS. 2A and B) in a generally vertical direction parallel to the plane of the reed R to concentrate the suction force. To reduce the possibility of the leading weft end missing this slotlike opening having a width of about ⅜", a laterally projecting flange 442, 444 extends from either side of the opening to increase the "target area" of the opening. The effect of these flanges is to momentarily halt the movement of the weft end if it should miss the tube opening, which is enough for the suction in the tube end to attract the weft end therein.

It is advantageous for the arrival of the weft at the reception tube to be positively detected. In the event the weft end does not completely traverse the shed, which can occur when the weft end becomes entangled upon itself, the result is a defect in the woven fabric which can become permanent if weaving is continued. To this end, a photoelectric detection unit can be provided at the reception side of the shed and is preferably associated with a modified form of reception tube $V_1$ seen in FIG. 19. In this embodiment, the tube itself is circular as at 440' and telescoped over its open end is an enlarged collar 446 of generally oval or rectangular shape having a vertically elongated aperture 448 in its center communicating with the suction tube and defining the weft entry slot. The sides 442', 444' of the end face of the collar serve as the weft intercepting flanges, and the edge around the inlet opening can usefully be beveled or rounded as at 450 to further assist entry of the weft end. Integrated into the collar is a vertically spaced array of minute photoelectric beam generators 452 and associated transducers 454 disposed along opposite sides of the elongated entry slot at a plurality, say three, of vertically spaced points. The response of such a multi-cell array is more reliable than a single large cell, the minute cells being more sensitive to interception by a small thread while the multiplication of the cells increase the likelihood of the weft being detected. As will be described more fully in connection with the electrical circuit diagram of FIG. 21, the outputs of the photoelectric detection transducer are amplified and transmitted through an appropriate circuit to a solenoid-operated clutch (not shown) controlling the power transmission from the loom motor to the loom crankshaft to bring the loom automatically to a halt in the event a signal pulse from one or more cells indicating the arrival of the weft fails to be received within a set interval of the loom operating cycle. That interval can vary but preferably begins when the shed opens to the extent permitting weft insertion, i.e. at about 140° of the cycle, and terminates at the front dead center position of the loom with the lay in its full beat up position, i.e. at 360°. This interval can be established by means of switches and activated from the loom crankshaft at the appropriate points of its rotation.

As is evident from the end view of the reception vacuum tube 440, 440' seen in FIG. 2A, the axis of the 440, 440' during weft insertion must be generally in registration with the axis of the interrupted weft guidance tube T within the open shed S, which axis is necessarily spaced forwardly of the plane of the reed R. Hence, if the reception tube remained fixed in this position during beat up, its axis would lie forwardly of the fell of the fabric (which coincides with the plane of the reed at front dead center) and since the free length of weft projecting outside the shed is made as short as possible, say 1 to 1½" so as to minimize the waste resulting when such projecting lengths are eventually sheared from the fabric, and the fed weft ends could consequently be pulled out of the reception tube inlet as the lay approaches front dead center, this would result in loss of engagement with the free weft end at the very moment such end needs to be positively restrained for purposes of selvage formation.

Preferably, therefore, the reception tube is mounted for limited independent relative displacement upon the lay as appears in FIGS. 2A and 2B. To this end, a bracket 460 is affixed to the end of the lay and upon this bracket is pivoted a generally vertically arranged bell crank lever 462 carrying the suction tube 440 at its upper end. The lower end 464 of the bell crank lever is linked to a collar 466 fixed to one of the guide rods 55 forming part of the vertically displaceable support for the interrupted weft guidance tube T. Thus, as the lay rocks rearwardly and guide rods slide upwardly to introduce the weft guidance tube into the opening shed preparatory to the weft insertion, collar 466 also moves upwardly to rock bell crank 462 forwardly and bring the suction tube 440 into alignment with the guidance tube axis. Contrariwise, as the lay swings forward to beat up position and the weft guidance tube is withdrawn downwardly below the shed, the bell crank 462 is rocked rearwardly to displace the suction tube axis rearwardly of the guidance tube axis and into coincidence with the plane of the reed which is possible since the suction tube is located outside the end of the reed. Any lateral offset between the location of the collar 466 and the bell crank 462 can be bridged by extending one or more pivot shafts.

For some purposes, the engagement of the weft free end by the suction in the weft reception tube is desirably augmented by means of a positively activating weft end clamp 470 (see FIGS. 18, 2A and 2B). Such a clamp can be built into the reception tube by cutting a slot in one side of the tube 440, as at 472, for the projection therein of a weft clamping pad 474 carried at the upper end of an upstanding finger 476. Finger 476 is pivotally mounted at its lower end 478 to the bell crank 462 so as to be movable bodily with the bell crank and the reception tube 440 carried thereby while also capable of limited independent pivotal movement. Below the pivot point the finger includes an angularly forward extension 480 which is adapted to engage an adjustable fixed stop 482 on the lay when the bell crank 462 is in forward position (and the lay is in rearward position) during weft insertion, thereby swinging the clamping pad 474 out of the tube slot 472 and allowing the weft end to freely enter the reception tube opening. Then, when the bell crank 462 pivots rearwardly during beat up, finger 476 rocks with it which lifts extension 480 away from the stop 482, allowing finger 476 to be biased forwardly by a spring 484 toward the reception tube seat 472 to bring pad 474 into engagement with the inside wall of the tube with the weft end gripped therebetween.

h. In-Shed Weft Tensioning

After the weft has been inserted entirely through the shed S and its leading end engaged by the suction of reception tube V provided on the reception side of the shed, it may be desirable in some cases to apply tension to the in-shed length of weft before it is beat up against the fell E of the fabric. Unless the inserted weft is taut before its entwinement by the warp during shedding, any slack therein will be locked into the fabric producing visible defects. If the insertion phase is carried out correctly, the weft can usually be made to extend through the shed with adequate tightness, but if this problem does arise, it can be solved without the necessity for physically engaging and stretching the projecting outside end of the weft, which would undesirably increase the exteriorly projecting length of the weft thread and consequently increase the amount of waste formed during production.

Effective in-shed weft tension can be accomplished quite simply by employing the modified form of reception tube of FIG. 18 including a positively-active weft end clamp 470, adding an adjustable strand tensioning unit, which can be incorporated into the tension detector 338 in FIG. 14. in a position on the loom frame intermediate the balloon guide and weft delivery clamp and altering the delivery clamp actuation cycle to release the clamp promptly after the free end of the weft strand has arrived at the reception tube. The force applied by the adjustable tensioning device is adjusted to the level of the tension desired in the weft length within the shed and is in any case greater than the force applied to the stored weft coils in the weft storage section by the air ring and the Coanda effect. Thus, the free end of the weft will be held by the reception clamp 470 which moves with the lay, while a part of the weft upstream of the insertion nozzle N is held by the tension unit which is stationary on the loom.

After weft insertion when the lay rocks a few degrees forward from back dead center, the reception clamp 470 functions to engage the weft leading end and thereafter continues to grip the free weft end after the delivery clamp has been released. As the lay moves towards front dead center during the beat up phase, the distance between the insertion nozzle and the stationary adjustable tension unit must increase (since the hypotenuse of a right triangle is always longer than its base side), and this change in the intervening strand length is used to impart a straightening tensioning force to the inserted weft. The adjustable tensioning unit, situated between the delivery drum and this length of strand is, as mentioned, adjusted to a level consistent with the tensioning force desired to be applied to the inserted weft. Consequently, as the lay moves forward with the free end of the weft held fixed by the reception clamp, the adjustable tension unit grips and holds an opposite end section of the weft until the tension along the entire length of the inserted weft exceeds the set tensioning force. Thereafter, as continued movement of the lay demands more weft, the adjustable tension unit yields to pass from the storage section that amount needed for the inserted weft length to move bodily with the lay. In this manner, the natural beat up motion of the lay serves to impart to the inserted weft the desired degree of tension so that the weft is in proper taut configuration for beating up into the fell, without resort to special slack-removing arrangements.

i. Fabric Selvage Formation

The fabric produced by the weaving system of the invention must, like any other fabric, be adapted for further processing, such as dyeing, printing, tentering and the like, and must be able to withstand the manipulation involved in carrying out such operations. Thus, the fabric must have the capacity to be gripped along its edges and stretched taut without undergoing substantial unraveling. In normal weaving, where the weft is looped back and forth across the shed without interruption, there is formed a fabric edge of selvage which has the necessary resistance to withstand lateral tensioning since the end loops bend around each ultimate warp end and effectively bind the same into the body of the fabric. In the fabric of the present invention, however, the weft is inserted always from the same side of the shed as discrete individual lengths of thread, the delivered weft being cut adjacent the sides of the shed, leaving its free ends dangling loose along the edges of the warp. Obviously, since these loose weft ends can move freely in all directions, they cannot withstand the tension inherent in the sinuously-bent warp ends; therefore, the outermost warp thread will be released and free to unravel which releases the next warp thread to unravel and so on. This problem is particularly acute on the reception side of the fabric because, in contrast to the delivery side where the projected length of the filling strand is positively gripped within the delivery clamp preferably until sheared at the fell line of the fabric, the free filling end on the reception side of the warp has only light tension imposed thereon by the vacuum reception tube which is not adequate to hold the warp threads in place.

Several techniques have been employed in the art to produce a fabric selvage having the necessary integrity for subsequent manipulation. In one case, tuckers have been utilized to engage each exteriorly projecting weft end and to tuck the same bodily into the next created shed so as to form artificially a loop securing the outermost warp threads in place. In another case, a group of two or more warp threads are secured by means of a leno chain stitch and an additional group of some 20–30 warp threads are provided to the outside of the locus of the leno stitch to produce a so-called false selvage. The weft is long enough to weave with this additional group of warp threads, and the result is a marginal strip suitable for engagement during handling. The weft ends are loose on the outside of the false selvage which makes unraveling possible, but this is inconsequential since after weft beat up is completed, the false selvage strip is severed from the remainder of the fabric and discarded.

In either case, the result is the formation of a significant amount of wasted thread. In the first instance, the tucking in of the projecting filling ends produces dense margins along the fabric edge which are readily distinguishable from the body of the fabric and must be severed and discarded before the fabric is used; while in the latter case, it is the false selvage strip itself that constitutes waste.

Since the present weaving system emphasizes the reduction to a virtual minimum of the amount of waste resulting from its operation, an improved selvage forming technique has been devised as shown in FIG. 36, and is preferably utilized. In this technique, a leno chain stitch is first formed in association with the outside three or four of the warp threads, which are stippled in FIG. 36 on at least the reception side of the warp and for this purpose a conventional leno attachment of a commercially available type is mounted on the front heddle of the loom as indicated diagrammatically in FIG. 1 of the drawings. As is well known in the art, a leno attachment takes the form of the two needle-like members 490 arranged adjacent one corner of the front heddle H generally parallel to the plane of the heddle, each needle having an eye not seen at its lower end through which a leno thread, shaded in FIG. 36, passes from a package (not shown) supported on the rear of the loom frame via one of the guides 492 mounted on the heddle. The two leno needles are mechanically coupled by means enclosed within a housing 494 in such a way as to undergo 180° bodily displacement in their relative positions each time the front heddle moves to its raised position so as to oscillate to and fro relative to the outermost three or four warp ends to criss-cross the leno threads over those warp ends. When the front heddle is in its upper position, the leno threads generally follow the angle of the upper side of the shed forwardly of the heddle and then lie above the next weft. While when the front heddle is in lowered position, the leno threads generally follow the lower side of the shed and then lie beneath the next weft. In this way a kind of criss-crossing chain stitch is formed around an outermost group of three or four of the regular warp ends to bind them to the body of the fabric, as indicated by the shaded leno threads in FIG. 36.

In operation, and assuming, for instance, the use of two heddle frames in the loom, the leno threads will wind beneath every other weft thread and then criss-cross, i.e. switch their location, over the top of each intervening alternating weft thread. If the number of heddle frames exceeds three or more, then the leno threads may criss-cross over the top of one weft and pass beneath the remaining two or more wefts before repeating.

The resultant leno chain stitch alone is not sufficient to bind effectively the outermost warp threads to the body of the fabric. The free weft end being, as already explained, completely free to move about without restraint, the bight of each leno thread winding beneath a just-inserted weft will immediately pull free as soon as it is tensioned during the next oscillation of the leno needles, destroying the chain stitch effect.

To avoid this problem according to the invention, there is associated with the leno stitch, a rotary binder stitch. To create the rotary binder stitch, a carrier plate 496 for two binder threads G (cross-hatched for identification in FIG. 36) is mounted on the reception side of the shed, and duplicated on the delivery side as well if desired, at a location on the loom frame on the warp beam or back side of the heddles with the plane of the plate arranged vertically and its axis of rotation extending generally parallel to the axis A of the lay. On the outboard face of this plate is a pair of binder thread supply spools 498 and threads G from these supplies are threaded through flexible strand tension wires 500 projecting at diametrically opposite points on the plate. An adjustable friction device (not shown) engages each spool to tension the strand withdrawn therefrom. The flexible tension wires 500 extend radially from the plate periphery to define between the guide eyes at their respective ends a separation roughly equal to the stroke of reciprocation of the heddles H and the binder threads G extend from the terminal guide eyes to the fell F of the fabric.

The carrier plate 496 rotates continuously at a rate synchronized with the rate of operation of the loom so that the plate turns 180° with each loom cycle and 5°-10° in advance of or out of phase with that cycle. Thus, the binder threads G move alternately up and down similar to the shed forming movement of the warp threads but slightly out of phase therewith, while being also simultaneously twisted about one another at the rate of one-half turn of twist per loom operating cycle. This twisting effect is in principle the same as if the carrier plate axis were parallel to the thread direction instead of perpendicular thereto, the only difference being that the rotation of the plate causes the binder supply package 498 to shift bodily towards and away from the fell E which would introduce slack in the binder threads G were it not for the carrier guide wires 500. These tension wires 500 are designed with sufficient flexibility to maintain the binder threads G under tension during the rotation of carrier plate 496 so that the binder threads G remain taut at all times throughout their length up to the fell of the fabric. The slightly advanced timing of the carrier rotation results in the binder threads crossing a freshly inserted weft as early as possible; and hence, the free end of each weft is immediately upon its insertion pinched between the binder threads. In this way, each free weft end is caught in the grip of the twisted together binder threads G and held in place until the leno chain stitch can be completed around that weft end.

It has been found that the combination of the leno chain stitch and the twisted binder stitch imparts a high degree of integrity to the fabric selvage and enables the same to readily withstand whatever stresses need to be imposed thereon during conventional fabric finishing operations. While the projecting ends of the weft are still necessarily loose or free as a fringe, this does not result in the collapse of the binder stitch because the twisted nature of that stitch acts to pinch the free weft end between the opposed binder threads and hold it in place until the weaving has progressed to the point that a sufficient number of new weft ends have been added as to pack all of the threads with sufficient tightness or density as to hold them in place after release of weaving tension. For some purposes, the binder stitch alone may exert adequate restraint upon the weft ends so that the leno chain stitch can be dispensed with, but it is preferred to employ the combination of these two stitches to achieve optimum results. In either case, it is unnecessary to remove any portion of the margins of the fabric, as is required with a false selvage or with a tucked selvage, since the density of the fabric remains uniform virtually to its extreme edges and waste is, therefore, reduced to a minimum j. Air Circuit

Figure 20:
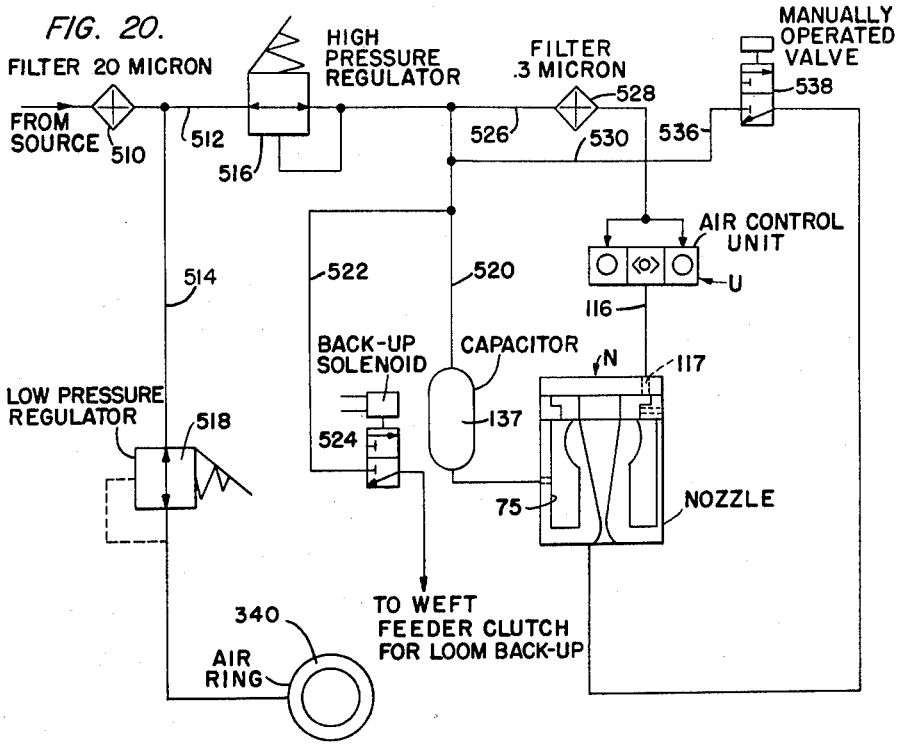
FIG. 20 is a schematic air circuit diagram for a preferred embodiment of the invention.

To aid in an understanding of the manner of operation of the invention, an "air" circuit diagram for the pneumatic components is shown in schematic fashion at FIG. 20. In this diagram, air from a suitable original pressure source (not shown) is passed through a coarse filter 510 to remove oil contamination and solid particles such as dust and the like, above say 20μ in size, and then is delivered to a high pressure line 512 and a low pressure line 514, the pressures in which are determined by high pressure and low pressure regulators 516, 518, respectively.

High pressure line 512 has several branches, the first of which 520 communicates directly with the storage chamber 75 of the insertion nozzle N or, more preferably as shown, with the air accumulator 137 and through that accumulator with the nozzle storage chamber. A second branch 522 passes through a solenoid operated valve 524, movable between a delivery and an exhaust position to a clutch (not shown) in the drive of the weft metering and storage unit so as to disengage that clutch and stop further accumulation of weft on that unit when the solenoid valve is activated during, for example, backing up of the loom to repair a broken or incomplete weft.

Another branch 526 passes through a fine filter 528 capable of removing particles down to about 3 micron and then connects with the inlet of the weft insertion nozzle control unit U (shown as the embodiment of FIGS. 8-10) for delivery under the control of that unit to the pilot control inlet 117 of the insertion nozzle N itself. A fourth branch 530 passes through a manually energized solenoid valve 538 having delivery and exhaust positions, and on to a feed port (which can be the same as pressure tap port 181) in the supply passageway of the nozzle so as to allow bursts of air to be emitted from the nozzle opening by direct operator actuation of valve 538 independently of the nozzle control unit U itself. The low pressure line feeds continuously to the air ring 340 of the weft metering and storage unit.

k. Electrical Circuit Diagram

Figure 21:
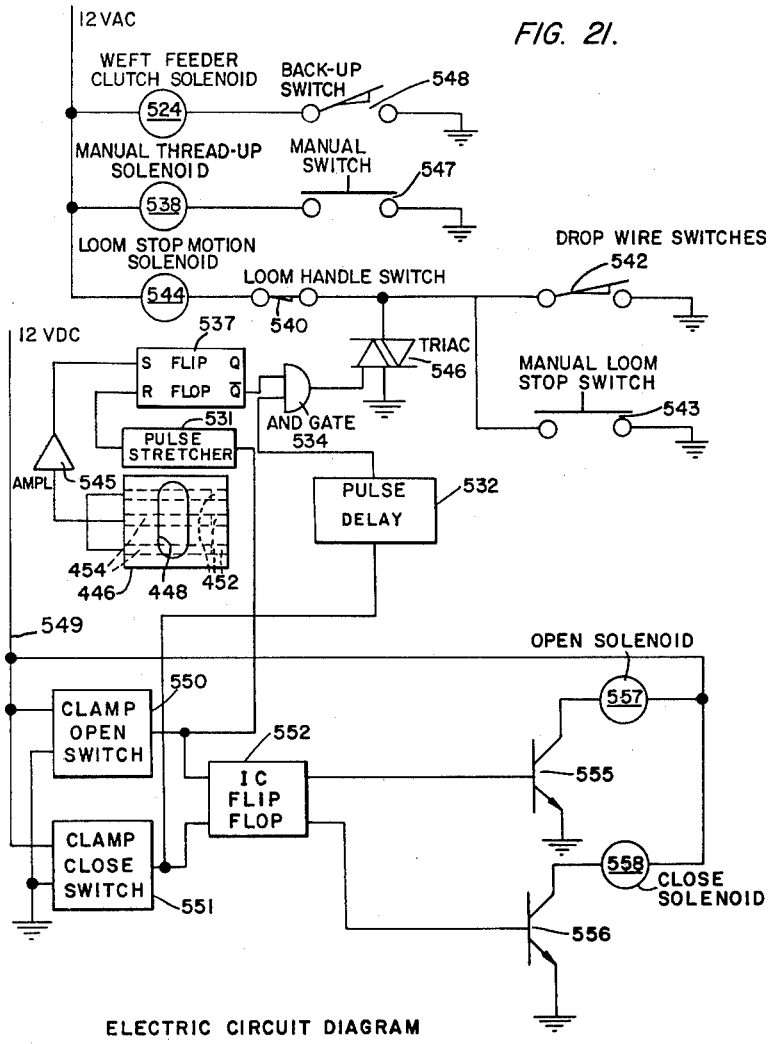
FIG. 21 is a schematic electrical circuit diagram for a preferred embodiment of the invention.

An electrical circuit diagram for the electrical components of the air circuit diagram and other related components (exclusive of the electrical embodiment of control unit U) is seen in FIG. 21.

As already mentioned, it is possible to operate the weft delivery clamp by a spring-return solenoid energized by a microswitch contacted by a rotary cam rotating with the loom crankshaft and contoured to open and close the switch and thus the clamp at the proper times. Obviously, however, it would be complicated to adjust these times with such an arrangement. It is preferred, therefore, to operate the weft delivery clamp with two separate oppositely driving solenoids which are coupled together and to the clamp head and are energized alternately in correctly timed relation. To this end, as shown at the bottom of FIG. 21, separate clamp opening and clamp closing switches 550 and 551 are each connected on one side to a 12 volt D.C. line 549 and on the other side to a different side of an integrated circuit flip-flop 552. Each of the outputs of the flip-flop is connected to the base of an associated power transistor 555, 556 is connected in series to one side of a corresponding solenoid 557, 558 having its other side connected to the D.C. line 549 to complete the circuit. When the clamp open switch 550 is closed, transistor 555 is activated to permit current to flow through solenoid 557 to open the weft delivery clamp; while, conversely, when clamp closing switch 551 is closed, transistor 556 is activated to allow current to flow to the solenoid 558 to close the weft delivery clamp.

A preferred arrangement for operating switches 550, 551 appears in FIG. 37 wherein switches 550, 551 take the form of Hall effect switches mounted at radially separated points on corresponding arms 559, 560 pivoted on a shaft 561 rotating with the loom crankshaft. Magnetic actuators 564, 565 are carried on separate discs 562, 563, fixed to the shaft 561 for rotation therewith, at corresponding radially separated points so that each of the actuators rotates in a circular path coinciding with only one Hall effect switch.

As stated, close control, within 1–2 ms, of the actuation of the weft delivery clamp can be important, and the open interval of the weft delivery clamp must be adjustable. Gross adjustment of the relative positions of magnetic actuators 564, 565 is possible by means of a clampable pin and slot connection 566. In addition, fine adjustment is achieved by forming the ends of the arms 559, 560 as gear segments as at 567, 568, for engagement with pinions 569, 570 fixed on the frame of the loom and secured by spring-biased detents (not shown) in any rotation position. The arms pivot independently on shaft 561 and by turning the pinions 569, 570, the relative peripheral positions of the arms and thus of the Hall effect switches themselves can be precisely adjusted.

A loom normally incorporates a so-called loom stop motion connected between a 12 volt A.C. source and ground and including a mercury switch 540 associated with the operating position (being shown normally closed in FIG. 21). A drop wire switch 542 responsive to the warp drop wires (not shown) to be closed when a warp thread breaks is connected in parallel to a manual loom stop switch 543, and both are in series through switch 540 with the loom "stop" solenoid 544 controlling a clutch (not shown) transmitting power from the loom motor to the loom crankshaft so as to automatically stop the loom when any warp strand breaks during operation or manual stop switch 543 is closed. This circuit is conveniently used in the present invention for stopping the loom in the event the photoelectric weft detector array in the reception tube fails to detect the arrival of the leading weft end at the proper time. To this end, the output of a triac or bi-directional thyristor 546 is also connected in series with the stop solenoid 544 through the mercury switch 540, being in parallel with the drop wire switch 542 and the manual stop switch 543. The output of photodetector, emitter-transducer array 452, 454 (FIG. 19) is amplified for practical reasons by an operational amplifier 545 and applied to the S input of an RS flip-flop 537 having its Q output open and its $\bar{Q}$ output connected to one side of an AND gate 534. A resetting pulse is derived from the clamp open switch 550 and after being stretched in a pulse stretcher 531 is applied to the R input of flip-flop 547, the duration of the stretching extending until a few ms after front dead center of the loom. A timing pulse derived from the clamp close switch 551 is delivered to the other side of AND gate 534 after being delayed as at 532 so that its arrival coincides exactly with front dead center of the loom. The output of AND gate 534 is applied to the trigger of triac 546.

Unless interrupted by the arrival of the weft, the photoelectric array is continuously conducting and the S input of the flip-flop remains at logic 1 which holds the $\bar{Q}$ output at logic 1 and the Q output at logic 0. Thus, if no weft has arrived by the time the loom reaches front dead center, both inputs of the AND gate are at logic 1 and a pulse is passed by that gate to trigger the triac and actuate the stop motion solenoid. If a weft does arrive, a mementary logic 0 is received at input S which activates the flip-flop to make $\bar{Q}$ go to logic 0 and Q go to logic 1. Since the pulse stretcher 531 holds input R at logic 1 until after front dead center, the flip-flop holds $\bar{Q}$ at logic 0 irrespective of subsequent fluctuations of the R input between logic 1 and logic 0. Upon the termination of the stretched reset pulse, input S returns to logic 0 which resets the flip-flop to make $\bar{Q}$ go to logic 1 and Q go to logic 0.

If the weft arrival detection array should become disabled, the loom is automatically stopped since any interruption in the photoelectric output activates flip-flop 547. When the loom is operated to correct the defect due to weft nonarrival or other problems, mercury switch 540 will be opened to disconnect the stop solenoid and simultaneously reset triac 546.

A loom back-up switch 548 on the operating handle supplies A.C. current to the weft feeder clutch solenoid valve 524 so as to disengage the weft feeder clutch and avoid entanglement or further accumulation of weft on the feeder while loom crankshaft is moved manually to make necessary repairs to fabric or loom. Similarly, solenoid 538 which controls a valve for admitting feeding air directly into the insertion nozzle independently of the nozzle control unit U is connected to the same power line on one side and on the other to a manually operated switch 547 and thence to ground. The operator by closing switch 547 can admit a pulse of air directly to the nozzle to project a weft during initial threading up.

I. Conversion of Shuttle Looms

While the air weft insertion system of the invention can advantageously be embodied into a loom of new design, any entirely new loom would require substantial, if not complete, redesign in order to make optimum use of the features of the invention and would entail a large capital investment for the invention to become available to the textile industry. It has been found that the principles of the invention are equally suited for the conversion of existing shuttle looms with only relatively modest modifications which would permit the invention to be used at far less cost, and the details of what is involved in converting an existing shuttle loom for the practice of the invention will now be described.

Since the present invention dispenses with the shuttle, the conventional picker motion and shuttle boxing motion can be completely eliminated. While the lay is retained, the massive lay beam ordinarily required in shuttle looms is unnecessary and undesirable and can, accordingly, be replaced by a skeleton lay consisting essentially of a light-weight channel to support the weft guidance tube, insertion nozzle and other related components. Since the diameter of the guidance tube is significantly smaller than the shed "envelope" required for the shuttle, the maximum separation of the shed can be reduced by at least about 30%, e.g. from about 2.4" of vertical separation for the shuttle loom to about 1.7" in the loom of the invention, which makes possible several other desirable alterations. First, the reduced shed opening means that the arcuate path of the lay can be correspondingly shortened, i.e. by about 30%, specifically from about 6" for a shuttle loom to 4.5" or less for the invention which in itself allows the lay driving rate to be increased. Secondly, the reduction in the maximum shed opening makes possible a corresponding reduction in the vertical travel of the harness motion. Inasmuch as the harness motion on existing shuttle looms is an important factor in limiting maximum operating speed, this change is especially advantageous. The fell line as well as the shed angle (i.e., the included angle between the separated warps of the shed) remain unchanged here. However, the harness motion must be shifted forwardly from its usual location relative to the lay, but this can be done with little difficulty particularly as most existing looms already provide for adjustment of the harness position.

With these modifications, and subtracting the added weight of the special inventive components, the overall weight of the loom, and particularly its reciprocating parts, can be reduced by several hundred pounds; consequently, about 16–20% less power is required to drive the loom of the invention, e.g. about ¾–1 HP versus 1.2 HP for a shuttle loom. The ultimate result of all of these savings is a converted loom capable of operation at 2–3 times the maximum speed of conventional shuttle looms at a cost of 10–20% of the cost of a completely redesigned new loom.

II. Operation of the System of the Invention a. Introduction

In the course of the preceding detailed description of the apparatus of the system of the present invention, considerable information has already been conveyed, either directly or indirectly, as to the mode of operation that is followed in the practical utilization of this apparatus. However, certain process conditions are of peculiar importance in the invention and need more detailed description augmented with actual test results.

Some preliminary general comments might be helpful to an understanding of the results of these tests which, basically, involve the projection through the warp of a standard 48" loom of a proper length of yarn drawn from the weft metering and storage device described above through a "standard" weft guidance tube utilizing a given combination of nozzle configuration and test conditions. For this purpose, a "standard" guidance tube is 48" in length, composed of 310 equally spaced annular elements, one for roughly every 12 warp strands, each ⅛" in thickness (i.e. axial dimension) and having a ¾" diameter honed internal bore. For each test, the supply chamber of the nozzle, and the accumulation reservoir where present, are pressurized with air to a given "supply pressure" by an uninterrupted connection to a pressure main of the same pressure, and the actual values of the "supply pressure" are measured by means of a pressure gauge (not shown) communicating with the interior of the nozzle supply chamber. A feed tube having an outside diameter of 0.095" is arranged within each nozzle with its free end projecting approximately ⅛" beyond the plane of the exit of the contoured section exclusive of the extension barrel where present, and the weft to be projected is introduced into the feed tube with its leading free end projecting a short distance, e.g approximately 1", exteriorly of the feed tube end, and simulating a practical weaving condition where the weft is cut between the nozzle and fabric edge.

After the nozzle has been activated or "fired" with a sufficient level of supply pressure, the weft length will be projected through the nozzle and into the guidance tube. For a given nozzle arrangement and set of test conditions, the time required for the free end of the weft length to traverse the entire length of the guidance tube and emerge from the far end thereof has been found to be reproducible with a reasonable level of accuracy, and this time, referred to herein as the "weft arrival time" is a useful characteristic in evaluating the effectiveness of the particular test conditions. For consistent evaluation, a distance of 52" has been fixed as a practical test distance the weft must travel for measuring these weft arrival times, this distance including the guidance tube itself and sufficient clearance space at either end to approximate what would be needed in actual practice on a 48" loom.

The technique used for measuring the "weft arrival times" is as follows: A stroboscope is located at the fixed test distance from the nozzle (outside the egress end of the guidance tube), the stroboscope being activated by means of an adjustable interval timer, calibrated in microseconds, which is started by the firing of the nozzle itself so that the strobe flashes after passage of whatever interval of time is set on the timer following the instant of nozzle firing. The egress end of the tube is then visually observed by a human observer to see the location of the leading end of the weft when the stroboscope flashes. The test is repeated with appropriate adjustments of the timer by trial and error until the leading end of the weft can be seen just reaching the 52" test point at the moment of the flash. This technique is simple with a good degree of reproducibility virtually free of human error and can easily be recorded for subsequent confirmation with a camera viewing the test point. Once the timer reading matching the instant of arrival of the weft is formed, the test is repeated once or more times to insure accuracy. When measured in this fashion, weft arrival times accurate to 1 millisecond (ms) have been obtained with reasonable consistency.

The firing of the nozzle will deliver a burst of air into the guidance tube and the emergence of this flow of air can be detected (and actually felt by hand), and, here again, the time required for the air current to traverse the given fixed distance, namely 52" is generally reproducible for a given set of conditions and has been found to provide an indication of the maximum theoretical efficiency that a given arrangement is capable of achieving under a given set of conditions. The period of time for the air burst to pass through the tube and reach the fixed end point is referred to herein as "air arrival time" and is preferably measured by means of a hot wire anemometer situated at the fixed point and connected to the recording oscilloscope measuring the lapse in time in milliseconds between firing of the nozzle and response of the anemometer. As is known in the art, a hot wire anemometer changes in electrical resistance in response to fluctuations in its ambient temperature, which resistance changes can be detected by a recording oscilloscope. Since a change in the velocity of air ambient to the hot wire produces a temperature fluctuation at the wire, this device effectively detects the instantaneous arrival of the air flow at the fixed point.

As is well known from the principles of fluid flow, the pressure which is actually delivered to the throat of a nozzle is virtually never the same as the supply or line pressure since the pressure level which can be "seen", i.e. received, by the nozzle throat will necessarily be affected by the inherent resistance of impedance in the connections existing between the supply lines and the nozzle itself. The term "head pressure" or "stagnation pressure" is used in the art to differentiate actual nozzle pressure from supply or line pressure, and this distinction is followed here. Specifically, the term "head pressure" or the equivalent "stagnation pressure" as employed in describing the various tests carried out here is intended to mean the pressure measured by a strain gauge pressure transducer mounted about the midpoint of the delivery passage of the nozzle upstream of the throat, as indicated roughly by the dotted lines designated 114 in FIG. 4, the signal from this transducer being delivered to a recording oscilloscope. On the other hand, the term "supply pressure" is that pressure measured by a gauge connected to the supply chamber which will be in equilibrium with the line pressure before nozzle activation.

With these preliminary explanatory observations, the discussion will now address particular operating conditions.

b. Nozzle Pressure

It is of critical importance to the present invention that the "head pressure" of the nozzle be sufficiently large to achieve a "choking" condition at the throat of the nozzle itself and not upstream or downstream of the nozzle throat. The term "choking" has been derived from the field of aeronautical testing, e.g. wind tunnel testing, and is accepted to mean the delivery to the nozzle of air under sufficient pressure that the velocity profile across or transversely of the air flow passing through the throat area uniformly equals sonic velocity, i.e., has a velocity of Mach No. 1.0. Generally, it is known that a nozzle throat will be "choked" in this sense when the ratio of the head or stagnation pressure actually available to the throat itself to ambient pressure is at least 1.894/1. Contrary to the experience of aerodynamic testing where choking is an undesirable phenomenon, it is essential in the practice of the present invention that a choking condition be produced directly in the nozzle throat and not before or after that throat in order to maximize the thrusting capability of the nozzle upon the strand disposed therein.

Thus, the throat of the nozzle of the present invention must constitute the point at which maximum impedance occurs within the delivery connections between the pressure source and the nozzle throat, including impedance due to turbulence of flow as well as boundary layer phenomena. By the term "boundary layer phenomenon" is meant the tendency of a layer of fluid adjacent a stationary surface or boundary to be substantially stationary and exert resistance to the flow of fluid along that surface, the extent of such resistance increasing as the surface length increases. To this end, the air supply components of the present invention are especially designed to allow air to flow therethrough with minimum impedance losses of all kinds, the distances between the pressure supply source, i.e the supply chamber and accumulator and the nozzle being as short as reasonably possible, and all connecting lines being of sufficiently large size as to eliminate significant impedance. Further, the delivery passageways extending from the supply chamber to the throat are carefully contoured for turbulent-free flow together with sufficient circumferential dimension as to substantially exceed, e.g by a factor of about 5, the actual throat cross-sectional area, notwithstanding roughly equal radial or annular dimensions, bearing in mind that the annular throat area of the present nozzle is reduced by the presence of the feed tube therein.

As already stated, the basic determinant of nozzle choking is the existence of a pressure relationship between the nozzle head pressure and the ambient atmosphere in the order of approximately 2:1, and the achievement of this ratio is the prime indicator of the occurrence of a choking condition. However, additional indications of this condition are provided by the quantitative relationship of the head pressure to the supply pressure, in that the head pressure for a choked nozzle will tend to more closely approach the supply pressure and by the pressure "history" for the nozzle obtained during a cycle of operation. If the pressure transducer communicating with the nozzle delivery passage just upstream of the nozzle throat is used to continuously record on an oscilloscope the pressure at that point during an operating cycle, the pattern of this recording gives a pressure trace or "pressure history" which reveals significant information about the nozzle, as will be explained.

Where the nozzle length is extended to project, e.g. by means of a barrel, downstream of the throat region which can be advantageous for certain purposes, care must be taken to insure that the length of such extension is not such as to superimpose upon the system a subsequent or downstream "choking point" that would defeat the critical requirement of the invention of choking directly at the throat. The boundary layer effect in an extended cylindrical tube introduces an increasing resistance or impedance according to the tube length, which is comparable in effect to a physical restriction analogous to a throat, and this effect cannot be permitted in this invention to develop to the extent of creating a "virtual throat" smaller than and downstream of the actual throat.

In order to give a comparison between a variety of different nozzles for the purpose of the present invention, extensive testing has been carried out with nozzles of different contours and dimensions, and the results thereof appear hereinafter.

c. The Nozzle Contour

For purposes of this invention, the contour of the nozzle does not appear to be critical and is subject to considerable variation. Early in the research underlying this invention, the hypothesis was drawn that a nozzle designed to produce supersonic air flow would be distinctly advantageous, if not crucial, to optimum high speed projection of weft strands in a loom. Subsequent working data have disproved this hypothesis in that while a nozzle designed for supersonic flow is certainly suitable for the practice of the invention, virtually the same operating efficiency can surprisingly be attained by nozzles which are not designed for supersonic flow.

(1) "Supersonically Contoured" Nozzle

The design of the nozzle contoured for supersonic flow has been thoroughly explored in the aerodynamic field and requires no detailed explanation here. Briefly, a so-called supersonic nozzle requires an outlet opening located downstream of a converging throat, the ratio of cross-sectional areas of the outlet opening relative to the throat being greater than 1, with the interior nozzle wall in the region between the throat and outlet being smoothly diverging in contour. With such a nozzle, the air flow at the throat reaches sonic velocity, and, if pressurized sufficiently, upon entering the downstream divergent area will undergo an expansion with consequential acceleration to above sonic speeds. The degree of expansion and consequential flow acceleration determines the maximum velocity capability of the nozzle, i.e. its effective Mach number, and each nozzle nust have its design parameters carefully selected in accordance with its intended design Mach number capability when operated at a given design pressure level. It is preferred that the divergent contouring be such as to produce flow expansion under carefully controlled conditions to thereby preclude the possibility of so-called shock wave formation caused by undesirable over expansion and subsequent collapse or recompression of the flow current to restore equilibrium. Also, the exit pressure at the outlet opening should ideally speaking, exactly equal atmospheric pressure for the same reason of avoiding shock wave formation. Calculations establishing the precise contours required for supersonic nozzles over a range of Mach number capabilities have been evolved in the aerodynamic art and additional practical information on this subject can be found in the paper "The Design of Supersonic Nozzles" by A. McCabe, the British Aeronautical Research Committee (BARC) Reports and Memoranda, No. 3340, 1967, while a theoretical treatment appears in the text *Aerodynamics of a Compressible Fluid* by Leipmann and Puckett, John Wiley & Sons, New York, 1947, especially pages 30–37 and 218–232. For present purposes, precise application of these calculations has not been found essential and an approximation acceptable for the invention can be obtained by simply establishing (e.g. with so-called "French curves") a smoothly curved divergent contour between the throat area and the exit opening of the nozzle.

To demonstrate the behavior of supersonically contoured nozzles, which for convenience are referred to here as "contoured nozzles", a series of tests was carried out with a given contoured nozzle alone and modified by the addition of extension barrels of varying length, such barrels being uniformly cylindrical in shape with a diameter matching the exit diameter of the nozzle and a length related to the nozzle exit diameter by factors of 5, 10 and 20, respectively. The nozzle in this case was designed with a throat cross-sectional area of 11 $mm^2$, a throat diameter of 0.175", and an exit diameter of 0.186" to give a Mach number of approximately 1.5 for a "design" stagnation pressure of 39.3 psig. The axial distance between the plane of the throat area and the plane of the exit opening is 0.120", and the nozzle surface is smoothly contoured in divergent fashion from the throat to the exit opening. The test results for these nozzles operated at supply pressures ranging from 40 to 120 psig, in 10 psig increments, in terms of air arrival times, weft arrival times as well as the effective head pressures attained appear in Table I below, while the data from this table for weft and air arrival times versus supply pressure for all four nozzles is plotted in FIG. 22, the respective nozzles being designated according to the legend appearing on that figure. The indication "NA" means "no arrival", i.e. the weft length could not be projected across the 52" test length at the corresponding condition.

TABLE I

Effect of Extension Barrels on Contoured Nozzle

| Supply Pressure | Air Arrival Time (ms) | | | | Weft Arrival Time (ms) | | | |
|---|---|---|---|---|---|---|---|---|
| | No Bbl | 5 × D Bbl | 10 × D Bbl | 20 × D Bbl | No Bbl | 5 × D Bbl | 10 × D Bbl | 20 × D Bbl |
| 40 | 37 | 35 | 34 | 35 | NA | NA | 56 | 58 |
| 50 | 30 | 30 | 30 | 32 | 98 | 45 | 42 | 42 |
| 60 | 27 | 27 | 26 | 28 | 53 | 36 | 36 | 34 |
| 70 | 26 | 24 | 25 | 25 | 50 | 34 | 30 | 30 |
| 80 | 24 | 23 | 23 | 24 | 44 | 33 | 29 | 27 |
| 90 | 23 | 22 | 22 | 23 | 33 | 27 | 27 | 26 |
| 100 | 21 | 21 | 20 | 22 | 29 | 27 | 26 | 23 |
| 110 | 20 | 20 | 19 | 21 | 27 | 25 | 23 | 23 |
| 120 | 18 | 19 | 18 | 19 | 26 | 23 | 21 | 21 |

| Supply Pressure | Head Pressure (psig) | | | |
|---|---|---|---|---|
| | No Bbl | 5 × D Bbl | 10× D Bbl | 20 × D Bbl |
| 40 | NA | NA | 40 | 39 |
| 50 | 48 | 48 | 48 | 50 |
| 60 | 57 | 57 | 60 | 59 |
| 70 | 67 | 68 | 70 | 68 |
| 80 | 78 | 78 | 78 | 78 |
| 90 | 88 | 90 | 90 | 87 |
| 100 | 99 | 99 | 98 | 97 |
| 110 | 110 | 108 | 110 | 108 |

TABLE I-continued

| Effect of Extension Barrels on Contoured Nozzle | | | | | |
|---|---|---|---|---|---|
| | 120 | 120 | 120 | 120 | 120 |

From the data of Table I several conclusions can be drawn. The effect on the air arrival times across this broad supply pressure range of the addition of extension barrels to a contoured nozzle is minimal—the curves representing air arrival times for the four nozzles cluster closely together and are very likely within the range of experimental error. However, the addition of an extension barrel significantly improves weft arrival times for the particular contoured nozzle of this test when operated at low supply pressures, this nozzle having poor efficiency at such low pressures, the difference in barrel lengths having relatively small significance. At higher operating pressures, on the other hand, the unmodified contoured nozzle, i.e. without an extension barrel, operates nearly as efficiently as the extended contoured nozzles. It will be seen that the head pressures achieved by this group of nozzles come close to the corresponding supply pressures; thus, essentially all of the energy of the supply pressure was effectively delivered directly to the nozzle with little measurable impedance indicating the occurrence of choking at the nozzle throats irrespective of the absence or presence of an extension barrel.

(2) "Straight" Nozzle

In addition to supersonically contoured nozzles, there have also been tested for purposes of this invention nozzles which instead of being contoured divergently downstream of the convergent throat area, extend cylindrically, i.e. with uniform diameter, to the plane of the exit opening to the ambient atmosphere. Such nozzles are referred to here as "straight" to distinguish them from supersonically contoured nozzles and when choked have only a maximum flow velocity at the nozzle throat of Mach No. 1.0, although upon leaving the exit opening, the air flow is sufficiently pressurized may expand into the atmosphere and hence may reach supersonic velocity in a region adjacent the nozzle exit. The air delivery path for the straight nozzle is identical to that of the contoured nozzles, (i.e. as shown in FIG. 4), the only change being the replacement of an end insert section of the nozzle to give the different shape and/or size. Since a straight nozzle already incorporates a short extension barrel equal to about 5×D, extending downstream of the throat, comparative tests with additional extension barrels were not carried out for straight nozzles, but instead tests were performed with straight nozzles of varying throat area to illustrate the effect of increasing throat area on nozzle performance, which effect would be expected to be substantially the same for both contoured and straight nozzles. The straight nozzles tested included one of 11 $mm^2$ cross-sectional throat area with a throat exit diameter of 0.175" (for direct comparison with the unmodified contoured nozzle of Table I) plus two others with throat cross-sectional areas of 16 and 32 $mm^2$, respectively, corresponding to throat exit diameters of 0.2015" and 0.268". The same feed tube associated with the contoured nozzle test was used here with its free end projecting just past the exit plane of the nozzle and with the weft introduced with a 1" projecting length beyond the feed tube end as before.

The results of the tests of these straight nozzles appear in Table II and have been plotted in FIG. 23, the several sized nozzles being identified by captions.

TABLE II

| Effect of Throat Size Variations with Straight Nozzle | | | | | | | | | |
|---|---|---|---|---|---|---|---|---|---|
| | Air Arrival Time (ms) Throat Area ($mm^2$) | | | Weft Arrival Time (ms) Throat Area ($mm^2$) | | | Head Pressure (psig) Throat Area ($mm^2$) | | |
| Supply Pressure | 11 | 16 | 32 | 11 | 16 | 32 | 11 | 16 | 32 |
| 40 | 36 | 28 | 21 | NA | 64 | 45 | NA | 39 | 39 |
| 50 | 33 | 26 | 19 | 98 | 55 | 39 | 48 | 48 | 45 |
| 60 | 29 | 25 | 18 | 50 | 44 | 35 | 57 | 57 | 50 |
| 70 | 27 | 22 | 17 | 49 | 33 | 31 | 70 | 67 | 60 |
| 80 | 25 | 20 | 16 | 48 | 30 | 26 | 78 | 78 | 70 |
| 90 | 23 | 19 | 15 | 36 | 30 | 25 | 87 | 87 | 76 |
| 100 | 23 | 18 | 14 | 35 | 30 | 24 | 97 | 96 | 87 |
| 110 | 20 | 18 | 13 | 30 | 32 | 21 | 110 | 108 | 99 |
| 120 | 20 | 17 | 12 | 26 | 25 | 20 | 120 | 118 | 108 |

From these results, one concludes that air arrival times as well as weft arrival times are generally improved, i.e., lower, by increasing the cross-sectional area of the nozzle throat. Here again, the efficiency of the 11 $mm^2$ nozzle, similar to the contoured nozzle of Table I, is substantially better at higher than lower operating pressures, and such behavior is seen to some extent for the 16 $mm^2$ nozzle. That is, while all of the tested nozzles exhibit a potential or capacity for highly accelerated weft delivery times, as shown by their air delivery times, that potential may in fact be realized only when their driving pressure has been adjusted to a sufficiently high level since it is at these higher pressures that the weft delivery times exhibit a pattern which begins to track or parallel the pattern of the air arrival times. For this reason, it is preferred in actual practice that the supply pressure for a given weft and nozzle be adjusted as necessary to produce weft arrival times which change as a function of pressure at the same rate as the air arrival times, i.e. that the supply pressure be within the region where the weft and air arrival times are substantially parallel and optimum performance is actually realized.

d. Nozzle Supply Capacity Variations

In all of the tests of Tables I and II above, the pressure source for all nozzles tested included a supplemental supply reservoir or accumulator designated 137 in FIG. 1 having a volume of 80 $in^3$ in addition to the 6 $in^3$ capacity of the nozzle supply chamber itself, this accumulator being connected to the nozzle supply chamber inlet opening through a ⅜" I.D. line of not more than 12" length and in turn connected to a line pressure main having the indicated supply pressure. To illustrate the difference this added supply capacity makes on nozzle performance, oscilloscopically derived head pressure traces were recorded using the contoured nozzle of Table I having the 5×D barrel at a supply pressure of 100 psig with the supplemental reservoir connected and disconnected, respectively, and these head pressure traces are shown side by side in FIGS. 34A and 34B wherein each horizontal unit represents a time interval of 5 or 10 secs. and each vertical unit pressure change of 30 psig. Both traces confirm the almost instantaneous response time of the preferred nozzle design of the invention, that is, the pressure rises from zero to a maximum near in both cases to the 100 psig supply pressure in less than 2 ms, and actually exceeds that pressure very briefly before the pressure wave oscillations stabilize or dampen out after a few more milliseconds. It can be seen, however, that with only the nozzle supply chamber capacity itself available, the head pressure after reaching maximum gradually decreases until at the end of the approximately 15 ms nozzle activation period, the head pressure in the nozzle of the small capacity (6 in$^3$) has dropped to approximately 70–75 psig. In contrast, with the supply capacity augmented to a full 86 in$^3$, as preferred, the pressure trace exhibits a virtual flat plateau maintaining full head pressure over the entire activation interval of the nozzle and drops only after flow of air to the nozzle has been positively terminated.

Data showing the effect of the difference in air supply capacity on air and weft delivery capabilities of the nozzle is summarized in Table III below from which one learns that the high capacity gives significantly improved efficiency at lower pressures and slight improvement at higher pressures. The data of Table III appears graphically in FIG. 27 (consilidated with curves illustrating the effect of another variable, i.e. the Mach number in contoured nozzles which will be discussed later).

TABLE III

| Nozzle Type | Mach No. | Effect on Weft Arrival Times (ms) of Variation in Supply Capacity — Supply Pressure 30 | 40 | 50 | 60 | 70 | 80 | 90 | 100 | 110 | 120 |
|---|---|---|---|---|---|---|---|---|---|---|---|
| | | A. Large Capacity (86 in.$^3$) | | | | | | | | | |
| Con No Bbl | 1.5 | 68 | 63 | 59 | 50 | 39 | 35 | 35 | 33 | 28 | 25 |
| | | B. Small Capacity (6 in.$^3$) | | | | | | | | | |
| Con 5 × D Bbl | 1.5 | — | 75 | 75 | 52 | 38 | 32 | 28 | 28 | 28 | 26 |

In the pressure traces for both the small and large capacity nozzles, after completion of the "rise time", the supply pressure remains well above ambient pressure over the entire pulse interval, and a distinct inflexion or break appears in each trace only when the control valve is positively moved to closed position to cut off the air flow, the head pressure then decreasing fairly rapidly to ambient. This behavior indicates that the supply capacity volume, even when only 6 in$^3$, is very substantially in excess of the rate of flow that can pass through the nozzle throat at the given pressure over the pulse interval and that the supply capability of the supply chamber is in fact delivered to the nozzle throat at a rate greater than the nozzle flow rate.

The "fall time" of each pressure trace tends to be somewhat longer than the "rise time" due to the need of residual air in the delivery passages between the nozzle diaphragm valve and throat to dissipate but the bulk of the pressure drop occurs almost instantaneously and the remainder has no perceived effect on nozzle performance. As previously stated, any clamping of the weft must occur only after substantial decay of the trace to avoid disintegration of the weft.

e. Air Pulse Width Variation

The results comparing high and low air supply capacities, were, as stated, obtained with an approximate 15 ms nozzle activation interval, as were the results of Tables I and II, and the option exists of altering this interval to change the duration of the air pulse emitted by the nozzle. The effect of such alteration for both large and small capacity nozzles is set forth in Table IV for the 11 mm$^2$ area contoured nozzle of Table I supplied with a pressure of 80 psig.

TABLE IV

| | Effect of Variation in Air Pulse Width — Pulse Width (ms) 5 | 8 | 10 | 15 | 20 | 25 | 30 | 35 | 40 |
|---|---|---|---|---|---|---|---|---|---|
| A. Large Capacity | | | | | | | | | |
| Air Arrival (ms) | NA | 28 | 25 | 23 | 23 | 23 | 23 | 23 | 23 |
| Weft Arrival (ms) | NA | NA | 55 | 33(28) | 28 | 26 | 26 | 26 | 26 |
| Integrated Pressure Units | — | — | — | 1179 | — | — | — | — | — |
| B. Small Capacity | | | | | | | | | |
| Weft Arrival (ms) | — | — | — | 39 | 31 | 29 | 30 | — | — |
| Integrated Pressure Units | — | — | — | 970 | 1102 | 1473 | 1560 | — | — |

Below the 10 ms level, the nozzle was incapable of projecting the yarn across the full 52" distance at all, as indicated by the letters "NA" (no arrival), but significant improvement was obtained with this nozzle at higher operating pressures, as was true in Table I and FIG. 22. In the test utilizing only a small capacity (6 in$^3$) unit, only weft arrival times were recorded at several pulse width intervals.

Based on this data, for the nozzles in question, the air pulse width or duration should be at least about 10 ms and preferably within the range of about 15–35 ms at the preferred pressure range of about 60–80 psig, dependent upon air supply capacity and other considerations.

To provide an alternative basis of evaulation, the areas under the pressure traces for the pulse obtained with the small capacity (6 $in^3$) air supply plus one large capacity pulse for comparison were integrated to give a value representing the total quantity of "pressure units" expended during the entire air pulse, and these values are stated in Table IV as "integrated pressure units". The weft arrival time for the large capacity nozzle varied somewhat from an earlier value, the latter being indicated in parentheses. It will be seen from these values that the large supply capacity (86 $in^3$) nozzle can achieve roughly equal arrival times as a small capacity nozzle consuming about 30–40% more pressure energy, as measured in integrated pressure units.

f. Comparative Prior Art Simulation

To afford a basis for evaluating performance of the system of the invention against the performance typically achieved by prior art air weft insertion systems, a simulation of a typical prior art system was devised as shown schematically in FIG. 24. To eliminate the influence on performance of nozzle design, the nozzle of the simulation was actually a version of the nozzle of the invention, as depicted in FIG. 4, with the actuating diaphragm removed and the 6 $in^3$ supply capacity volume blocked out with an impermeable filler, e.g. wax, so that air admitted to the end opening of the nozzle fed directly into the annular passage 115 in the nozzle head and thence to the delivery passageway of the nozzle. The nozzle inlet was connected by three feet of an air conduit of ⅜" O.D. and about ¼" I.D. to the outlet of a ¼" cam operated poppet diaphragm valve. The inlet side of this valve was in turn connected by 12" of the same tubing to a pressure regulated capacitor. The poppet valve was actuated by means of an air motor rotated at approximately 400 rpm, the configuration of the cam being such that the poppet valve was displaced to open position for an interval of 55–60 ms.

In order to allow the air motor driven poppet control valve to be brought up to operating speed before delivery of the air thereto, the air supply capacitor actually took the form of one of the nozzles of the invention including the supplemental reservoir (total capacity $86''^3$), the outlet of the nozzle being connected to the inlet of the poppet valve as stated. In this way, instantaneous delivery of the air to the already working poppet valve could be readily accomplished, the supply nozzle valve being maintained in open position throughout the full operating interval of the poppet valve. The pressure delivered by this supply nozzle was adjusted to provide the desired effective supply pressure to the poppet valve. All other conditions were the same as in the tests of Tables I and II, and air arrival times, weft arrival times, as well as pressure traces, were derived and recorded as before.

Figure 26:
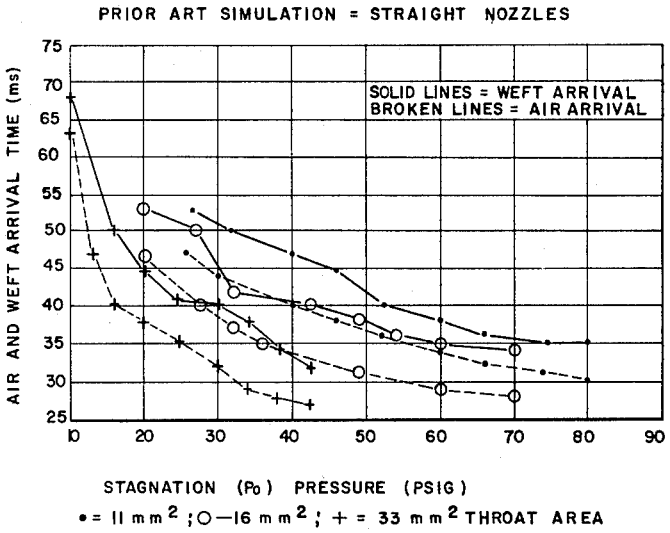
FIG. 26 is a comparative graph plotting air and weft arrival times versus actual nozzle stagnation or head pressure achieved by the prior art simulation of FIG. 24 with the same nozzles as in the graph of FIG. 25.
Figure 28A:
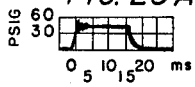
Figure 28B:
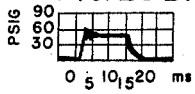
Figure 28C:
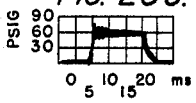
Figure 28D:
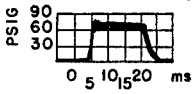
Figure 28E:
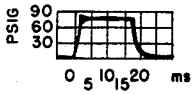
Figure 28F:
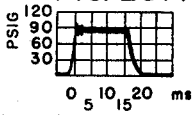
Figure 28G:
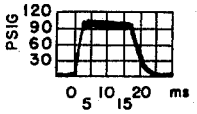
Figure 28H:
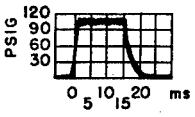
Figure 28I:
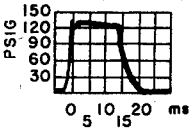

The nozzles employed in the prior art simulation were the straight nozzles of Table II, having the same varying areas of 11, 16 and 32 $mm^2$, respectively, without any additional extension barrel. The duration of the air pulse was 55–60 ms. The results of these tests are summarized in Table V below and are plotted graphically in FIGS. 25 and 26 which plot air and weft arrival times versus supply pressure and nozzle head or stagnation pressure, respectively.

TABLE V

Results of Prior Art Simulation with Straight Nozzles of Varying Throat Area

| | Air Arrival Time (ms) Throat Area ($mm^2$) | | | Weft Arrival Time (ms) Throat Area ($mm^2$) | | | Head Pressure (psig) Throat Area ($mm^2$) | | |
|---|---|---|---|---|---|---|---|---|---|
| Supply Pressure | 11 | 16 | 32 | 11 | 16 | 32 | 11 | 16 | 32 |
| 40 | 47 | 46 | 63 | 53 | 53 | 68 | 26 | 20 | 10 |
| 50 | 43 | 40 | 47 | 50 | 50 | 55 | 32 | 27 | 13 |
| 60 | 40 | 37 | 40 | 47 | 42 | 50 | 40 | 32 | 16 |
| 70 | 38 | 35 | 38 | 44 | 40 | 45 | 46 | 36 | 20 |
| 80 | 36 | 33 | 35 | 40 | 40 | 41 | 52 | 42 | 25 |
| 90 | 34 | 31 | 32 | 38 | 38 | 40 | 60 | 49 | 30 |
| 100 | 32 | 30 | 29 | 36 | 36 | 38 | 66 | 54 | 34 |
| 110 | 31 | 29 | 28 | 35 | 35 | 34 | 74 | 68 | 38 |
| 120 | 30 | 28 | 27 | 35 | 34 | 32 | 80+ | 70 | 42 |

From this data, one learns that the air arrival values for the prior art simulation are substantially independent of variations in the throat area (apart from the 32 $mm^2$ area nozzle at pressures below about 50 psig, which gave even worse values) but in all cases are substantially slower than the air arrival times achieved by the invention. Inasmuch as the air arrival time constitutes a limiting factor on performance, in the sense that the weft arrival times can never exceed the air arrival times so that the most one can hope for is to achieve weft arrival times as close as possible but always somewhat less than the air arrival times, it follows that the weft arrival times achieved in the prior art simulation are inherently inferior to those possible with the system of the invention and are never in fact as short as the desired goal of 30 ms, even with a large area nozzle and very high supply pressures. At low supply pressures, the weft arrival times achieved with the small area nozzles in the prior art system may sometimes be shorter than those achieved with comparable nozzles in the system of the invention, but this apparent advantage is more than offset by the greater duration of the pulse interval in the prior art simulation exceeding by four times the pulse interval of the inventive system, with a consequential greatly multiplied consumption of air. Thus, compared on the basis of actual energy consumed, the system of the invention exhibits significantly greater overall efficiency. In addition, the system of the invention has the potential for greatly improved efficiency by increasing supply pressure which is inherently lacking in the systems operated in the manner of the prior art.

The "pressure signatures" recorded for the various tests in the prior art simulation are duplicated in FIGS. 31A–I, 32A–I, and 33A–I for 11 $mm^2$, 16 $mm^2$, and 32 $mm^2$ throat areas respectively, covering at 10 psi intervals the entire supply pressure range of 40–120 psig and comparable "pressure signatures" for the same 11 $mm^2$, 16 $mm^2$, and 32 $mm^2$ area nozzles operated according to the invention in the tests of Table II appear (with scale changes for convenience as indicated) in FIGS. 28A–I, 29A–I, and 30A–I, respectively, at the same pressures.

Analysis of these pressure signatures shows that for the invention, the instantaneous achievement of maximum nozzle pressure occurs essentially independently of supply pressure, i.e., is virtually identical throughout the entire pressure range, and is only moderately affected by increases in nozzle throat area. Even for a large throat area nozzle, i.e., 32 $mm^2$, the time for the head pressure to rise from zero to maximum, i.e., the "rise time", rarely exceeds 5 ms, in a majority of instances is not more than about 3 ms, and frequently is only 1 ms. Similarly, the "plateau effect" discussed previously, wherein the maximim head pressure persists substantially at full maximum level throughout the entire interval of the pulse, is characteristic of all of the pressure traces representing the inventive system. Even for the maximum throat area nozzle, the loss in pressure from beginning to end of the pulse is in the order of approximately 5% and never goes as high as 10%. The maximum pressure trace levels representing operating head pressures for the invention closely approximate the supply pressure levels. From these relationships, one concludes that the nozzles of the invention are thus delivering pressure energy to the yarn at the highest possible efficiency and are in choked condition.

Furthermore, the portion of the pulse in the invention during which the maximum pressure is at least substantially maintained always substantially exceeds, i.e., by a factor of at least two, the rise time. This means that the pulse is predominantly devoted to useful work with minimum loss in "starting up".

In contrast, the head pressure traces obtained during the prior art simulation exhibit radically different characteristics. In the first place, the "rise time" even for the very small throat area nozzles is in all instances at least, and usually greater than, 20–25 ms and does not become substantially shorter with increasing or decreasing nozzle throat area. That is to say, the slow rise time of the prior art simulation is inherent in the air supply thereof and is not improved by varying the nozzle area. Collaterally with the prolonged rise time, the pressure wave form of the prior art system does not after its initial peak show a temporary oscillation or "hunting" which tends to denote a fully loaded choked condition.

In the second place, even though each nozzle in the prior art simulation maintains maximum head pressure for a significant proportion of the pulse interval and until the poppet valve begins to close upon release of its operating cam, thereby indicating an ample supply capacity of air during the simulation, the actual head or stagnation pressure level occurring within each of the nozzles during the prior art simulation is at most in the order of about 60–70% of the supply pressure levels and is significantly less than the percentages achieved in the invention. However, the difference between head and supply pressures increases dramatically with increasing throat area so that for nozzles with the largest throat area, maximum head pressure is in the order of only 25–30% of supply pressure. From these characteristics, one must conclude that the nozzles in the prior art simulation are in no case choked in the sense of the invention, notwithstanding their operation at supply pressures over the same range.

In the simulation pulses, almost as much, and sometimes more, time is consumed in reaching working pressures, i.e. "starting up", as in maintaining working pressure which imposes a definite obstacle to high operating speeds and efficiency.

g. Other Variable Conditions in the Invention (1) Air Velocity

Since the practically equivalent performance of supersonically contoured and straight nozzles in the system of the invention was unexpected, tests were carried out to check this performance by measuring the actual velocities of air pulses at the moment of entry into the inlet opening of the guidance tube at speeds above and below sonic velocity (i.e., Mach 1) and observing the effect of such variation on air arrival times over the 52" fixed test distance, as well as on the velocities of the air flow measured at the tube exit. This was done by adjusting the distance between the nozzle exit plane and the tube entrance plane to achieve supersonic and subsonic air velocities at the guidance tube inlet, as measured by a hot wire anemometer located in the inlet and calibrated as precisely as possible to accurately indicate air velocity, the exit velocities also being measured by hot wire anemometer. The results of these tests are shown in Table VI below and establish that the air arrival times are virtually identical irrespective of whether the initial air velocity was supersonic or subsonic, although the air exit velocities did reflect (but not proportionately) the difference in starting velocities. This performance held true at head pressure of 60, 80 and 104 psig.

TABLE VI

Effect of Varying Air Velocity with Contoured Nozzle

| Head Pressure | Distance Between Nozzle and Tube | Air Velocity (ft/sec) Tube Entrance | Air Velocity (ft/sec) Tube Exit | Air Arrival Time (ms) |
|---|---|---|---|---|
| 60 | 1.125 | 1200 | 225 | 28 |
| | 2.500 | 900 | 200 | 28 |
| 80 | 1.125 | 1800 | 300 | 26 |
| | 2.500 | 900 | 250 | 26 |
| 104 | 2.000 | 1300 | 375 | 22 |
| | 4.250 | 900 | 300 | 23 |

(2) Spacing Between Nozzle and Guidance Tube

As the preceding discussion suggests, an available option is the adjustment of the clearance space or separation between the exit plane of the nozzle and the entrance plane of the guidance tube and a series of tests to establish the effect of nozzle spacing was carried out using a supersonically contoured nozzle having a throat area of 11 $mm^2$ and a Mach number of 1.5 with and without extension barrels of 5 times and 10 times the nozzle exit diameter, respectively, at a suply pressure of 80 psig, a pulse width of 15 ms and a large capacity ($86''^3$) air supply. The air arrival times achieved when this spacing was gradually varied from zero to 6" are summarized in Table VII.

TABLE VII

Effect of Varying Spacing of Nozzle Exit from Guidance Tube Entrance With and Without Extension Barrel

| | Air Arrival Time (ms) | | |
|---|---|---|---|
| Spacing in Inches | No Barrel | 5 × D Barrel | 10 × D Barrel |
| 0 | NA | NA | 27 |
| .250 | NA | 25 | 26 |
| .500 | NA | 25 | 26 |
| .750 | NA | 25 | 26 |
| 1.000 | NA | 24 | 26 |
| .250 | 25 | 24 | 26 |
| .500 | 25 | 24 | 27 |
| .750 | 27 | 23 | 24 |
| 2.000 | 27 | 24 | 25 |
| .250 | 28 | 23 | 24 |
| .500 | 28 | 24 | 24 |

TABLE VII-continued

| Effect of Varying Spacing of Nozzle Exit from Guidance Tube Entrance With and Without Extension Barrel | | | |
|---|---|---|---|
| | Air Arrival Time (ms) | | |
| Spacing in Inches | No Barrel | 5 × D Barrel | 10 × D Barrel |
| .750 | 29 | 24 | 25 |
| 3.000 | 30 | 23 | 24 |
| .250 | 32 | 24 | 25 |
| .500 | 32 | 25 | 27 |
| .750 | 35 | 25 | 27 |
| 4.000 | 37 | 26 | 27 |
| .250 | 37 | 27 | 28 |
| .500 | 39 | 28 | 27 |
| .750 | 40 | 28 | 29 |
| 5.000 | 45 | 29 | 30 |
| .250 | 46 | 30 | 31 |
| .500 | 55 | 31 | 32 |
| .750 | 58 | 32 | 34 |
| 6.000 | 65 | 34 | 35 |

From these results, it follows that no real optimum location for the nozzle appears to exist and variation in nozzle position within reasonable limit has no significant effect on the air arrival times. Thus, between approximately an inch or less up to approximately 3–4", satisfactory air arrival times are produced and can be improved even further by the addition of a short extension barrel to the nozzle. Beyond about 4" separation, the air arrival times begin to suffer even with the addition of the extension barrels.

(3) Nozzle Mach No.

Another factor susceptible to change in the practice of this invention is the Mach number of the supersonically contoured nozzle and to explore the influence of this variable on weft delivery efficiency, a series of tests was performed using supersonically contoured nozzles having an identical throat area of 11 mm$^2$ with increasing exit opening diameters (i.e. 0.186", 0.207" and 0.220") as necessary to provide design Mach numbers of 1.5, 1.91 and 2.07, respectively. These nozzles were tested for weft arrival times only both with and without a 5×D barrel at supply pressures in the range of 30–120 psig, and the data produced in the tests are summarized in Table VIII and are plotted in FIG. 27. From this data one sees that change in Mach number has little or no practical influence on the effectiveness of the nozzle in propelling the weft, although the addition of a barrel does afford some improvement at lower supply pressures.

TABLE VIII

| Effect on Weft Arrival Times (ms) of Variation in Contoured Nozzle Mach Number | | | | | | | | | | | |
|---|---|---|---|---|---|---|---|---|---|---|---|
| | | Weft Arrival Time (ms) Supply Pressure | | | | | | | | | |
| Nozzle Type | Mach No | 30 | 40 | 50 | 60 | 70 | 80 | 90 | 100 | 110 | 120 |
| Con No Bbl | 1.5 | 68 | 63 | 59 | 50 | 39 | 35 | 35 | 33 | 28 | 25 |
| Con No Bbl | 1.91 | NA | 70 | 62 | 54 | 36 | 35 | 33 | 31 | 31 | 27 |
| Con No Bbl | 2.09 | NA | NA | 72 | 45 | 40 | 34 | 33 | 31 | 29 | 29 |
| Con 5 × D Bbl | 1.5 | 68 | 58 | 39 | 33 | 30 | 30 | 30 | 28 | 26 | 24 |
| Con 5 × D Bbl | 1.91 | NA | NA | 53 | 41 | 30 | 25 | 26 | 26 | 24 | 21 |
| Con 5 × D Bbl | 2.09 | NA | 64 | 43 | 35 | 33 | 33 | 29 | 24 | 23 | 21 |

All of the tests in Table VIII included the large (86"$^3$) supply capacity for the various nozzles, and it will be recalled that FIG. 27 includes a curve representing a test of a Mach 1.5 nozzle with a 5×D barrel identical to the corresponding nozzle of Table VIII, but having a small capacity (6"$^3$) air supply. Comparing these results, one sees the considerable extent of improvement afforded by the addition of the large capacity supply which is particularly prominent at lower pressures, i.e below about 90 psig.

(4) Projected Energy Consumption

The importance of a capability for effective operation at the lower range of supply pressures which characterizes the invention is illustrated by the following Table IX which shows a projected consumption of energy, expressed in kilowatts per minute, for a loom equipped with the system of the invention and operating at 1000 picks per minute for nozzles having throat areas of 11 mm$^2$ and 16 mm$^2$, either supersonically contoured or straight, with a pulse duration of 15 ms and a large (86"$^3$) capacity supply.

TABLE IX

| | Projected Energy Consumption (kilowatts) Supply Pressure (psig) | | | | | | | | |
|---|---|---|---|---|---|---|---|---|---|
| | 40 | 50 | 60 | 70 | 80 | 90 | 100 | 110 | 120 |
| 11 mm$^2$ Nozzle Area | .323 | .447 | .576 | .721 | .873 | 1.03 | 1.203 | 1.378 | 1.56 |
| 16 mm$^2$ Nozzle Area | .473 | .649 | .839 | 1.04 | 1.26 | 1.50 | 1.73 | 1.99 | 2.26 |

Thus, the increase in power consumption is not a linear function of either increasing head pressure or nozzle throat area but an exponential function, the energy consumption at 90 psi supply pressure, for example, being more than three times the consumption at 40 psi.

h. "Balanced Mode" of Operation

In the preceding discussion of the operation of the system of the invention, it is suggested that the selection of (a) a relatively high level of head pressure is advantageous in achieving particularly fast air arrival times, which gave the capability of minimum weft arrival times and offered maximum potential for high operating speeds with (b) a minimum effective duration for the air pulse, i.e. about 15–20 ms, in order to reduce energy consumption as much as possible. When operating in this manner, observation has shown that during flight, the leading end section of the weft tends to become bunched upon itself as it encounters the resistance of the stationary column of air within the guidance tube, and it was reasoned that this problem was aggravated by the fact that the metered and stored length of weft had been withdrawn from the weft storage drum section within a period of time significantly less than the time required for that weft end to actually traverse the width of the loom.

Usually, as the projected weft length completes its traverse, the bunched-up leading section will eventually straighten out and arrive at the reception side of the warp shed but, occasionally, say one to two times per 1000 or so picks of operation, the bunched-up leading section apparently becomes sufficiently tangled as to resist straightening out under the fairly light inertial forces working upon it. When this condition develops, the leading end of the weft does not actually reach the far side of the shed for engagement by the reception tube there, and if the weaving is continued, the result is the introduction of a defect in the fabric being woven. As described, the system of the invention preferably includes a weft arrival detection unit which serves to detect the failure of the weft end to arrive at the reception nozzle and halt the weaving operation automatically to allow for the intervention of a human operator to correct the fabric defect, but this results in loss of production due to the "down time" needed to correct the defect.

Furthermore, the air pulse injected by the nozzle into the guidance tube actually moves through the guidance tube as a kind of column corresponding in length to the duration of the pulse. Thus, the "air arrival" times emphasized in preceding description represent arrival of only the leading end of the column and air continues to advance through the tube until the trailing end of this column passes out the tube. If the weft traveling through the guidance tube slows down or stops while the trailing end of the air column is still advancing rapidly, it has been found that the free weft end can be blown "off course" and out of the guidance tube egress slot 49 instead of continuing through the tube bore. Indeed if the air column is still at full speed after the weft has been entirely withdrawn and its free end held in the reception tube, a "backlash" can occur, pulling the free weft end out of the reception tube and blowing it out of tube egress slot 49. Once the weft free end has escaped through slot 49, a weaving defect, i.e. "mispick" is inevitable.

The bunching and tangling phenomenon has been found upon inspection to always occur on the leading end section, i.e. the last 2–3", of the weft length and one possible solution to this occasional problem would be the addition of enough extra length to the weft that it will reach the reception side of the warp even when the bunching phenomenon occurs. Obviously, however, with the addition of this added length during every cycle (it being impossible to predict in advance a particular cycle during which the phenomenon might occur) the amount of waste produced during weaving is correspondingly increased. Consequently, this solution violates an important objective of the invention of maximizing efficiency and minimizing waste.

It has been discovered that the bunching phenomenon can be better avoided by adjusting the weft insertion thrust and/or resistance so as to arrive at a mode of operation which is more "balanced" in the sense of matching the time required to completely withdraw the stored weft length from the storage section with the time required to completely project the end of that weft length across the full width of the shed. Reduction of the nozzle head pressure, of course, results in a reduction in the thrust imparted to the weft, other conditions being equal, and there can be definite practical advantages in selecting a nozzle head pressure of about 60–70 psig. Most textile mills currently in operation already have available for normal mill functions compressed air at a pressure of about 75–80 psig, which is fully adequate to achieve head pressures of the desired 60 psig or so level, and there are obvious practical advantages in being able to utilize the existing mill compressed air supply. Otherwise, expensive special compressing equipment would have to be purchased and installed to produce the required higher pressure level which would greatly add to the cost of putting the present invention into actual practice.

When operating at a head pressure of about 60 psig as just indicated, the thrust imparted to the yarn is still somewhat excess from the standpoint of achieving the balanced mode of operation described above and additional measures need to be applied.

Several ways are available for balancing weft withdrawal time with weft projection time. On the one hand, the efficiency of the nozzle in transmitting its pressure forces to the weft end can be reduced as, for example, by extending the distance between the end of the yarn feed tube and the exit plane of the nozzle, say increasing the projecting length of feed tube to about $\frac{3}{8}$" instead of about $\frac{1}{8}$" as before, and this is presently the preferred technique. Alternatively, the resistance or "drag" of the weft length during its withdrawal from the weft storage unit can be increased either by increasing the distance between the balloon guide and the end of the delivery drum so as to lengthen the unwinding balloon and increase its diameter or by adding tension to the weft upstream of the inlet of the nozzle.

The effect of the balanced mode of operation is to "stretch" the energy forces applied to the weft over a longer period of time with the result that the withdrawal of the stored weft length does not take place as rapidly as before but instead occurs at a rate substantially matching the rate at which the weft is advancing through the warp shed. Therefore, overrunning of the leading end by the on-coming weft length is virtually eliminated with consequential disappearance of the bunching phenomenon.

Optimum performance is obtained where the free weft end exits from the end of the guidance tube before the stored coils of weft have been completely withdrawn from the drum storage section; that is, the weft end leaves the guidance tube before an initial tension rise is detected by the tension detector 338. Ideally, the arrival of the weft end within the reception tube, as signaled by the photoelectric detection means, occurs virtually simultaneously with the departure of the last of the stored weft from the drum storage unit; that is, the detected tension rise and weft arrival signal are virtually coincident.

Operation with head pressures consistent with available mill line pressures has a further practical advantage, namely, a considerable reduction in the time required for the pulse to decay from its plateau level back to zero. In the "balanced mode" operation, the pulse decay can be reduced to about 7 ms from about 12 ms as typically characterizes the "high impulse" mode. This makes possible the prolongation of the plateau phase of the pressure pulse without concomitant risk of continuation of the pulse after the weft has in fact arrived at the reception side of the shed. Mention has already been made of the fact that if the pulse persists after the weft is in fully straightened static condition, the weft will be buffeted about severely leading to its degradation if not complete disintegration. In the balanced mode the pressure pulse can be "stopped" so to speak, in roughly half the time required for the higher pressures; it thus is easier to insure that the pulse has ended before the weft has achieved a stationary condition within the shed. In general, it is preferred that the pulse be completely decayed about 2–3 ms prior to the arrival of the leading weft end at the reception side of the loom.

It has been discovered that the sacrifice in weft arrival times obtained in accordance with the balanced mode of operation is at most small. For instance, with a head pressure of 60 psig, a pulse duration extended to about 30 ms, and the preferred weft feed tube projection of $\frac{3}{8}''$, air arrival times equal to about 23 ms and weft arrival times of about 32 ms can be consistently attained with ease.

i. Other Conventional Factors

There exists in the operation of the system invention factors other than those described above which are not peculiar to the invention but are shared with prior art systems, so that full description of the role they play is not necessary here. One such factor is the nature of the strand itself and in common with prior art air weft insertion systems, the system of the invention works effectively principally only with relatively rough surfaced wefts. Such wefts are represented by conventional twisted spun staple yarns, either natural or synthetic, and presumably by textured surface synthetic filaments as well. Smooth surfaced mono-filaments have not been examined so far.

The influence of the size of the weft has not been examined thoroughly but the capacity of the various nozzles described above is sufficient to readily accommodate considerable range of conventional deniers and no difficulty is anticipated in the utilization of the inventive system with such yarns, given the potential for supply pressure variation inherent in the present system. Wefts tested to date range from 12's–50's cotton staple yarns, and all have been satisfactorily woven without change in operating conditions.

A further factor is the diameter of the weft guidance tube. Rough bench tests have established that a certain minimum tube diameter is needed for the weft to be effectively transported through the entire tube length. For example, with the various nozzles mentioned above, an inner bore for the tube of $\frac{1}{2}''$ is not adequate; only the large throat area nozzles (32 $mm^2$) are capable of delivering the strand entirely through a $\frac{1}{2}''$ I.D. guidance tube and even with these nozzles, the weft arrival times are quite long, e.g. in the order of 60 ms. On the other hand, tube bore diameters of $\frac{3}{4}''$ are entirely satisfactory and all of the numerous tests appearing above were carried out with a tube of this dimension, as stated. The bore diameter could likely be increased further without drastic consequences on operational effectiveness, but no particular advantage is seen in doing so. A reasonable theory is that if the tube bore diameter is too small in relation to the nozzle outlet diameter, the tube tends to unduly confine the air pulse column emitted by the insertion nozzle, in the sense of frictionally resisting its passage and/or interfering with its freedom to undergo some expansion upon emergence from the nozzle opening. However, so long as the nozzle diameter is sufficiently large to afford the air pulse a minimum dynamic freedom, satisfactory operation is possible and larger diameter tubes would, of course, afford greater freedom. On the other hand, the guidance tube is a critically important part of the system and if omitted, the weft projection capability of the nozzle is extremely limited and far less than the width of any normal sized loom. The applicants suspect that a similar relationship exists between prior art nozzles and tube diameter, although no express recognition of this fact as yet appeared in the published art to applicants' knowledge.

It follows from the preceding comment that the present system is designed for association with "normal-sized" looms, i.e. about 48" in width or greater. Special narrow width looms are known, e.g. ribbon looms, sword looms and the like, but high speed operation of such looms is possible in other ways, i.e. by means of mechanical transports, e.g. swords, because of their much less demanding technological requirements, and little reason exists for resorting in such narrow looms to the more sophisticated approach of the present system.

Further with regard to the guidance tube, mention has already been made of the practice in the invention of mechanically abrading the interior surface of the guidance tube bore to impart a reasonable degree of polish or smoothness thereto, as by means of honing. Air and weft arrival times may be reduced significantly more with internally polished tubes as compared to tubes with surfaces obtained by conventional casting or molding. However, for the balanced mode of operation honing has not been necessary and careful assembly of the elements by means of a jig produces satisfactory registration.

The axial thickness and frequency of the segments making up the guidance tube is generally determined by the requirement that the elements making up the tube be sufficiently close together as to effectively confine the air flow, which can limit the size and number of the warp threads, but this limitation applies to any system utilizing a guidance tube. Segments having an axial dimension of about $\frac{1}{8}''$ and spaced apart about 20/1000–35/1000 have performed well.

j. Specific Example

A shuttle loom of 48" width converted according to the present invention is used to weave print cloth from 40's warp threads spun from a 35/65 mixture of cotton and polyester staple fibers and 35's weft threads spun from the same 35/65 mixture of cotton and polyester staple. The total number of warp threads is 3750 and the reeded width of the warp is 51.5". The loom is equipped with the nozzle of FIG. 5 including the large capacity accumulator and the control unit is the modified mechanical embodiment of FIGS. 11–13. The nozzle is a supersonically contoured nozzle having a throat area of 11 $mm^2$, a Mach number of 1.5 and 5×D extension barrel giving a head pressure of 70 psig. The end of the weft feed tube projects $\frac{3}{8}''$ beyond the end plane of the barrel in contrast to the feed tube arrangement in the various tests in the preceding description where the feed tube terminated in all cases at the exit plane of the nozzle orifice exclusive of any extension, i.e. the plane designated 88 in FIG. 4. The loom is operated at 318 picks per minute.

A representative cycle of operation of the above loom is depicted in the strip chart of FIG. 35 which shows in timed relationship the following wave forms: a the activation, i.e. opening and closing of the weft delivery clamp C, 330; b the head or stagnation pressure of the insertion nozzle; c the weft delivery tension as detected by the tension detector 338; and d the arrival of the weft at the reception tube, as detected by the photoelectric array. The clamp opens at 140°, remains open for a period of 40 ms and closes at 217°. The insertion nozzle is activated at 145° for a period of 34 ms, the head pressure subsiding to starting level at about 220°.

With the activation of the nozzle, the tension in the weft increases from its "previous noise level" almost coincidentally with the nozzle activation and perceptible peak in weft tension occurs at 208° indicating the complete withdrawal of the weft from the drum storage section, the weft tension indicator thereafter subsiding to its inherent "background" level. The arrival of the weft end at the photodetector occurs at 208°, the subsequent peaks e in wave form d being caused by fluttering of the weft end in the reception tube and of no significance. The weft arrival time is 36 ms and the air arrival time (derived by other means) was observed to be 28 ms.

In this description, the abbreviations ms represents milliseconds and psig represents pounds per square inch gauge.

What is claimed is:

1. A method of inserting a weft strand into the shed of a weaving machine comprising the steps of providing a nozzle in proximity to the shed and serving as guide for a weft strand passing therethrough, and abruptly expelling from said nozzle at a supersonic velocity a sustained pulse of a gaseous medium, said pulse being directed toward said shed into the atmosphere ambient thereto to thereby project the weft strand through at least a portion of the shed, said medium being supplied to said nozzle at an operating pressure having a ratio to the pressure of the ambient shed atmosphere of at least about 2.7:1.

2. The method of claim 1 wherein the pressure of the ambient atmosphere varies from atmospheric pressure.

3. The method of claim 1 in which the strand is projected across said shed and said gaseous medium is supplied to said nozzle at an operating pressure maintained within a pressure range at which the lengths of time required for the strand to travel across said shed at different pressures within said range vary at substantially the same rate as the periods of time required for the pulses of said medium emitted at the corresponding pressures to travel across said shed.

4. The method as set forth in claim 1 including the step of confining said strand to a pre-selected path during passage of said pulse of medium and said strand through at least said portion of said shed.

5. The method as set forth in claim 4 including the step of providing through said portion of said shed an elongated confinement zone at least partially open to atmosphere along its length.

6. The method as set forth in claim 1 wherein said pulse is expelled from said nozzle for a pre-selected duration.

7. The method as set forth in claim 6 including the steps of passing, by means of said pulse, the leading end of said strand through said shed from a first side thereof to a second side thereof, and limiting the time said pulse is expelled to a time less than the time required for the leading end of said strand to advance from said first shed side to said second shed side.

8. The method as set forth in claim 6 including the step of traversing a pulse of medium through said shed from a first side thereof to a second side thereof, and limiting the time of expelling said pulse to a time less than the time for a pulse to arrive at said second shed side.

9. The method as set forth in claim 1 wherein said nozzle includes a zone of convergence for the gaseous medium.

10. The method as set forth in claim 9 wherein said nozzle includes a zone of divergence downstream from said zone of convergence.

11. The method as set forth in claim 10 wherein the ratio of the maximum area of the zone of divergence to the minimum area of the zone of convergence is 1.176:1.

12. The method as set forth in claim 10 including the step of providing a medium expansion limiting zone downstream of the said zone of convergence.

13. The method as set forth in claim 1 wherein said operating pressure once attained is substantially constant during said pulse.

14. The method as set forth in claim 1 wherein said medium of said pulse expands after being expelled from said nozzle and including the steps of at least partially confining said strand within a guiding zone of preselected diameter during its passage through at least said portion of said shed, and delivering said medium to the entrance of said guiding zone before said medium has expanded to a size larger than the diameter of said guiding zone.

15. The method as set forth in claim 1 wherein said nozzle includes a zone of convergence through which said strand passes and said strand is shielded from contact with said medium until said strand reaches at least the downstream portion of said zone of convergence.

16. The method as set forth in claim 15 wherein said nozzle includes a zone of divergence downstream of said zone of convergence, and said strand is shielded from contacting with said medium until said strand reaches at least the downstream end of said zone of divergence.

17. The method as set forth in claim 16 wherein said nozzle includes an elongated medium expansion zone downstream of said zone of divergence.

18. The method as set forth in claim 15 wherein said nozzle includes an elongated medium expansion limiting zone downstream of said zone of convergence.

19. The method as set forth in claim 1 wherein said medium is air.

20. The method as set forth in claim 1 wherein said medium is moist air.

21. The method as set forth in claim 20 wherein said air is preheated.

22. In a method of inserting a weft strand into the warp shed of a loom in which a nozzle is located adjacent one side of the shed, said nozzle converging to a minimum cross-sectional area and one end of a length of said strand is delivered to the nozzle for insertion in the shed, the improvement comprising:

(a) providing a source of a compressible medium under a pressure in excess of that required to choke said nozzle and with a supply capacity substantially exceeding the flow rate of said nozzle, and (b) delivering said pressurized medium to said nozzle from said source at a flow rate capability exceeding the actual flow rate possible at said pressure through the minimum area of the nozzle to induce at the minimum area of the nozzle a choked condition of said medium and continuing delivery of said medium to said nozzle to substantially sustain its choked condition for a time exceeding the time required for said choked condition to be achieved, whereby a pulse of pressurized medium of at least supersonic velocity is emitted from said nozzle with consequential projection of said strand length from said nozzle into said shed.

23. The method of claim 22 in which prior to the delivery of said medium, the pressure of the source thereof is adjusted to a level within a pressure range at which the periods of times required for the strand to travel a fixed distance through the shed at different pressures within said ranges varies at substantially the same rate as the periods of times required for the pulses of said medium at said pressures to travel the same distance.

24. The method of claim 22 wherein the delivery of said pressurized medium is discontinued prior to the arrival of the leading strand end at a fixed distance from said nozzle.

25. The method of claim 22 including the step of providing an array of coaxial annular elements projecting between spaced apart pairs of adjacent warp threads, the elements in said array being arranged in axially aligned relationship to define an interrupted tubular zone extending transversely within the shed and adapted to receive therein the pulse and strand end from the nozzle and confine the travel of the same within the shed.

26. The method of claim 27 wherein said pulse has a duration of at least about 10 millisec and said delivery pressure is in the range of about 50–80 psig.

27. The method of claim 22 wherein the time required for said pressure to produce a choking condition in said nozzle after initiation of delivery of said medium to the nozzle is not greater than about 5 millisec and said choking condition after being once achieved substantially exceeds said time by a factor of at least 2.

28. A loom in which a weft strand is inserted into a shed of warp threads comprising a nozzle in proximity to the shed and opening into the shed to serve as a guide for a weft strand passing therethrough, means for delivering to the nozzle a gaseous medium at an operating pressure having a ratio to the atmosphere ambient to said shed of at least about 2.7:1, and means for abruptly expelling from said nozzle a sustained pulse of said gaseous medium, said pulse having a supersonic velocity and being directed toward the shed to thereby project said weft strand through at least a portion of the shed.

29. The loom as set forth in claim 28 including guiding means within said shed for confining said strand to a pre-selected path during passage of said pulse of medium and said strand through at least said portion of said shed.

30. The loom as set forth in claim 29 wherein said in-shed guiding means is at least partially open to atmosphere along its length.

31. The loom as set forth in claim 29 wherein said guiding means defines a guiding zone of pre-selected diameter during passage of said strand through at least said portion of said shed, and including means for maintaining a a relative spacing between said nozzle and the adjacent end of said guiding zone such that said medium upon expansion after exiting said nozzle enters said guiding zone before said medium has expanded to a size larger than the diameter of said guiding zone.

32. The loom as set forth in claim 28 including means for adjusting the duration of said pulse.

33. The loom as set forth in claim 32 wherein said leading end of said strand is passed by means of said pulse through said shed from a first side thereof to a second side thereof, and said adjusting means limits the duration of said pulse to a time less than the time required for the leading end of said strand to advance from said first shed side to said second shed side.

34. The apparatus as set forth in claim 32 wherein a pulse of medium is traversed through said shed from a first side thereof to a second side thereof, and said adjusting means adjusts the duration of the pulse expelled from said nozzle to a time not greater than the time for the traversing pulse to arrive at said second shed side.

35. The loom as set forth in claim 28 wherein said nozzle includes a zone of convergence for the gaseous medium.

36. The loom as set forth in claim 35 wherein said nozzle includes a zone of divergence downstream from said zone of convergence.

37. The loom as set forth in claim 36 wherein the ratio of the maximum area of the zone of divergence to the minimum area of the zone of convergence is 1.176:1.

38. The loom as set forth in claim 36 including means defining a medium expansion limiting zone downstream of the said zone of convergence.

39. The loom as set forth in claim 28 wherein said nozzle includes a zone of convergence through which said strand passes and including means shielding said strand from contact with said medium until said strand reaches at least the downstream portion of said zone of convergence.

40. The loom as set forth in claim 39 wherein said nozzle defining means includes means for forming an elongated medium-expansion-limiting zone downstream of said zone of convergence.

41. The loom as set forth in claim 39 wherein said nozzle includes a zone of divergence downstream of said zone of convergence, and including means for shielding said strand from contacting with said medium until said strand reaches at least the downstream end of said zone of divergence.

42. The loom as set forth in claim 41 wherein said nozzle defining means includes means for forming an elongated medium-expansion-limiting zone downstream of said zone of divergence.

43. In a loom comprising a nozzle located adjacent one side of the loom shed, said nozzle converging to a minimum cross-sectional area and means for delivering one end of a length of a weft strand to the nozzle for insertion in the shed, the improvement comprising:

(a) means for providing a source of a compressible medium under a pressure in excess of that required to choke said nozzle by said medium and with a supply capacity substantially exceeding the flow rate of said nozzle, and (b) means for delivering said pressurized medium from said source at a flow rate capability exceeding the actual flow rate possible at said pressure through the minimum area of the nozzle to induce at the minimum area of the nozzle a choked condition of said medium, and (c) control means for continuing delivery of said medium to said nozzle to substantially sustain its choked condition for a time exceeding the time required for said choked condition to be achieved, whereby a pulse of pressurized medium of at least supersonic velocity is emitted from said nozzle with consequential projection of said strand length from said nozzle into said shed.

44. The method of claim 43 comprising means for adjusting the pressure of said source of medium to a level within a pressure range at which the times required for the strand to travel a fixed distance through the shed at different pressures within said range vary at substantially the same rate as the times required for a pulse of medium to travel the same distance at the corresponding pressures.

45. The loom of claim 43 including means for operating said control means to discontinue the delivery of said pressurized medium prior to the arrival of the leading strand end at a fixed distance from said nozzle.

46. The method of claim 43 including an array of coaxial annular elements projecting between spaced apart paris of adjacent warp threads, the elements in said array being arranged in axially aligned relationship to define an interrupted tubular zone extending transversely within the shed and adapted to receive therein the pulse and strand end from the nozzle and confine the travel of the same within the shed.

47. A method of inserting a weft strand into the shed of a cyclically operating weaving machine, said shed having a length of at least about 48 inches, comprising the steps of: providing a nozzle in proximity to one side of said shed for guiding the free end of a weft strand toward said shed, providing in said shed an elongated weft confining zone at least partially open to atmosphere along its length, and creating a pulse of a pressurized gaseous medium of a duration corresponding to a fraction of the machine operating cycle passing through said nozzle and across said shed to the other side thereof, the magnitude of said medium pressure and said pulse duration being sufficient to impart to said strand end energy adequate to transport the same across said shed to said opposite shed side, and the magnitude of said pulse pressure being selected to deliver the pulse front to said opposite shed side before the arrival thereat of the leading strand end.

48. A method of inserting a weft strand according to claim 47 wherein the duration of said gaseous medium pulse is terminated before the pulse front arrives at said opposite shed side.

49. The method of claim 47 wherein the magnitude of pressure of said gaseous medium is sufficiently high that said pulse is emitted from said confined zone at a velocity significantly higher than the velocity of sound in the atmosphere ambient to said weaving machine.

50. The method of claim 47 including the step of delivering to said nozzle a supply of gaseous medium under an operating pressure having a ratio to the ambient atmosphere of at least about 2.7:1.

* * * * *